US008235167B2

(12) United States Patent
Kobayashi et al.

(10) Patent No.: US 8,235,167 B2
(45) Date of Patent: Aug. 7, 2012

(54) VIBRATING BODY FOR SPEAKER AND SPEAKER DEVICE

(75) Inventors: Hiroyuki Kobayashi, Tendo (JP); Toshihiro Hikichi, Tendo (JP); Takuei Nagasawa, Tendo (JP); Koji Takayama, Tendo (JP); Koji Maekawa, Tendo (JP); Kenichi Oshima, Tendo (JP); Yasuhisa Abe, Tendo (JP); Minoru Horigome, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 13/062,894

(22) PCT Filed: Dec. 25, 2009

(86) PCT No.: PCT/JP2009/071639

§ 371 (c)(1),
(2), (4) Date: Mar. 8, 2011

(87) PCT Pub. No.: WO2011/077560

PCT Pub. Date: Jun. 30, 2011

(65) Prior Publication Data

US 2011/0232990 A1 Sep. 29, 2011

(51) Int. Cl.
*G10K 13/00* (2006.01)

(52) U.S. Cl. ..... 181/163; 181/167

(58) Field of Classification Search ..... 181/163, 181/167

See application file for complete search history.

(56) References Cited

U.S. PATENT DOCUMENTS

| | | | | |
|---|---|---|---|---|
| 1,808,238 | A * | 6/1931 | Sachs et al. | 181/163 |
| 1,885,308 | A * | 11/1932 | Thomas | 181/148 |
| 4,585,090 | A * | 4/1986 | Lindsay | 181/163 |
| 4,595,801 | A * | 6/1986 | Coffin | 381/424 |
| 4,783,820 | A * | 11/1988 | Lyngdorf et al. | 381/89 |
| 6,343,128 | B1 * | 1/2002 | Coffin | 381/186 |
| 6,678,384 | B2 * | 1/2004 | Kowaki et al. | 381/182 |
| 2002/0139609 | A1 * | 10/2002 | D'Hoogh | 181/167 |
| 2005/0279566 | A1 * | 12/2005 | Hooley et al. | 181/163 |
| 2008/0087493 | A1 * | 4/2008 | Ikeda et al. | 181/167 |
| 2011/0051988 | A1 * | 3/2011 | Ogasawara et al. | 381/412 |

FOREIGN PATENT DOCUMENTS

JP HEI02-79693 U 6/1990

* cited by examiner

*Primary Examiner* — Forrest M Phillips
(74) *Attorney, Agent, or Firm* — Osha Liang LLP

(57) ABSTRACT

A speaker vibrating body vibrated by a driving part includes a plurality of diaphragms vibratably supported by a static part supporting said driving part and a diaphragm connecting part, provided between a first diaphragm and a second diaphragm among said plurality of diaphragms, coupling said first diaphragm and said second diaphragm and synchronously moving said first diaphragm and said second diaphragm toward or away from each other.

23 Claims, 40 Drawing Sheets

Prior Art (a)

Enlarged view of A (a)

(b)

Enlarged view of A (a)

(b)

(a)

(b)

(a)

(b)

(a)

(b)

(a)

(b)

(a)

(b)

(a)

(b)

(a)

(b)

(a)

(b)

VIBRATING BODY FOR SPEAKER AND SPEAKER DEVICE

FIELD OF THE INVENTION

The present invention relates to a speaker vibrating body and a speaker device.

BACKGROUND OF THE INVENTION

A patent literature 1 shown below describes a bass reverse speaker device. This speaker device has a speaker unit and a passive vibrating body (passive radiator), a vibration system without a driving system such as a magnetic circuit from the speaker unit, mounted on or in a single cabinet. It can have a preferable low-frequency performance compared to a speaker device mounting a speaker unit on a sealed cabinet.

This speaker unit uses a typical dynamic type speaker device. The dynamic speaker device, for example, as shown in FIG. 1, includes a frame 3J, a cone-shaped diaphragm 21J, an edge 4J through which the diaphragm 21J is supported by the frame 3J, a voice coil bobbin 610J applied to the inner periphery part of the diaphragm 21J, a damper 7J through which the voice coil bobbin 610J is supported by the frame 3J, a voice coil 611J wound around the voice coil bobbin 610J, a yoke 51J, a magnet 52J, a plate 53J, and a magnetic circuit having a magnetic gap in which the voice coil 611J is arranged. In this speaker device, when an audio signal is inputted to the voice coil 611J, the voice coil bobbin 610J vibrates by a Lorentz force developed in the voice coil 611J in the magnetic gap and the diaphragm 21J is driven by the vibration.

PRIOR ART

Patent Literature

[Patent literature 1] Publication of unexamined utility model application H2-79693

SUMMARY OF THE INVENTION

In the above bass reverse speaker device, the passive vibrating body (passive radiator) is vibrated by a air pressure, a driving force for the passive vibrating body, emitted from the rear side of the speaker unit mounted on the same cabinet. This vibration of the passive vibrating body is substantially in the same phase as the speaker unit when it vibrates at its resonance frequency that is determined by compliance of air in the cabinet and the mass of the passive vibrating body. However, when it vibrates at lower frequencies than the resonance frequency, it vibrates substantially in the opposite phase of the speaker unit. As such, sound pressure at a frequency lower than the resonance frequency is reduced and acoustic characteristic is deteriorated. More specifically, the above-mentioned conventional bass reverse type speaker device has its reproduction performance rather decreased in lower frequencies than the resonance frequency. The term "resonance frequency" here, is an antiresonant frequency represented by $(1/2\pi)\times(S_c/M_p)^{1/2}$ ($S_c$: equivalent mechanical stiffness inside a cabinet, $M_p$: equivalent mechanical mass of a passive vibrating body).

Meanwhile, in the above typical dynamic type speaker unit, for example as shown in FIG. 1, a voice coil 611J is arranged in the opposite side of the sound emission side of a diaphragm 21J such that the vibration direction of the voice coil 611J and the voice coil bobbin 610J is the same as the vibration direction of the diaphragm 21J. In the speaker device as configured above, a region for vibration of the diaphragm 21J, a region for vibration of the voice coil bobbin 610J, and a region for arranging the magnetic circuit, etc. are necessarily formed in the vibration direction (sound emission direction) of the diaphragm 21J. Accordingly, it is inevitable that the total height of the speaker device is comparatively large.

Specifically, as shown in FIG. 1, the dimension of the above-mentioned speaker device in the vibration direction of the diaphragm 21J includes (a) the total height of the cone-shaped diaphragm 21J in the vibration direction and the edge 4J through which the diaphragm 21J is supported by the frame 3J, (b) the height of the voice coil bobbin from the joining part of the diaphragm 21J and the voice coil bobbin 610J to the upper end of the voice coil 611J, (c) the total height of the voice coil, (d) the height mainly of the magnet of the magnetic circuit, corresponding to the height from the lower end of the voice coil 611J to the upper end of the yoke 51J, (e) the thickness mainly of the yoke 51J of the magnetic circuit, etc. The speaker device as described above requires sufficient heights of the above-mentioned (a), (b), (c), and (d) to ensure a sufficient vibration stroke of the diaphragm 21J. Further, the speaker device requires sufficient heights of the above-mentioned (c), (d), and (e) to secure a sufficient electromagnetic force. Accordingly, particularly in a speaker device adapted to a large sound volume, the total height of the speaker device inevitably becomes large.

Since the vibration direction of the voice coil bobbin 610J is the same as that of the diaphragm 21J in the conventional speaker device as described above, the total height of the speaker device inevitably becomes large to secure a vibration stroke of the voice coil bobbin 610J, when seeking a large volume sound with large amplitude of vibration of the diaphragm 21J. Thus, it becomes difficult to make a thin device. In other words, the problem is that making a thin device and securing a loud sound are contradictory to each other.

Further, in the conventional speaker device, when a speaker unit is arranged in the cabinet, it is required to provide a large depth of the cabinet on the rear side of the speaker unit corresponding to total height of the speaker unit, when securing a sufficient space volume on the rear side of the speaker unit. As such, the speaker device as a whole including the cabinet becomes large, and thereby there is a problem of limiting installation space for the speaker device. In particular, the installation space for the speaker device is limited specifically in an in-car speaker, etc., and thereby there is a problem that the speaker unit may not be arranged in the cabinet having a sufficient volume.

It is an object of the present invention to overcome the problem described above.

That is, an object of the present invention is such as to improve acoustic characteristic of low-frequency reproduction, to provide a thin speaker device capable of emitting a loud reproduced sound and to enable the whole speaker device including the cabinet to be made thin while providing preferable acoustic performance of the speaker unit by securing a sufficient volume in the cabinet.

To achieve the above-mentioned object, the present invention has at least a configuration according to the following independent claim:

A speaker vibrating body vibrated by a driving part, comprising:

a plurality of diaphragms vibratably supported by a static part supporting said driving part; and a diaphragm connecting part, provided between a first diaphragm and a second diaphragm among said plurality of diaphragms, coupling said first diaphragm and said second diaphragm and synchronously moving said first diaphragm and said second diaphragm toward or away from each other.

BRIEF DESCRIPTION OF THE DRAWINGS

FIG. 2(*a*) is a plan view and FIG. 2(*b*) is a cross-sectional view taken along line A-A of FIG. 1(*a*);

DETAILED DESCRIPTION OF THE INVENTION

Figure 1:
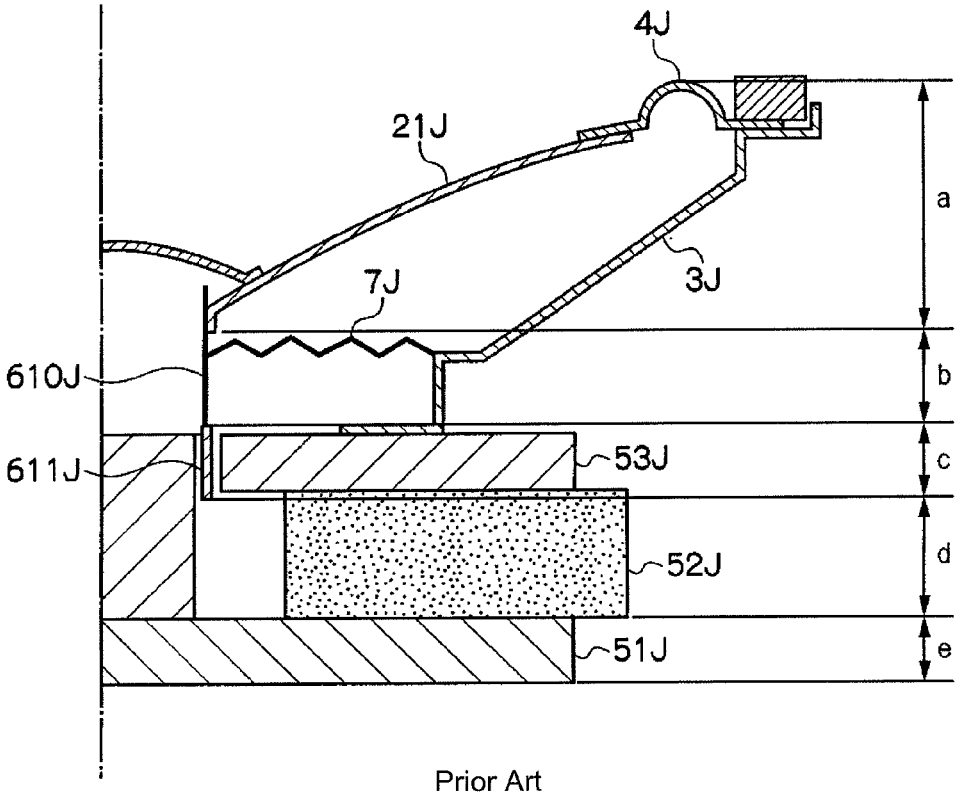
FIG. 1 is a view illustrating a speaker device of a conventional art.
Figure 2:
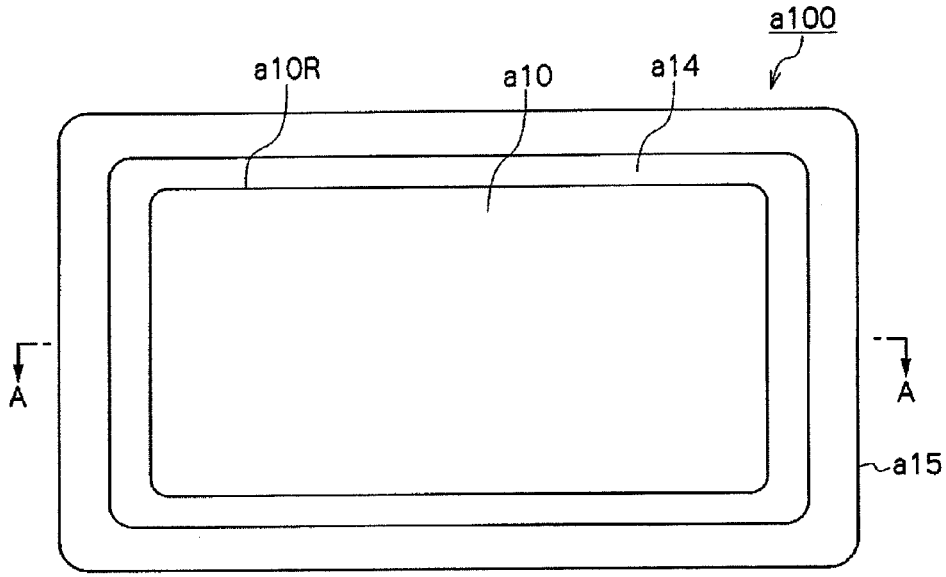
FIG. 2 is a view illustrating a speaker vibrating body according to an embodiment of the present invention.
Figure 2:
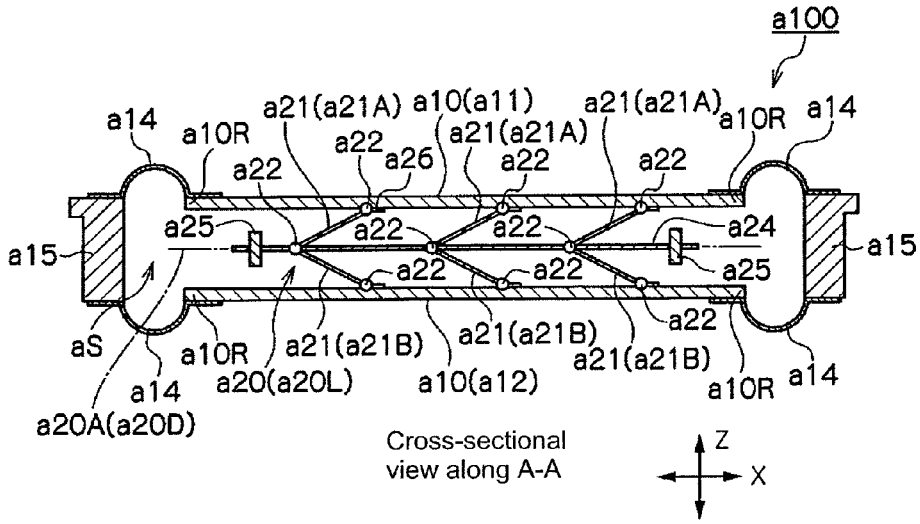

Hereinafter, the embodiments of the present invention are described with reference to the drawings. The embodiments of the present invention include what is described by the drawings, but not limited to it. FIG. 2 is a view illustrating a speaker vibrating body according to an embodiment of the present invention. FIG. 2(*a*) is a plan view and FIG. 2(*b*) is a cross-sectional view taken along line A-A of FIG. 1(*a*).

A speaker vibrating body a100, vibrating on the operation of a driving part (not shown), includes a plurality of diaphragms a10 and diaphragm connecting parts a20. The plurality of the diaphragms a10 are vibratably supported by a static part supporting the above-mentioned driving part. The diaphragm connecting part a20, which is arranged between a first diaphragm a11 and a second diaphragm a12 opposed each other of the plurality of the diaphragms a10, connects the first diaphragm a11 and the second diaphragm a12 and synchronously moves them toward or away from each other. The periphery a10R of the first diaphragm a11 and the periphery a10R of the second diaphragm a12 are vibratably supported by a tubular diaphragm support part a15 surrounding a space aS between the first diaphragm a11 and the second diaphragm a12. The periphery a10R of the diaphragm a10 is supported by the diaphragm support part a15 via an edge a14. The diaphragm support part a15 is the static part described above. The space, surrounded by the first diaphragm a11, the second diaphragm a12, the edge a14 and the diaphragm support part a15, may be substantially sealed. As an example, the diaphragm a10 is formed in a tabular shape and has rigidity in the vibration direction of the diaphragm a10.

In the example shown in the drawing, the diaphragm connecting part a20 includes a link body a20L formed with a rigid link part a21. This link body a20L includes a bendable or foldable hinge part a22 formed between the link part a21 and the diaphragm a10. The link part a21 is connected to the diaphragm a10 or the link connecting part 24*a* described below directly or via other member. In the example shown in the drawing, the link body a20L is substantially symmetrically formed with respect to a central axis a20D between the first diaphragm a11 and the second diaphragm a12.

The link part a21 includes a first link part a21A and a second link part a21B. The first link part a21A has hinges a22 at one end on the side of a first diaphragm a11 and the other end, while the second link part a21B has hinges a22 at one end on the side of a second diaphragm a12 and the other end. A link body a20L includes a link connecting part a24 connecting the other end of the first link part a21A and the other end of the second link part a21B such that the first link part a21A and the second link part a21B vary angles upon vibration of the first diaphragm a11 or the second diaphragm a12. As an example, one end of the link part a21 arranged on the side of the diaphragm has rigidity.

Further, in the example shown in the drawing, the first link part a21A and the second link part a21B are obliquely provided in the directions opposite each other with respect to the vibration direction of the diaphragm a10 (Z-axis direction in the drawing). The link connecting part a24 is movably provided in the direction crossing the vibration direction of the diaphragm a10 (X-axis direction in the drawing). The bendable or foldable hinge part a22 is formed between the other end of the first link part a21A and the other end of the second link part a21B, and the link connecting part a24. The first link part a21A and the second link part a21B have a plurality of substantially parallel link parts a21 respectively. More particularly, these link parts configure a parallel link. The link part a21 and the diaphragm a10 or the link connecting part a24 described below may be integrally formed, or may be connected via other members such as adhesive or buffer material. That is, the link part a21 and the diaphragm a10 or the link connecting part a24 are connected directly or via other member.

The diaphragm connecting part a24 has a reference face a20A between the first diaphragm a11 and the second diaphragm a12. The first diaphragm a11 and the second diaphragm a12 move toward or away from each other with respect to the reference face a20A. The reference face a20A is substantially static with respect to the diaphragm a11 and the second diaphragm a12 moving toward or away from each other, while it vibrates with the first diaphragm a11 and the second diaphragm a12 together when they integrally vibrate.

Further, when the reference face a20A is substantially static with respect to the first diaphragm a11 and the second diaphragm a12 moving toward or away from each other, the position of the reference face with respect to the vibration direction of the first diaphragm a11 or the second diaphragm a12 does not substantially change. Further, when the reference face a20A together vibrates with integral vibration of the first diaphragm a11 and the second diaphragm a12, the position with respect to the vibration direction of the first diaphragm a11 or the second diaphragm a12 substantially changes.

This speaker vibrating body a100 is mechanically coupled with the diaphragm connecting part a20 such that the first diaphragm a11 and the second diaphragm a12 vibrate in the directions opposite to each other. As such, the speaker vibrating body a100, when provided as a passive vibrating body on the cabinet on which the speaker unit is provided, can mechanically reverse pressure change inside the cabinet due to the operation of the speaker unit and emit it outside of the cabinet as a sound wave, and thus low-frequency characteristic may be improved even with a smaller cabinet volume. Further, when the speaker vibrating body a100 is directly driven, the sound wave, emitted from the first diaphragm a11 and the second diaphragm a12, can be emitted in the opposite directions substantially in the same phase.

Figure 3:
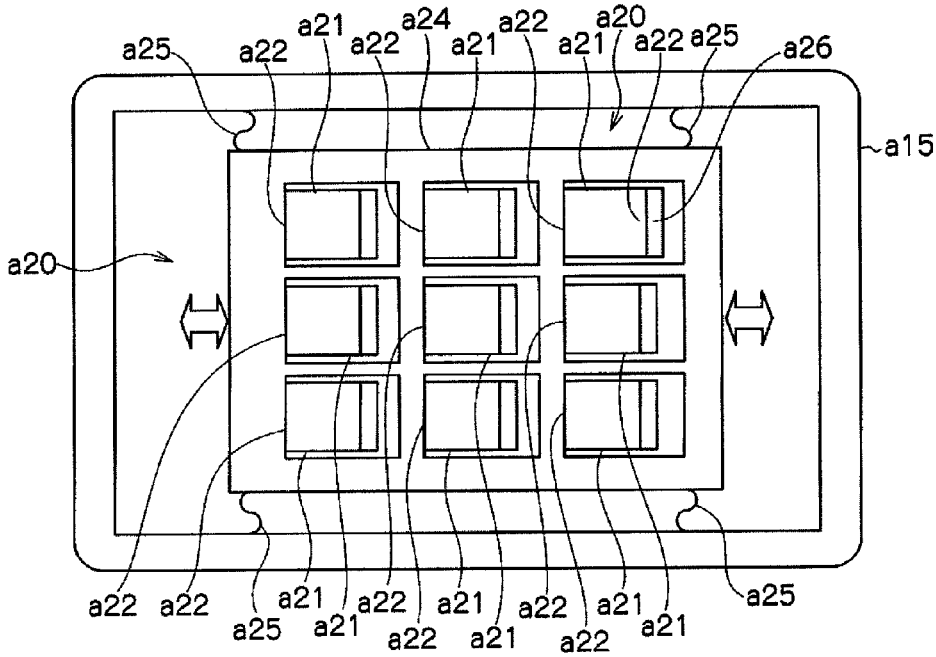
FIG. 3 is a plan view illustrating a specific configuration example of a diaphragm connecting part.

FIG. 3 is a plan view illustrating a specific configuration example of a diaphragm connecting part a20 (plan view without removal of diaphragm a10 in FIG. 2). The link connecting part a24 here is made up of a plate shape body, and the link part a21 is formed partially cut out of this link connecting part a24. The hinge part a22 is formed at the boundary between the link connecting part a24 and the link part a21. The first link part a21A and the link part a21B are formed by joining a pair of the plate shape bodies. The link connecting part a24 and the link part a21 may be integrally formed with the hinge part a22 bendable or foldable, or the link part a21 is connected to the link connecting part a24 with the hinge part a22 bendable or foldable. The hinge part a22 is also formed at the end of the link part a21 on the side opposite to the link connecting part a24, and a connecting part a26 connected to the diaphragm a10 is formed on the end of the hinge part a22 on the diaphragm a10. The link connecting part a24 is vibratably supported in the direction of arrow by the diaphragm support part a15 via a suspension a25 (holding part). Further, the vibration of the link connecting part a24 in the direction crossing the direction of arrow may be restricted or reduced by the suspension a25 (holding part). The direction crossing the direction of arrow maybe, for example, the direction passing through the two opposing suspensions a25 sandwiching the diaphragm connecting part a20 (the former direction), the vibration direction of the first diaphragm a11 or the second diaphragm a12 (the latter direction), etc. In the example shown in the drawing, the suspension a25 restricts the vibration of the link connecting part a24 in the former direction, and restrains the vibration of the link connecting part a24 in the latter direction.

Figure 4:
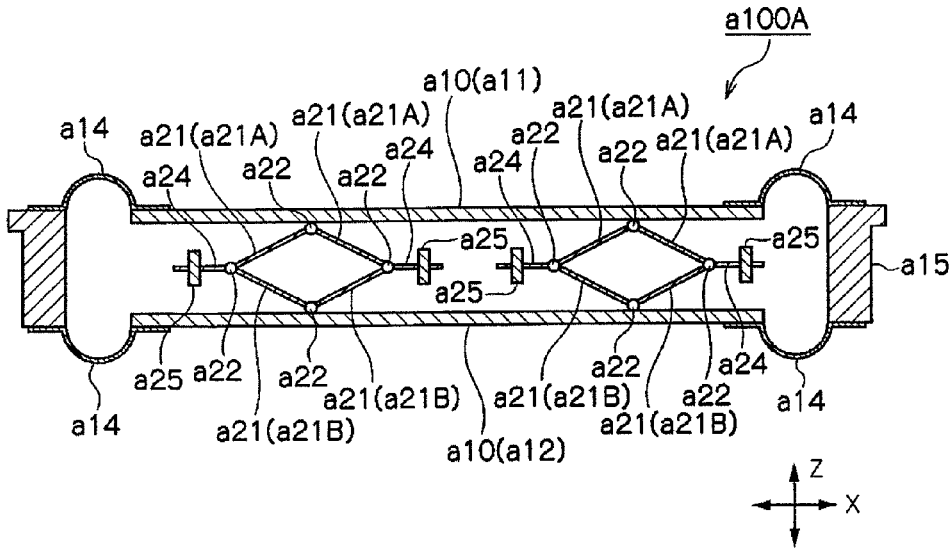
FIGS. 4(*a*) and (*b*) are views illustrating another embodiment of the speaker vibrating body.
Figure 4:
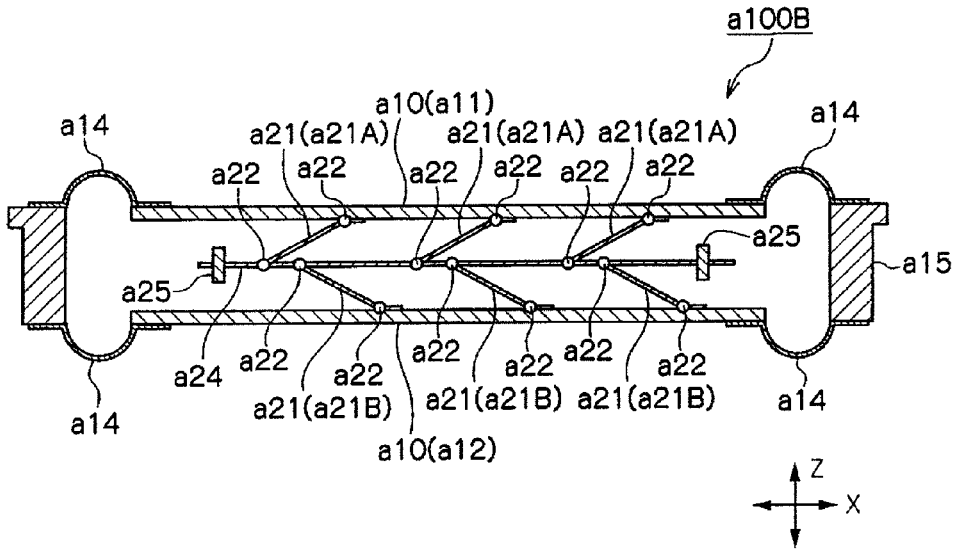

FIG. 4 is a view illustrating another embodiment of the speaker vibrating body (the same symbols are applied to the same parts shown in the above embodiments and duplicate descriptions are partially eliminated). The space, surrounded by the diaphragm a11, the second diaphragm a12, the edge a14 and the diaphragm support part a15, may be substantially sealed. The speaker vibrating body a100A shown in FIG. 4(*a*) includes the link part a21 in which a pair of the first link part 21A and the second link part a21B is obliquely disposed in the opposite direction each other. A pair of the first link parts a21A, a21A and a pair of the second link parts a21B, a21B configure a pantograph shaped link body, and the ends of the first link part a21A and the second link part a21B are connected by the link connecting part a24. And, the link connecting part a24 is movably supported by the suspension a25 (holding part) in the X axial direction. Also, in this configuration, the first diaphragm a11 and the second diaphragm a12 are mechanically connected so as to move toward or away from each other as in the example shown in FIG. 2.

The speaker vibrating body a100B shown in FIG. 4(*b*) includes the first link part a21A and the second link part a21B, each of which has a plurality of parallel link parts a21 as in the example shown in FIG. 2. The first link part a21A and the second link part a21B are connected to the link connecting part a24 at different positions. The connecting portions between the link connecting part a24, and the first link part a21A or the second link part a21B are the hinge parts a22 at which both connected parts are bendable or foldable. Also, in this configuration, the first diaphragm a11 and the second diaphragm a12 are mechanically connected so as to move toward or away from each other as in the example shown in FIG. 2.

Figure 5:
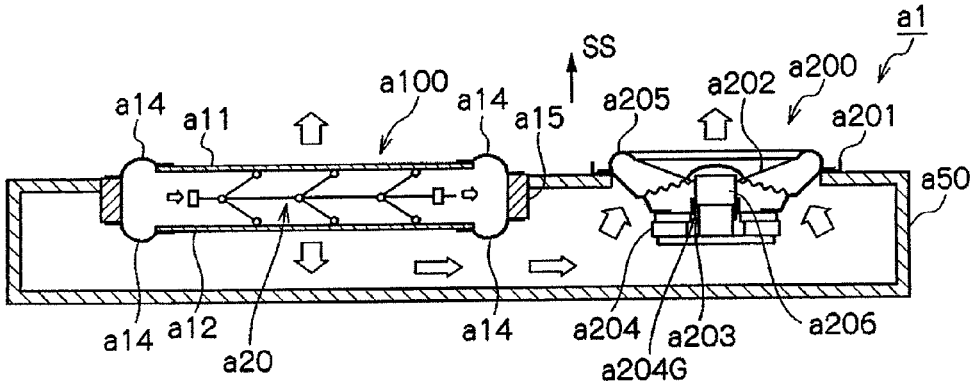
FIGS. 5(*a*)-(*c*) are views illustrating an embodiment of a speaker device including a speaker vibrating body as a passive vibrating body.
Figure 5:
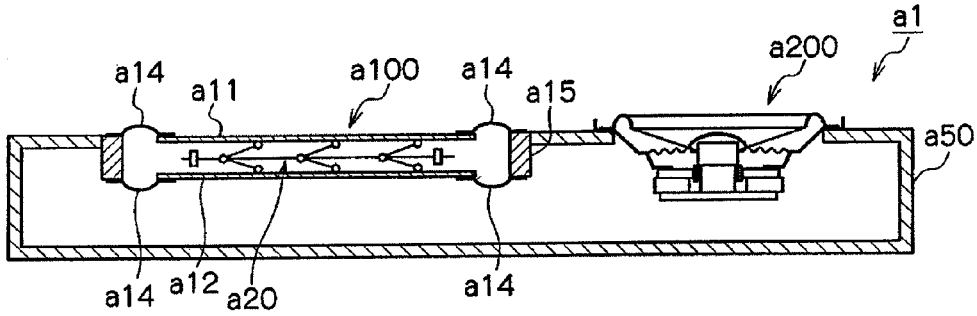
Figure 5:
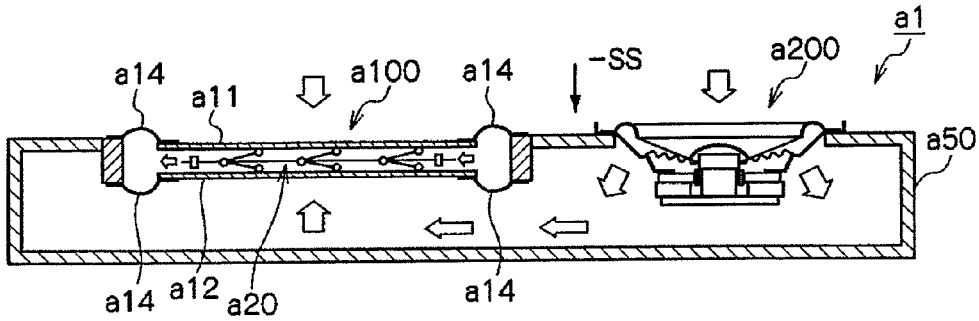

FIG. 5 is a view illustrating an embodiment of a speaker device including a speaker vibrating body as a passive vibrating body. The speaker device a1 includes the above speaker vibrating body a100, a speaker unit a200 as a driving part and a cabinet a50 as a static part. The diaphragm support part a15 of the above speaker vibrating body a100 is supported by the cabinet a50. Space inside of the cabinet a50 is sealed, and the first diaphragm a11 faces outside of the cabinet a50 while the second diaphragm a12 faces inside of the cabinet a50. Specifically, the sound emission face of the first diaphragm a11 faces the space outside of the cabinet a50 while the sound emission face of the second diaphragm a12 faces the space inside the cabinet a50. The sound emission face of the first diaphragm a11 may be arranged, for example, substantially at the same position as a part of the cabinet a50 supporting the first diaphragm a11, or outside or inside of the cabinet without any particular limitation. Further, the space surrounded by the first diaphragm a11, the second diaphragm a12, the edge a14 and the diaphragm support part a15 may be substantially sealed.

The speaker unit a200 is supported by the cabinet a50 at the different position from the speaker vibrating body a100 as a driving part for the speaker vibrating body a100. In the example shown in the drawings, the speaker unit a200 includes a frame a201 as a static part, a diaphragm a202 supported by the frame a201, a voice coil a203 supported by the diaphragm a202 and a magnetic circuit a204 supported by the frame 201 and having a magnetic gap a204G in which a part of the voice coil a203 is arranged, and the outer periphery of the diaphragm a202 is supported by the frame a201 via the edge a205 and the voice coil a203 is supported by a voice coil support part a206 connected to the diaphragm a202. Further, the magnetic circuit a204 includes at least a yoke and a magnet, and includes a plate as necessary. Further, in the example shown in the drawings, the magnetic circuit a204 is an outer-magnetic type magnetic circuit. However, it may be an inner-magnetic type magnetic circuit or an inner and outer magnetic type magnetic circuit in which magnets are arranged inside and outside of the voice coil a203.

This speaker device a1 drives the speaker vibrating body a100 with air pressure, change of air pressure or a sound wave generated on the opposite side of the sound emission face of the speaker unit a200 by driving the speaker unit a200. That is, the speaker vibrating body a100 is vibrated by change of pressure inside of the cabinet a50 generated by driving the speaker unit a200.

In the operation as shown in FIG. 5(*a*), when the diaphragm a202 of the speaker unit a200 moves from the neutral position in the sound emission direction SS, pressure inside the cabinet a50 is decreased to be negative pressure and the second diaphragm a12 of the speaker vibrating body a100 is pulled and moved inside the cabinet a50. As such, the first diaphragm a11 connected to the second diaphragm a12 via the diaphragm connecting part a20 moves in the opposite direction of the second diaphragm a12 by the above link body of the diaphragm connecting part a20. That is, the first diaphragm a11 and the second diaphragm a12 move away from each other.

Further as shown in FIG. 5(*b*), when the diaphragm a202 of the speaker unit a200 returns to the neutral position, the first diaphragm a11 and the second diaphragm a12 of the speaker vibrating body a100 returns to the neutral position as well. Furthermore, as shown in FIG. 5(*c*), when the diaphragm a202 of the speaker unit a200 moves from the neutral position in the opposite direction of the sound emission direction −SS, pressure inside the cabinet a50 increased to be positive pressure and the second diaphragm a12 of the speaker vibrating body a100 is pushed and moved outside the cabinet a50. As such, the first diaphragm a11 connected to the second diaphragm a12 via the diaphragm connecting part a20 moves in the opposite direction with respect to the second diaphragm a12 by the above link body of the diaphragm connecting part a20. That is, the first diaphragm a11 and the second diaphragm a12 move toward each other.

In the example shown in the drawings, the first diaphragm a11 and the second diaphragm a12 of the speaker vibrating body a100 vibrate in the directions opposite each other in substantially the same amplitude of vibration. Further, the diaphragm a202 facing the sound emission direction SS of the speaker unit a200 and the first diaphragm a11 of the speaker vibrating body a100 vibrate in the substantially same direction in the substantially same phase. According to the vibration of this speaker vibrating body a100 that is a passive vibrating body, change of pressure inside the cabinet a50 is mechanically reversed and emitted out of the cabinet a50 as a sound wave. As such, low frequency characteristic of the speaker device a1 may be effectively improved even with a comparatively small cabinet volume.

Figure 6:
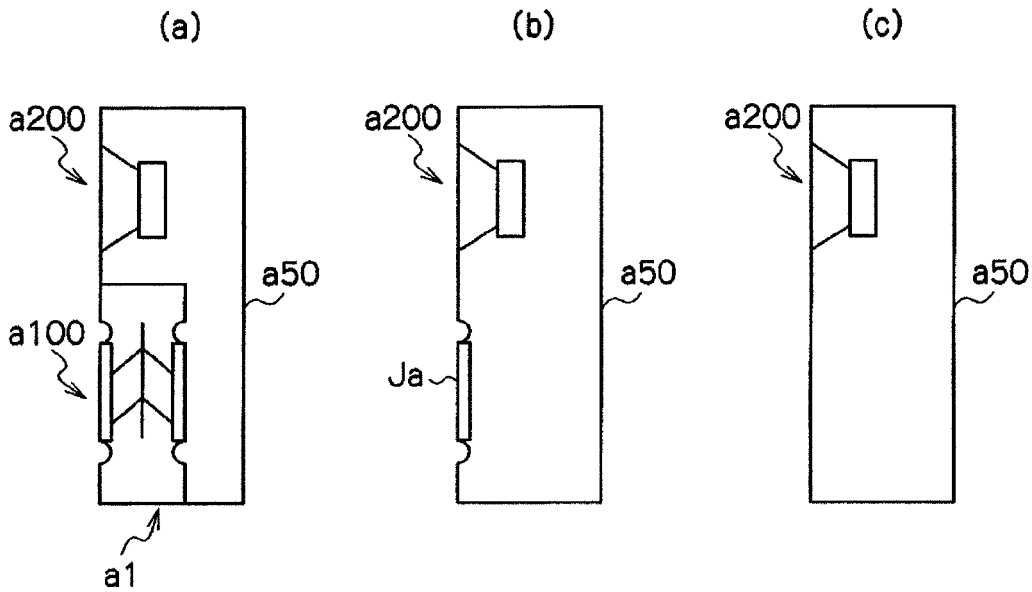
FIG. 6 is a graph comparing sound pressure frequency characteristics between a conventional speaker device and a speaker device according to an embodiment of the present invention.
Figure 6:
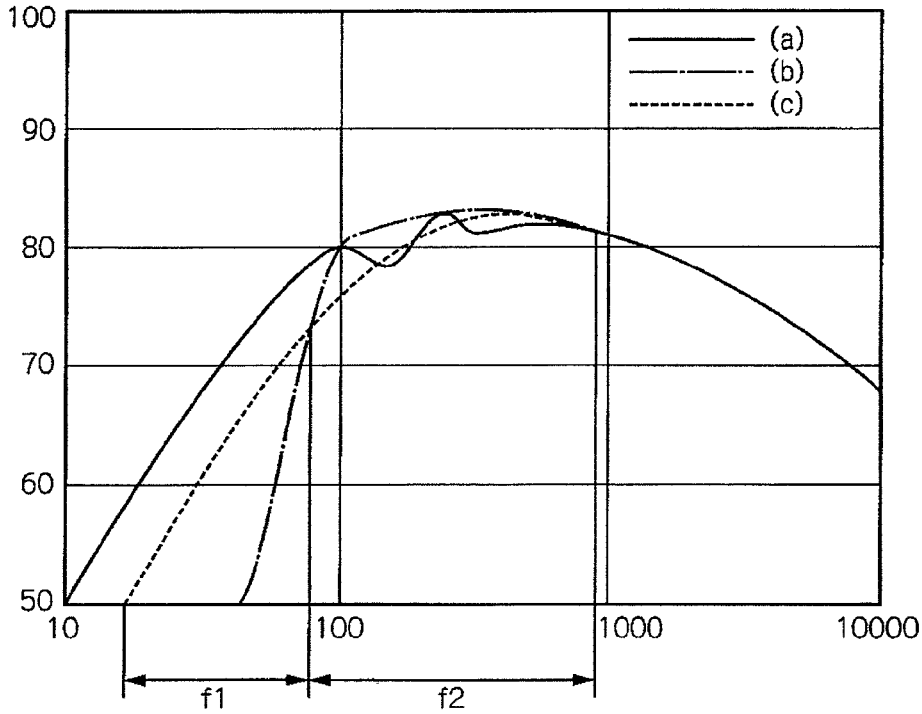

FIG. 6 is a graph comparing sound pressure frequency characteristics between a conventional speaker device and a speaker device according to an embodiment of the present invention. A solid line (a) in the graph represents a characteristic of the speaker device a1 according to an embodiment of the present invention, a dashed line (b) represents a characteristic of a conventional bass reverse speaker device and a broken line (c) represents a characteristic of a sealed speaker device respectively. Here, the same speaker unit a200 is used and the cabinets a50, which are the same in total volume, are used. The speaker vibrating body a100 and a passive diaphragm Ja, which are the same in total area, are used. The horizontal axis of the graph represents frequency (Hz) and the vertical axis represents sound pressure (dB).

As apparently shown in the drawing, the conventional bass reverse speaker device shown in (b), although it has higher sound pressure than the sealed speaker device shown in (c) at the frequency range f2, has the sound pressure drastically decreased at a lower frequency than that (lower than a resonance frequency), and has even lower sound pressure than the sealed speaker device at lowest frequency range within frequency range f1. By contrast, the speaker device a1 according to an embodiment of the present invention, has the same level of sound pressure at frequency range f2 as the conventional bass reverse speaker device (b) or the sealed speaker device (c), and may have higher sound pressure than the conventional bass reverse speaker device (b) or the sealed speaker device (c) at frequency range f1 lower than frequency range f2.

Figure 7:
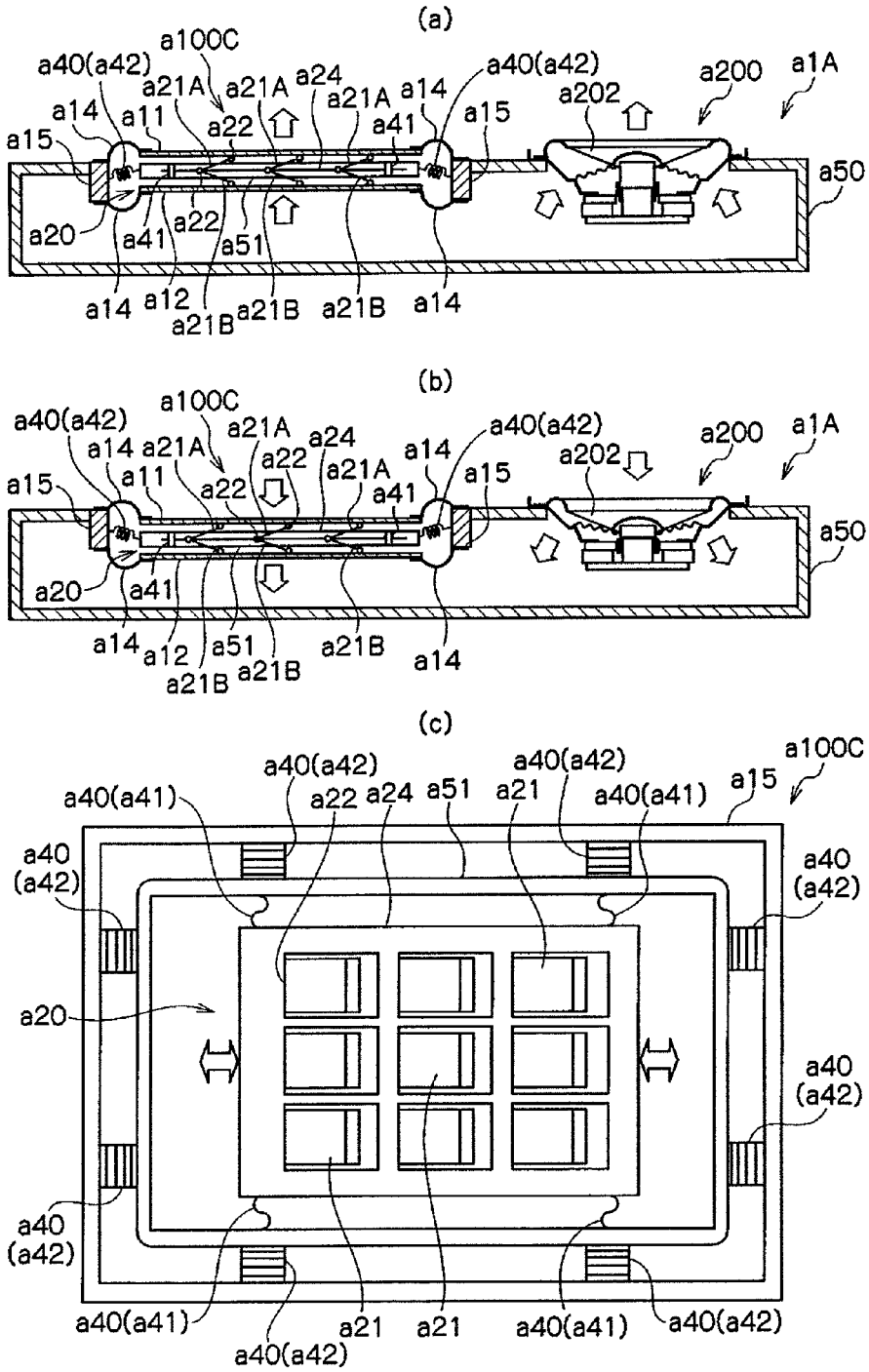
FIGS. 7(*a*)-(*c*) are views illustrating a speaker device according to another embodiment of the present invention.

FIG. 7 is a view illustrating a speaker device according to another embodiment of the present invention. Also, in this embodiment, the space, surrounded by the first diaphragm a11, the second diaphragm a12, the edge a 14 and the diaphragm support part a15, may be substantially sealed. This speaker device a1A includes a speaker vibrating body a100C, a speaker unit a200 that is a driving part and a cabinet a50 as a static part as in the above-mentioned embodiment.

In this embodiment, the diaphragm connecting part a20 is supported in the side of the cabinet a50 via a holding part a40 that allows the link connecting part a24 to move. The holding part a40 includes a first holding part a41 supporting the diaphragm connecting part a20 at an annular part a51 that surrounds the diaphragm connecting part a20 and a second holding part a42 elastically supporting the annular part a51 at the static part (diaphragm support part a15) including the cabinet a50.

The diaphragm connecting part a20 has the link connecting part a24 formed with a plate shaped body as in the example shown in FIG. 3, and the link part a21 is formed partially cut out of this link connecting part a24. The hinge part a22 is formed at the boundary between the link connecting part a24 and the link part a21. And, the first link part a21A and the second link part a21B are formed by joining a pair of these plate shape bodies.

According to this speaker device a1A, the whole geometry of the speaker vibrating body a100C is movable same as in the conventional bass reverse speaker device. Specifically, the first diaphragm a11 and the second diaphragm a12, elastically supported by the second holding part a42, are integrally movable, and the link body of the diaphragm connecting part a20 works to vibrate the first diaphragm a11*a* in the opposite direction for the large vibration of the second diaphragm a12. The first holding part a41 restricts the movement of the link connecting part a24 only in the direction of arrow, and the second holding part a42 supports the annular part a42 elastically displaceably in each direction. Further, the link connecting part a24 may restrict or restrain vibration in the direction crossing the direction of arrow by the first holding part a41. The direction crossing the direction of arrow may be, for example, the direction passing through the two opposing first holding parts a41 sandwiching the diaphragm connecting part a20 (the former direction) or the vibration direction of the first diaphragm a11 or the second diaphragm a12 (the latter direction). In the example shown in the drawing, the first holding part a41 restricts the vibration of the link connecting part a24 in the former direction, and restrains the vibration of the link connecting part a24 in the latter direction.

In comparison with sound pressure frequency characteristics of other examples, with such the speaker as the above mentioned speaker device a1, the speaker device a1A according to this embodiment, can have the similar or higher sound pressure at frequency range f1 lower than the resonance frequency (see FIG. 6), and have a stable (dip-restrained) sound pressure frequency characteristic at frequency range f2 (see FIG. 6) compared to the speaker device a1.

Figure 8:
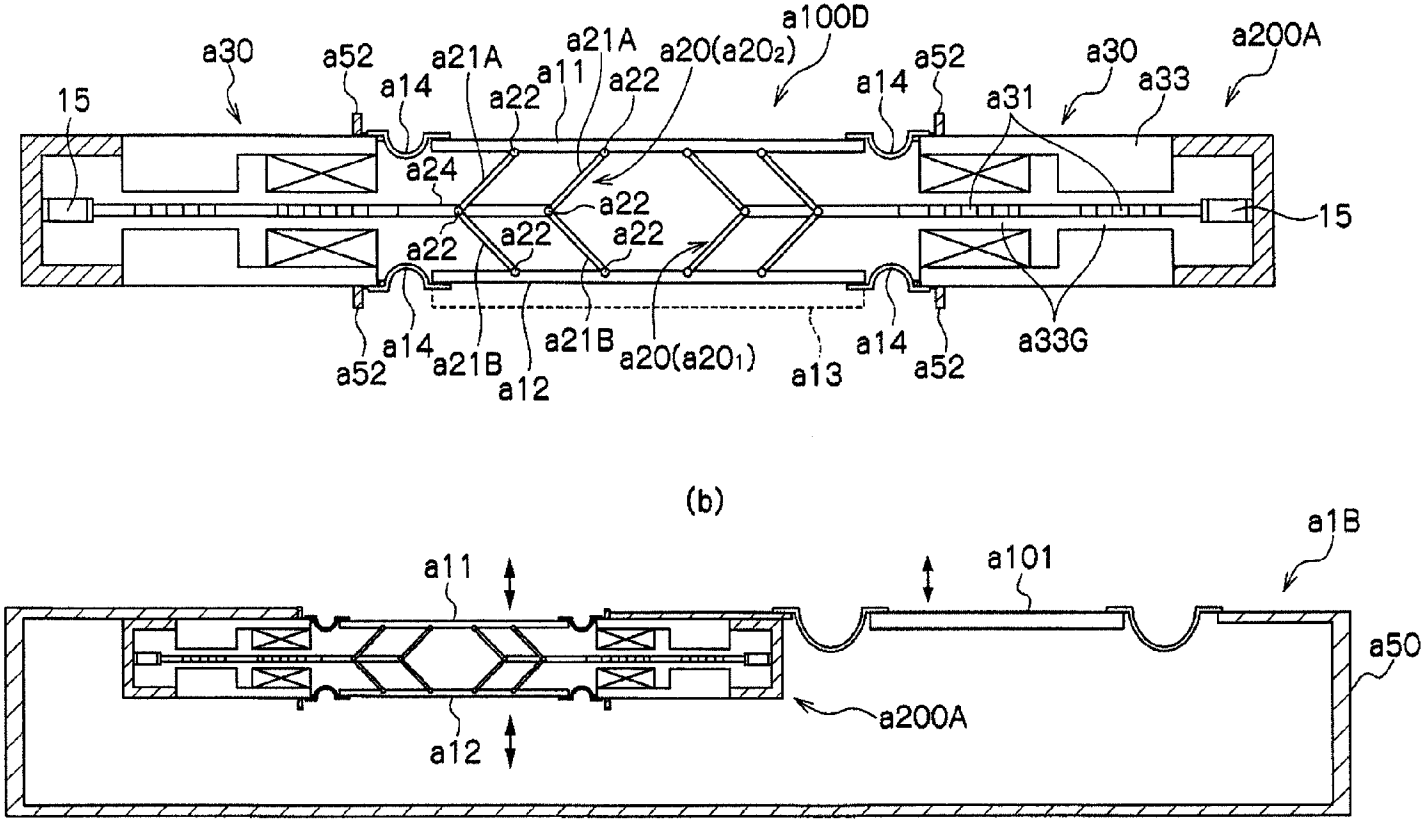
FIG. 8 is a view illustrating a speaker unit including a speaker vibrating body (FIG. 8(*a*)) and a speaker device including this speaker unit (FIG. 8(*b*))

The speaker vibrating body a100 itself may be driven by a driving force of the magnetic circuit. FIG. 8 is a view illustrating a speaker unit including a speaker vibrating body (FIG. 8(*a*)) and a speaker device including this speaker unit (FIG. 8(*b*)).

The speaker vibrating body a100D has the first diaphragm a11 and the second diaphragm a12 connected via the diaphragm connecting part a20. A pair of the diaphragm connecting parts a20 are provided in the left side and right side. One diaphragm connecting part a20*i* and the other diaphragm connecting parts $a20_2$ are provided left-right symmetrically. This diaphragm connecting part a20 ($a20_1$, $a20_2$) includes a first link parts a21A and a second link parts a21B. The first link part a21A has hinge parts a22 at one end and the other end on the side of the first diaphragm a11, while the second link parts a21B has hinges a22 at one end and the other end on the side of the second diaphragm a12. This diaphragm connecting part a20 ($a20_1$, $a20_2$) includes a link connecting part a24 connecting via the hinge parts a22 the other end of the first link part a21A and the other end of the second link part a21B such that the first link parts a21A and the second link parts a21B vary angles. The first diaphragm a11 and the second diaphragm a12 are supported by the static part a52 via the edge a14.

The speaker unit a200A includes a driving part a30 driving the speaker vibrating body a100D. This driving part a30 is provided for each of the pair of the diaphragm connecting parts a20 ($a20_1$, $a20_2$). The driving part a30 includes a voice coil a31 connected to the diaphragm connecting part a20 directly or via other member and a magnetic circuit a33, supported by a static part, having a magnetic gap a33G in which a part of the voice coil a31 is arranged, and vibrates the first diaphragm a11 and the second diaphragm a12 via the diaphragm connecting part a20 upon vibration of the voice coil a31. The magnetic circuit a33 is supported by the static part a52 described above.

The voice coil a31 is connected to the link connecting part a24 of the diaphragm connecting part a20 directly or via other member. Upon vibration of the voice coil a31, the link connecting part a24 is vibrated in the direction crossing the vibration direction of the first diaphragm a11 and the second diaphragm a12, and the first link part a21A and the second link part a21B are angle-varied.

This speaker unit a200A may be mounted on or in a various types of cabinets and configure the speaker device a1B. In the example shown in the drawing, a speaker unit a200A is provided in the cabinet a50 supporting a passive vibrating body a101 that includes at least a diaphragm. In this example, the first diaphragm a11 includes a sound emission face emitting a sound wave. The second diaphragm a12 arranged inside of the cabinet a50 includes a driving force emission face driving the passive vibrating body a101. Although an example that the speaker device includes the passive vibrating body a101 as a passive radiator is shown here, a duct, including a sound emission hole that emits a sound wave outside the cabinet a50, may be provided in place of the passive vibrating body a101.

In this speaker device a1B, the first diaphragm a11 and the second diaphragm a12 are vibrated by the driving part a30. When the first diaphragm a11 and the second diaphragm a12 move toward each other, pressure inside the sealed cabinet a50 is decreased to be negative pressure, and when the first diaphragm a11 and the second diaphragm a12 move away from each other, pressure inside the cabinet a50 is increased to be positive pressure. Upon this change of pressure inside the cabinet a50, the passive vibrating body a101 is vibrated.

Particularly, at frequency range lower than an antiresonant frequency, when the first diaphragm a11 moves in the sound emission direction, pressure inside the cabinet a50 is increased to be positive pressure and the passive vibrating body a101 also vibrates in the sound emission direction. when the first diaphragm a11 moves in the opposite direction of the sound emission direction, pressure inside the cabinet a50 is decreased to be negative pressure and the passive vibrating body a101 also vibrates in the opposite direction of the sound emission direction, and thus the diaphragm of the speaker unit a200A and the diaphragm of the passive vibrating body a101 vibrate substantially in the same phase. As such, the function of low frequency reproduction similar as the above-mentioned speaker device a1, may be obtained.

Further in another embodiment, acoustic adjustment member a13 may be attached to the second diaphragm a12 as shown in a broken line or the second diaphragm a12 may be replaced by the acoustic adjustment member a13. As the acoustic adjustment member a13, a member, which has large weight compared to the first diaphragm a11 having a sound emission face, or a member, which has a plurality of openings, may be adopted. According to this embodiment, for example, when the speaker unit a200A alone is placed in the cabinet, a sound wave generated from the side of the second diaphragm may be restrained. With this speaker unit a200A applied to the bass reverse speaker device, a speaker device, having comparatively little unwanted vibration generated at cabinet, etc., may be produced. If the weight on the side of the second diaphragm is heavier than the weight of the first diaphragm a11 by the acoustic adjustment member a13, the member on the side of the second diaphragm functions as the static part, and thus unwanted vibration generated at the link body or the link part may be restrained. Further, since the acoustic adjustment member a13 is configured with a member having a plurality of openings, reaction force due to vibration of the second diaphragm a12 may be comparatively small, and thus unwanted vibration, generated at the link body or the link part, may be restrained.

Further, if the mass of the first diaphragm and the second diaphragm are substantially the same, unwanted vibration generated in the diaphragm connecting part, the static part or the voice coil, for example, by reaction force from the first diaphragm and the second diaphragm, may be canceled out with each other. In this case, substantially symmetrical vibrations may be generated in the speaker vibrating body in the vibration directions of the first diaphragm and the second diaphragm and in the vibration direction of the voice coil, and thus generation of unwanted vibration may be restrained.

A various types of embodiments may be applied to a speaker unit used in the speaker device a1. By using a speaker unit including a vibration direction converter part as shown below, in place of the dynamic type speaker unit a200 with a cone shaped diaphragm as in the example shown in FIG. 5, the speaker unit itself may be made thin while it can make louder sound. Moreover, when the speaker unit is arranged in a cabinet, volume of space in the rear side of the speaker unit may be sufficiently secured even with the cabinet having no large depth. In this way, the whole speaker device including the cabinet may be made thin. The link body of the vibration direction converter part described below can be applied as each part of the link body of the above-mentioned diaphragm connecting part (link part, link connecting part, hinge part, etc.). A contact avoiding part or an adhesive material housing part described below may be formed also at the link body of the diaphragm connecting part.

Figure 9:
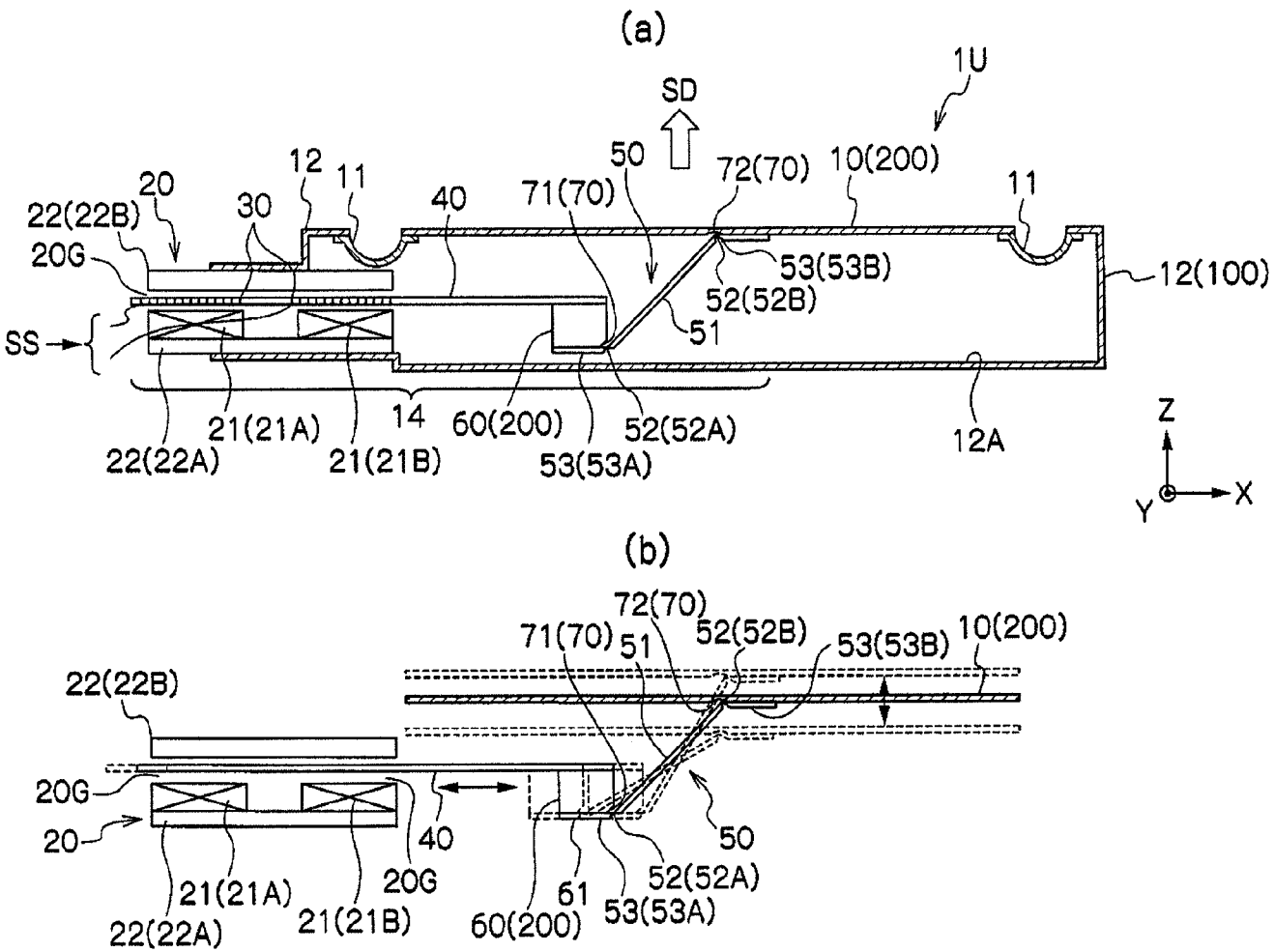
FIG. 9 is a view illustrating a basic configuration of the speaker unit including a vibration direction converter part (FIG. 9(*a*) is a cross-sectional view taken along X-axis direction and FIG. 9(*b*) is a view illustrating an operation of the driving part)

FIG. 9 is a view illustrating a basic configuration of the speaker unit including a vibration direction converter part (FIG. 9(*a*) is a cross-sectional view taken along X-axis direction and FIG. 9 (*b*) is a view illustrating an operation of the driving part). The speaker unit 1U includes a diaphragm 10, a static part 100 supporting the diaphragm 10 vibratably in the vibration direction and a driving part 14 arranged at the static part 100 to vibrate the diaphragm 10 in response to an audio signal. The driving part 14 includes a magnetic circuit 20 forming a magnetic gap 20G, a voice coil 30 vibrating in a direction different from the vibration direction of the diaphragm 10 upon the inputted audio signal and a vibration direction converter part 50 to convert the direction of the vibration produced by the voice coil 30 and transmit the vibration to the diaphragm 10. The voice coil 30 itself may connect with the vibration direction converter part 50, while the voice coil 30 is supported by a voice coil support part 40 as shown in the drawings. In this embodiment, the vibration direction of the voice coil 30 is X-axis direction and two directions orthogonal to X-axis direction are Y-axis direction and Z-axis direction respectively.

The diaphragm 10 may be formed substantially in a rectangular shape, a circular shape, an ellipsoidal shape or other shapes in the plan view. Further, the cross-sectional shape of the diaphragm 10 may be formed in a prescribed shape, for example, such as a tabular shape, a dome shape, a cone shape, etc. The cross-sectional shape of the diaphragm 10 is planar as shown in the drawings, however it may be formed in a curved shape. Further, the speaker unit 1U may be made thin by making the total height of the diaphragm 10 comparatively small as necessary.

The static part 100 is a collective term for those that support vibrations of the diaphragm 10, the driving part 14, etc., which includes the frame 12 and those that have also a function of the frame 12 such as an after-mentioned yoke, a mounting unit, etc. The static part 100 is, however, not necessarily completely static. The whole static part 100 may vibrate subject to vibration of the driving part 14 or other force. The outer periphery part of the diaphragm 10 is supported via an edge 11 by the frame 12 as the static part 100.

The driving part 14 has the magnetic circuit 20, the voice coil 30 and the vibration direction converter part 50. The voice coil 30 vibrates in one axis direction along the magnetic gap 20G of the magnetic circuit 20 and the vibration direction converter part 50 converts the direction of the vibration and transmits the vibration to the diaphragm 10. The voice coil 30 vibrates in X-axis direction and the diaphragm 10 is vibratably arranged in Z-axis direction orthogonal to X-axis direction as shown in the drawings. The vibration direction converter part 50 converts the vibration of the voice coil 30 in X-axis direction into a vibration at obliquely disposed angle of its own displacement, and thus vibrating the diaphragm 10 in Z-axis direction.

The magnetic circuit 20 has a magnet 21 (21A, 21B) and a magnetic pole member (yoke) 22 (22A, 22B) such that a plurality of the magnetic gaps 20G are arranged in vibration direction of the voice coil 30, for example, in X-axis direction. In this embodiment, the magnetic pole direction of the magnet 21 (21A, 21B) is set such that magnetic field directions of a pair of the magnetic gaps 20G are opposite to each other (±Z-axis direction). The voice coil 30 made up of a wound conducting member is arranged such that currents flow in directions opposite to each other (±Y-axis direction) in the magnetic gap 20G having magnetic fields in directions opposite to each other. Thereby, a driving force (Lorentz force, electromagnetic force) may be developed in the voice coil 30 in directions (±X-axis directions) along the magnetic gap 20G. Relationship of arrangement between the magnet 21 and the magnetic pole member (yoke) 22 is not limited to the example shown in the drawings. Rigidity (bending rigidity, torsional rigidity included) may be added to the voice coil 30 as a whole by forming the voice coil support part 40 with, for example, a tabular insulating member.

A tabular insulating member as the voice coil support part 40 has a plurality of conducting layers formed at the outside of a conducting wire. The conducting layer 43 is electrically connected to a lead wire 31 (see FIG. 27) that is pulled out from the start point and the end point of the conducting wire. The lead wire 31 is configured, for example, with a part of an after-mentioned conducting member. Further, the lead wire 31 is electrically connected to outside via an after-mentioned holding part 15, thus functioning as a junction wire for inputting an outside audio signal into the voice coil 30. Further, for example, when a conducting wire free from the voice coil is wound in the speaker unit as the junction wire, an additional space for wiring by winding is required. However, since the conducting layer 43 (see FIG. 27) as the junction wire is formed on the surface of the voice coil support part 40, the space for the junction wire is no longer required, and thus the speaker unit may be made thin. As shown in the drawings, the voice coil 30 and the voice coil support part 40 are formed to be tabular, but they are not limited to this form and may be formed to be tubular. Further if the voice coil 30 or the voice coil support part 40 supporting the voice coil 30 are formed to be tubular, a tabular lid, which enables angle-variable coupling of the vibration direction converter part, may be connected with the end of the vibration direction converter part 50.

The voice coil 30 is formed by winding the conducting wire (conducting member) to which the audio signal is inputted. The voice coil 30 in itself is vibratably arranged at the static part 100 or is vibratably arranged at the static part 100 via the voice coil support part 40. The voice coil support part 40 may be formed, for example, with a tabular insulating member, and the voice coil 30 is supported on the surface of or inside the voice coil support part 40.

Since the voice coil support part 40 is formed, for example, with the tabular insulating member, rigidity (bending rigidity and torsional rigidity included) may be added to the voice coil 30 as a whole.

The voice coil 30 is held on the static part 100 with a holding part not shown in the drawings. The holding part is configured to vibratably hold the voice coil 30 or the voice coil support part 40 in vibration direction (for example, X-axis direction) with respect to the static part 100 and restrict them not to move in other directions. For example, the holding part is deformable in the vibration direction (for example, X-axis direction) of the voice coil 30. And the holding part may be formed with a curved plate member having rigidity in a direction crossing this vibration direction. Further, the length of the voice coil 30 in the direction orthogonal to the vibration direction of the voice coil thereof may be comparatively long with respect to the length of the voice coil 30 in the vibration direction of the voice coil so that a comparatively large driving force may be produced when driving a speaker.

The vibration direction converter part 50 has one end angle-variably connected to the voice coil 30 directly or via other member, and has another end angle-variably connected to the diaphragm 10 directly or via other member. The vibration direction converter part 50 is obliquely disposed with respect to each of vibration directions of the diaphragm 10 and the voice coil 30. Specifically, the vibration direction converter part 50 includes a rigid link part 51 angle-variably and obliquely disposed between the voice coil 30 or the voice coil support part 40 and the diaphragm 10, and a hinge part 52, which is formed at both ends of the link part 51 and functions as a fulcrum for angle change of the vibration direction converter part 50. The connecting part 53 of the vibration direction converter part 50 is connected to the diaphragm 10, the voice coil 30, or an attaching counterpart 200 including other member than the diaphragm 10 or the voice coil 30 with a coupling member including a joining member such as an adhesive or a double-faced tape, and a fastener member such as a screw, etc. The hinge part 52 is arranged in proximity of the attaching counterpart 200. The connecting part 53 (53A) at the end of the vibration direction converter part 50 is coupled to the voice coil 30 or the voice coil support part 40 via a connecting part 60 as shown in the drawings. However, the connecting part 53 (53A) may be directly connected without the connecting part 60. The connecting part 60 is formed between the end of the vibration direction converter part 50 on the voice coil side and the end of the voice coil 30 or the voice coil support part 40 on the side of vibration direction converter part, and thereby both ends are coupled spaced apart in the vibration direction. Further, the connecting part 60 absorbs the thickness of the magnetic circuit 20, thus making the speaker unit thin.

Further, a contact avoiding part 70 avoiding contact with the hinge part 52 is formed on the surface side of the attaching counterpart 200 in proximity of the hinge part 52 of the vibration direction converter part 50. The contact avoiding part 70 also functions as a joining member housing part (restraining part), which houses and restrains the joining member joining the vibration direction converter part 50 and the attaching counterpart 200. The contact avoiding part 70 is, for example, a concave portion, a notch part, a groove part, etc., which is formed in a concave shape along the hinge part 52. Accordingly, a predetermined space is formed between the hinge part 52 and the surface of the attaching counterpart 200 arranged near the hinge part 52 and thus preventing the adhesive material provided between the vibration direction converter part 50 and the attaching counterpart 200 from affecting the hinge part 52. As shown in the drawings, the notch part 71 as the contact avoiding part 70 is formed at the connecting part 60, which is the attaching counterpart 200, such that the notch part 71 is located in proximity of the hinge part 52 (52A), while the concave portion 72 as the contact avoiding part 70 is formed at the diaphragm 10, such that the concave portion 72 is located in proximity of the hinge part 52 (52B). As such, when the connecting part 53 of the vibration direction converter part 50 and the connecting part 60 or the end face of the diaphragm 10 are applied with the joining member such as adhesive, double-faced tape, etc., the adhesive and the end of the double-faced tape running off toward the hinge part 52 enter into the notch part 71 or the concave portion 72, and thus preventing them from contacting and adhering to the hinge part 52.

In the above-mentioned speaker unit 1U, when an audio signal SS as an electric signal is inputted to the voice coil 30 of the driving part 14 as shown in FIG. 2(*a*), the voice coil 30 or the voice coil support part 40 vibrates along the magnetic gap 20G of the magnetic circuit 20, for example, in X-axis direction of the drawings as shown in FIG. 2(*b*). Accordingly, the direction of the vibration is converted by the vibration direction converter part 50 and the vibration is transmitted to the diaphragm 10 such that the diaphragm 10 is vibrated, for example, in Z-axis direction of the drawings, thereby a sound in response to the audio signal is emitted in the sound emission direction SD.

In the speaker unit 1U as described above, since the direction of the vibration produced by the voice coil 30 and the vibration direction of the diaphragm 10 are different from each other by using the vibration direction converter part 50, the thickness of the speaker unit 1U on the rear side of the diaphragm 10 may be made smaller than the thickness of the speaker, of which the voice coil 30 is vibrated in the vibration direction of the diaphragm 10. As such, a thin speaker device, which may reproduce a low frequency range with a high sound pressure, may be realized.

Further, since the direction of the vibration produced by the voice coil 30 is converted by the vibration converter part 50 and the vibration is transmitted to the diaphragm 10, the thickness in sound emission direction of the speaker unit 1U (total height of the speaker unit) is not increased even if the amplitude of vibration of the diaphragm 10 is increased by increasing the amplitude of vibration of the voice coil 30. As such, a thin speaker device, which may emit a loud reproduced sound, may be realized.

Further, when the connecting part 53 of the direction converter part 50 and the attaching counterpart 200 are connected to each other by using the adhesive as an joining member, if the adhesive spreads out and runs off toward the hinge part 52 due to the join, and adheres to the hinge part 52, the hinge part 52 may be hardened and lose mobility. Also, when the double-faced tape is used as the joining member, if the end of the double-faced tape runs off toward the hinge part 52 and the double-faced tape adheres to the hinge part 52, the hinge part 52 may be hardened and lose mobility. In addition, the hinge part 52, which is adhered to and hardened by the adhesive, the end of the double-faced tape, etc. adhered thereto, may be subject to fracture by the repetition of bending, folding or rotational motion. If the hinge part 52 fractures as described above, the part to which the adhesive or the end of the double-faced tape adheres may repeatedly contact with and separate from the diaphragm 10, the voice coil 30 or the attaching counterpart 200 as other members, etc., and thus an abnormal noise (contact sound) may be generated each time. On the other hand, if the applied volume of the adhesive or the joining area by the double-faced tape is limited such that the adhesive or the double-faced tape does not run off and adhere to the hinge part 52, the coupling force between the vibration direction converter part 50 and the attaching counterpart 200 may be reduced, then detachment, etc. may occur at the end face, causing abnormal noise, or if a total detachment occurs, the speaker may eventually be fractured. Furthermore, since the hinge part 52 is arranged near the attaching counterpart 200, the hinge part 52 may contact the attaching counterpart 200. Therefore, the hinge part 52 damages, or there is a case that the vibration direction converter part 50 cannot bend, fold or rotate with respect to the attaching counterpart 200. However, in this speaker unit 1U, since the contact avoiding part 70 is formed on the surface side of the attaching counterpart 200 in proximity of the hinge part 52, it is possible to prevent the attaching counterpart 200 from contacting the hinge part 52 and restrain the generation of abnormal noise, etc. due to the contact. Further, even if the joining member such as the adhesive, double-faced tape, etc., which is used for coupling the connecting part 53 of the vibration direction converter part 50 and the attaching counterpart 200, runs off, the joining member enters into the contact avoiding part 70 that also functions as a joining member restraining part, and thus it is possible to restrain adherence of the joining member to the hinge part 52 causing hindrance to mobility thereof. As such, the function of the hinge part 52 may be maintained while the coupling force between the vibration direction converter part 50 and the attaching counterpart 200 is maintained large. Since the vibration direction converter part 50 securely bends, folds or rotates with respect to the attaching counterpart 200, contact of the hinge part 52 to the attaching counterpart 200, generation of the abnormal noise, etc. due to fracture may be restrained.

Figure 10:
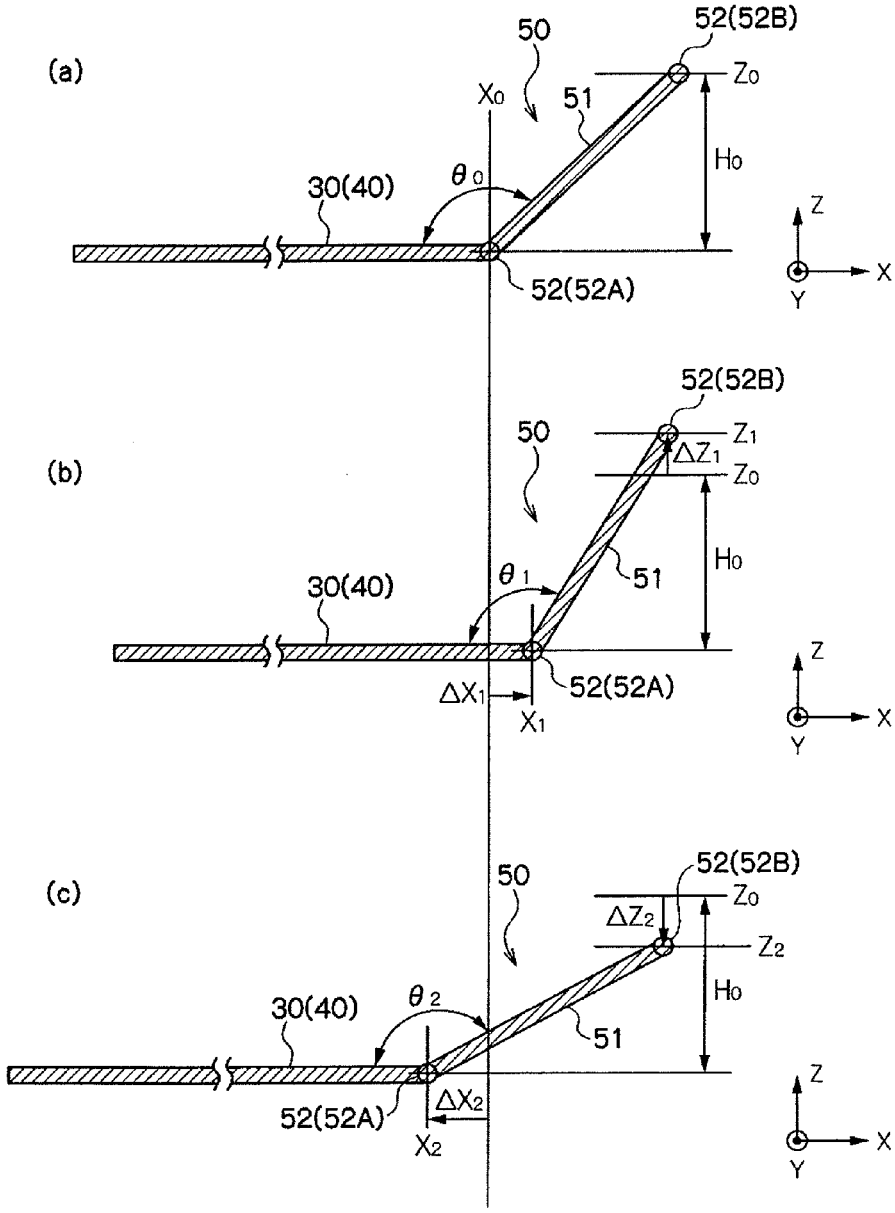
FIGS. 10(*a*)-(*c*) are views illustrating a configuration example and an operation of a vibration direction converter part.
Figure 11:
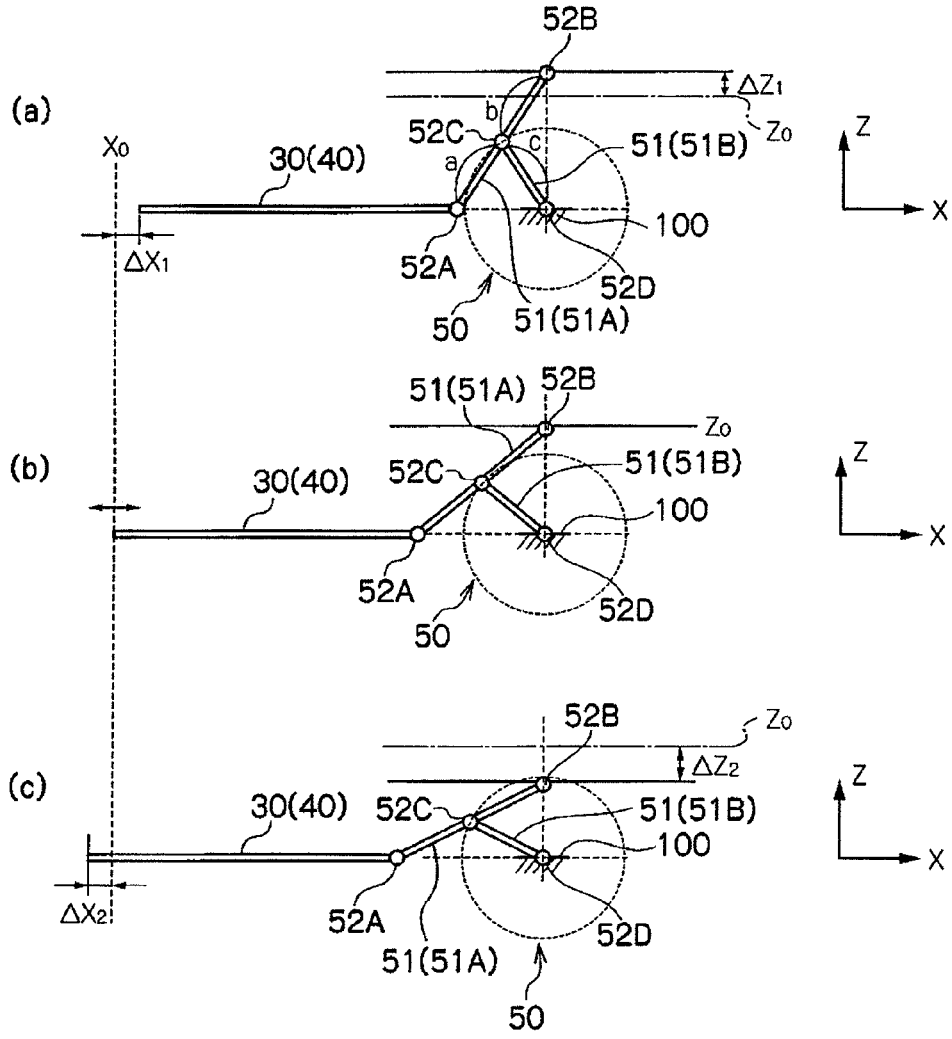
FIGS. 11(*a*)-(*c*) are views illustrating a configuration example and an operation of the vibration direction converter part.

FIGS. 10 and 11 are views illustrating a configuration example and an operation of the vibration direction converter part 50. The rigid vibration direction converter part 50, direct-converting the vibration of the voice coil 30 and transmitting it to the diaphragm 10, has hinges 52 formed on the sides of the diaphragm 10 and the voice coil 30 respectively, and has the link part 51 obliquely disposed with respect to the vibration direction of the voice coil 30. The hinge part 52 is a part that rotatably joins two rigid members or a part that bends or bendably joins integrated two rigid parts, while the link part 51 is a rigid part having the hinge parts 52 formed at the ends. The rigidity means that the members and the parts are not so deformable that the vibration of the voice coil 30 can be transmitted to the diaphragm 10. It does not mean that they are totally undeformable. The link part 51 can be formed in a plate shape or in a rod shape.

In the embodiment shown in FIG. 10, one link part 51 has the hinge parts 52 (52A, 52B) formed at both ends such that the one hinge part 52A is formed at the end of the voice coil 30 or the voice coil support part 40, while another hinge part 52B is formed on the side of the diaphragm 10. Another hinge part 52B may be connected to the diaphragm 10 or connected to the diaphragm 10 via other member. A conventional member may be used as other member. For example, a metal material, etc. improving join strength between the hinge part 52 and the diaphragm 10, may be selected (diaphragm 10 is not shown in FIG. 10).

FIG. 10(*a*) shows that the link part 51 is in the middle position of the vibration. The link part 51 is obliquely disposed between the voice coil 30 (or voice coil support part 40) and the diaphragm 10 at an angle $\theta_0$. Meanwhile, the hinge part 52B on the side of the diaphragm 10 is arranged at the position $Z_0$ apart from the voice coil 30 by distance $H_0$ in the vibration direction of the diaphragm 10. The vibration direction of the voice coil 30 (or voice coil support part 40) is restricted such that it may vibrate in one axis direction (for example, X-axis direction), while the vibration direction of the diaphragm 10 is restricted such that it may vibrate in a direction (for example, Z-axis direction) different from the vibration direction of the voice coil 30.

As shown in FIG. 10(*b*), when the hinge part 52A formed at the end of the voice coil 30 moves from position $X_0$ to position $X_1$ by $\Delta X_1$, in the vibration direction (X-axis direction), the inclination angle of the link part 51 is converted to be $\theta_1$ ($\theta_0>\theta_1$) and the position of the hinge part 52B on the side of the diaphragm 10 moves to position $Z_1$ by $\Delta Z_1$ in the vibration direction of the diaphragm 10 (Z-axis direction). More specifically, the diaphragm 10 is pushed up by $\Delta Z_1$ in the vibration direction.

As shown in FIG. 10(*c*), when the hinge part 52A formed at the end of the voice coil 30 moves from the original position $X_0$ to the position $X_2$ by $\Delta X_2$ in the vibration direction (−X-axis direction), the inclination angle of the link part 51 is converted to be $\theta_2$ ($\theta_0<\theta_2$) and the position of the hinge part 52B on the side of diaphragm 10 moves to position $Z_2$ by $\Delta Z_2$ in the vibration direction of the diaphragm 10 (−Z-axis direction). More specifically, the diaphragm 10 is pushed down by $\Delta Z_2$ in the vibration direction.

As such, the vibration direction converter part 50, including the link part 51 and the hinge part 52 (52A, 52B), converts vibration of the voice coil 30 to the change in the angle of the link part 51 obliquely disposed and transmits it to the diaphragm 10, and thus vibrating the diaphragm 10 in a direction different from the vibration direction of the voice coil 30.

FIG. 11 is a view illustrating another configuration example and the operation of the vibration direction converter part 50. Specifically, FIG. 11(*b*) shows a state of the vibration direction converter part 50 when the diaphragm 10 is positioned in a reference position, FIG. 11(*a*) shows a state of the vibration direction converter part 50 when the diaphragm 10 is displaced to the sound emission side from the reference position and FIG. 11(*c*) shows a state of the vibration direction converter part 50 when the diaphragm 10 is displaced in the direction opposite to the sound emission side from the reference position (diaphragm 10 is not shown).

The vibration direction converter part 50 has a function that the link part 51 can angle-convert by receiving reaction force from a static part 100 such as the frame 12 positioned on the opposite side of the diaphragm. Specifically, the vibration direction converter part 50 includes a first link part 51A having one end on the side of the voice coil 30 as a hinge part 52A while another end on the side of the diaphragm 10 as a hinge part 52B and a second link part 51B having one end as a hinge part 52C to the middle part of the first link part 51A while another end as a hinge part 52D to the static part 100, and the first link part 51A and the second link part 51B are obliquely disposed in different directions with respect to the vibration direction of the voice coil 30. More specifically, the vibration direction converter part 50 includes a first link part 51A having one end on the side of the voice coil 30 as a first hinge part 52A while another end on the side of the diaphragm 10 as a second hinge part 52B and a second link part 51B having one end as a third hinge part 52C to the middle part of the first link part 51A while another end as a fourth hinge part 52D to the static part 100, and the first hinge part 52A, the second hinge part 52B and the fourth hinge part 52D are located on the circumference of a circle with a diameter of substantially the same length as the first link part 51A, having the third hinge part 52C as the center.

In the vibration direction converter part 50, the hinge part 52D, supported by the static part 100 (or frame 12), is only the hinge part that does not change position, and thus providing reaction force from the static part 100 for the link part 51. Accordingly, when the voice coil 30 (or the voice coil support part 40) moves from the reference position $X_0$ by $\Delta X_1$ in the X-axis direction, angles of the first link part 51A and the second link part 51B that are obliquely disposed in different directions are increased by substantially the same angle as shown in FIG. 11(*a*), and thus the hinge part 52B, receiving reaction force from the static part 100 at the hinge part 52D, securely pushes up the diaphragm 10 from the reference position $Z_0$ by $\Delta Z_1$ in the Z-axis direction. Further, when the voice coil 30 moves from the reference position $X_0$ by $\Delta X_2$ in the direction opposite to the X-axis direction, angles of the first link part 51A and the second link part 51B are decreased by substantially the same angle as shown in FIG. 11(*c*), and thus the hinge part 52B, receiving reaction force from the static part 100 at the hinge part 52D, securely pushes down the diaphragm 10 from the reference position $Z_0$ by $\Delta Z_2$ in the direction opposite to the Z-axis direction.

A length a of a link part from the hinge part 52A to the hinge part 52C, a length b of a link part from the hinge part 52C to the hinge part 52B and a length c of a link part from the hinge part 52C to the hinge part 52D are configured to be substantially the same as each other, and thereby the hinge part 52A and the hinge part 52D are preferably arranged substantially in parallel with the moving direction of the voice coil 30. This link body is well known as a "Scott Russell linkage" where the hinge parts 52A, 52B and 52D are located on the circumference of a circle with the length of the first link part 51A (a+b=2a) as the diameter and the hinge part 52C as the center of the circle. In particular, the angle defined by the line passing through the hinge part 52A and the hinge part 52D and the line passing through the hinge part 52B and the hinge part 52D becomes a right angle. As such, when the voice coil 30 is moved in the X-axis direction, the hinge part 52B between the first link part 51A and the diaphragm 10 moves in the Z-axis direction that is perpendicular to the X-axis, and thus it is possible to convert the vibration direction of the voice coil 30 to its orthogonal direction and transmit the vibration to the diaphragm 10.

Figure 12:
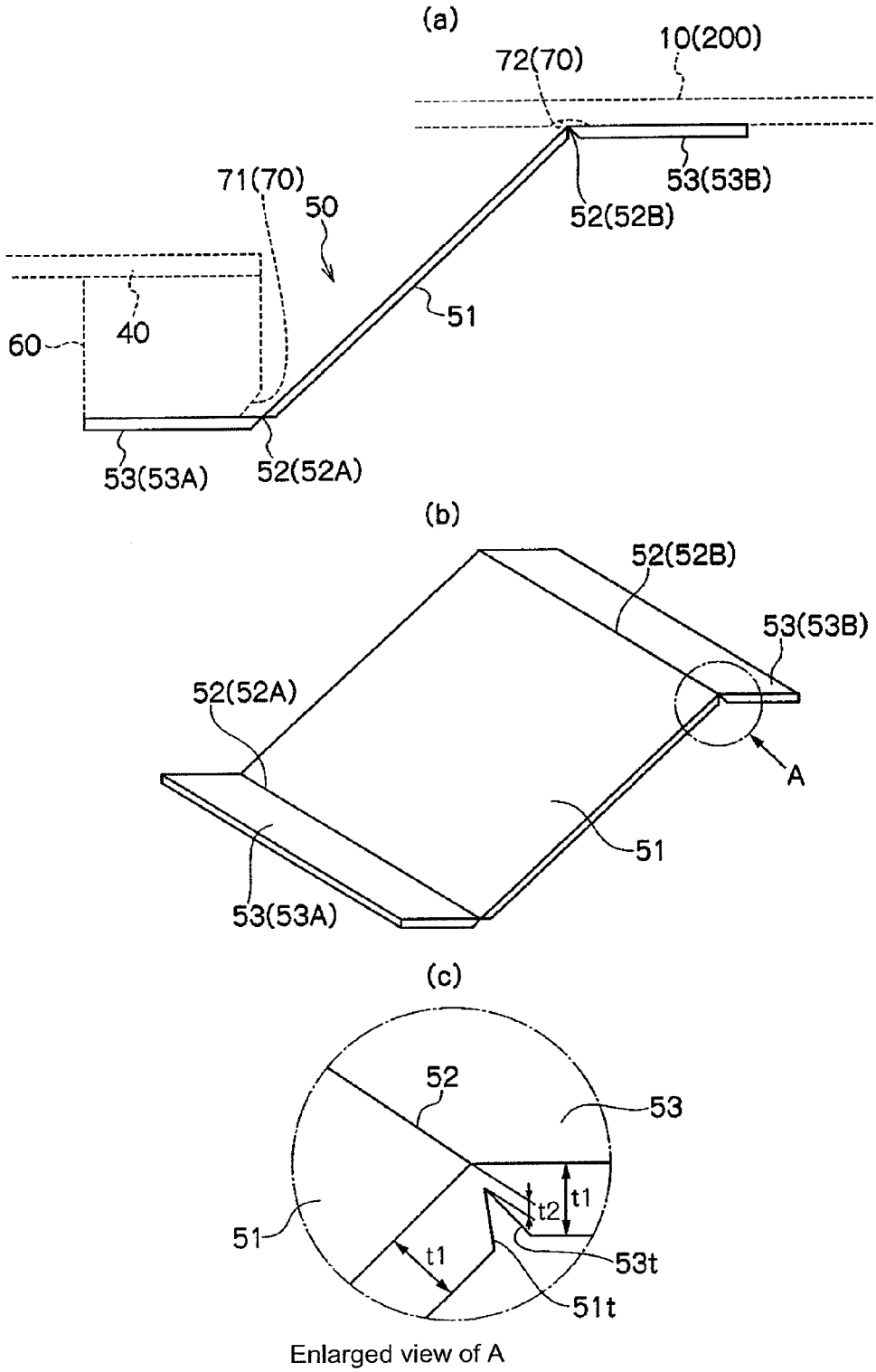
FIGS. 12(*a*)-(*c*) are views illustrating a configuration example of the vibration direction converter part.
Figure 13:
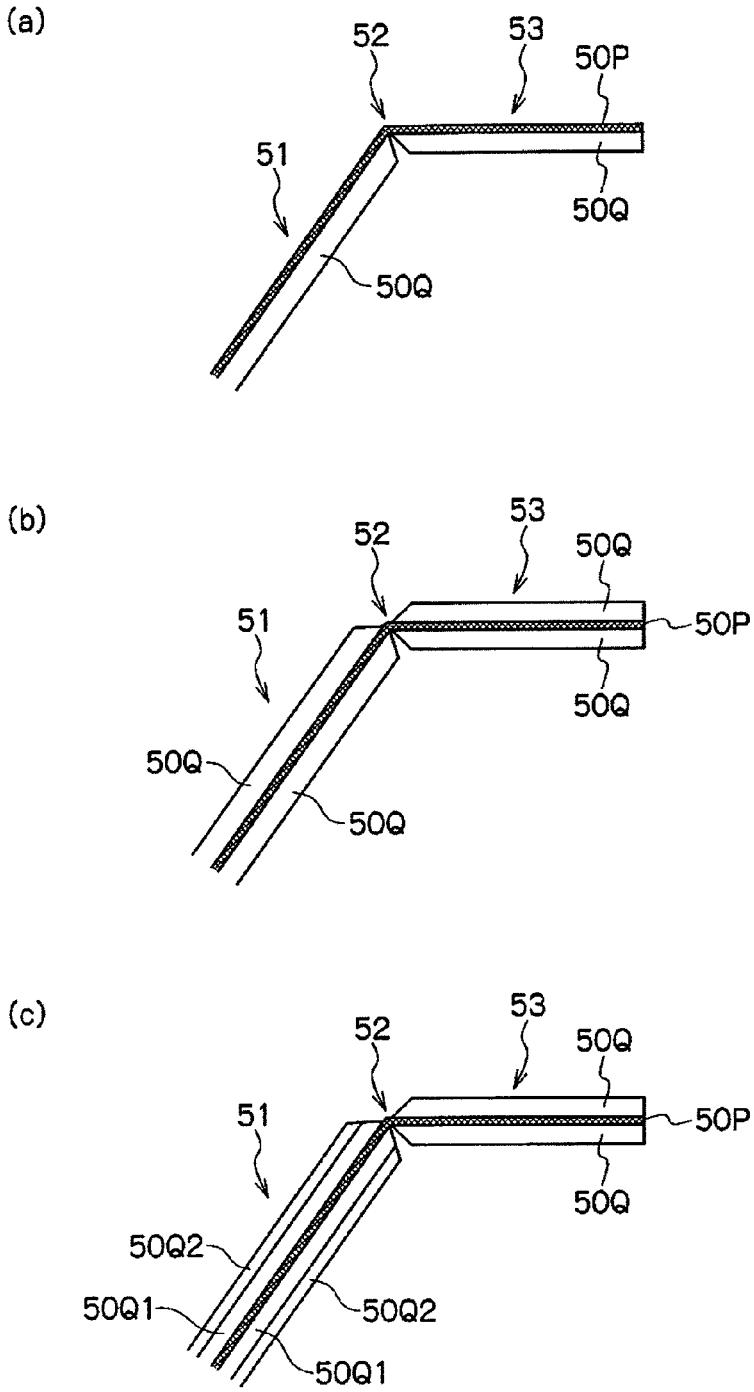
FIGS. 13(*a*)-(*c*) are views illustrating a configuration example of the vibration direction converter part.

FIGS. 12 and 13 are views illustrating a formation example of the vibration direction converter part (FIG. 12(*a*) is a side view, FIG. 12(*b*) is a perspective view and FIG. 12(*c*) is an enlarged view of part A). The vibration direction converter part 50 includes the link part 51 and the hinge parts (52A, 52B) formed at both ends of the link part 51 as described above. As shown in the drawings, connecting parts 53 (first connecting part 53A and second connecting part 53B) are formed at both ends of the link part 51 via hinge parts 52. The first connecting part 53A, connected to the voice coil 30 or the voice coil support part 40 directly or via other member, integrally vibrates with the voice coil 30, while the second connecting part 53B, connected to the diaphragm 10 directly or via other member, integrally vibrates with the diaphragm 10.

In the vibration direction converter part 50, the link part 51, the hinge parts 52A and 52B, the first and second connecting parts 53A and 53B are integrally formed, and the hinge parts 52A and 52B are formed with a bendable continuous member continuing between the parts of both sides over the hinge parts 52A and 52B. This continuous member may be a member configuring the link part 51 and the first and the second connecting part 53A and 53B as a whole, or may be a member configuring the link part 51 and a part of the first and second connecting parts 53A and 53B. Provided with this second connecting part 53B, the link part 51 may support the diaphragm 10 over a wide range, and thereby it is possible to vibrate the diaphragm 10 in the same phase. The term "fold" includes "bend" in its conceptual scope.

If the vibration direction converter part 50 is formed with a plate shape member, the hinge part 52 is linearly formed extended in a width direction as shown in FIG. 12(*b*). Further, the link part 51 is required to be rigid and not to be deformable. Since the hinge part 52 is required to be bendable, the integral member is configured to have a different property by forming the thickness t2 of the hinge part 52 smaller than the thickness t1 of the link part 51 or the connecting part 53.

Further, the change in thickness of the hinge part 52 and the link part 51 is formed on a slant face, and the slant faces 51*t* and 53*t*, facing the ends of the parts of both sides over the hinge part 52, are formed. As such, when the link part 51 is angle-varied, interference to the angle variation by thickness of the link part 51 may be restrained.

Further, a concave portion or notch part 71, which acts as a contact avoiding part 70, is formed at the end of the connecting part 60 that is an attaching counterpart 200 arranged near the hinge part 52A, such that a space is formed between the hinge part 52A and the connecting part 60 as shown in FIG. 12(*a*). In an example shown in FIG. 12(*a*), the notch part is formed in a slantwise cross-sectional shape. Furthermore, a concave portion or notch part 72, which acts as a contact avoiding part 70, is formed at the diaphragm 10 that is an attaching counterpart 200 arranged near the hinge part 52B, such that a space is formed between the hinge part 52B and the diaphragm 10. In an example shown in FIG. 12(*a*), the concave portion is formed in a curved cross-sectional shape. As such, contact between the hinge parts 52A, 52B and the attaching counterpart 200 may be restrained. Further, when joining the first connecting part 53A of the link part 51 with the end face of the connecting part 60, and joining the second connecting part 53B with the diaphragm 10 respectively with adhesive as a joining member, even if the adhesive runs off toward the hinge parts 52A, 52B, it will run into the concave portion or the notch part 71, 72, and therefore it will not adhere to the hinge parts 52A, 52B. Since the adhesive only adheres to a non-hinge part (unbendable or unfoldable rigid part) even if the adhesive adheres, interference to bending or folding of the hinge parts 52A, 52B may be restrained.

In an example shown in FIG. 13, a link part or a connecting part is configured by integrating a bendable continuous member and a rigid member, and a hinge part is a part that is configured by the continuous member. In the example shown in FIG. 13(*a*), the link part 51 or the connecting part 53 is configured by joining a rigid member 50Q to the surface of a continuous member 50P that is a bendable sheet-shaped member. According to this configuration, the continuous member 50P continuously extends between the parts of both sides over the hinge part 52, and the hinge part 52 is bendably formed substantially only by the continuous member 50P. Meanwhile, the link part 51 or the connecting part 53, which is formed by joining the rigid member 50Q to the continuous member 50P, may be formed as a rigid part.

In an example shown in FIG. 13(*b*), the rigid members 50Q are applied to sandwich the continuous member 50P to form the link part 51 or the connecting part 53. Also, the part, not applied with the rigid member 50Q, becomes the hinge part 52. In an example shown in FIG. 13(*c*), the rigid member forming the link part 51 is formed in multiple layers laminated by the rigid members 50Q1 and 50Q2. Further, in FIG. 13(*c*), the rigid member 50Q1 and the rigid member 50Q2 may be formed in a multiple-layer structure. As such, the bendable hinge part 52 and the rigid link part 51 and connecting part 53 may be integrally formed by partially joining the rigid member 50Q to the bendable continuous member 50P.

The continuous member 50P is preferably configured to have strength and durability durable against repeated bending of the hinge part 52 when the speaker unit is driven, and have flexibility making little noise when bending is repeated. According to one embodiment, the continuous member 50P may be formed with a woven or an unwoven material made of high-strength fiber. As an example of the woven material, plain weave with uniform material, plain weave having different warp and weft material threads, plain weave with alternately changed thread material, plain weave with twisted union yarn and plain weave with paralleled yarn. Other than plain weaves, there may be applied triaxial and quadraxial woven fabrics, triaxial and quadraxial continuous non-woven fabric of glued layer, knitting, fabric with paralleled yarn in one direction, etc.

When the high-strength fiber is applied partially or as a whole, sufficient strength against vibration of the voice coil 30 or the voice coil support part 40 may be achieved by arranging the high-strength fiber in the vibration direction of the voice coil support part 40. When applying both the warp and the weft thread as the high-strength fiber, durability may be improved with a uniform tensile force given to the warp and the weft thread by inclining both fiber directions by 45° with respect to the vibration direction of the voice coil support part 40. As the high-strength fiber, aramid fiber, carbon fiber, glass fiber, etc. may be used. Further, a damping material may be applied to adjust characteristic such as bending stress and rigidity of the continuous member.

As the rigid member 50Q, thermoplastic resin, thermosetting resin, metal, paper, etc., which are light weight, easy to mold and having rigidity after hardening, may preferably be used. The vibration direction converter part 50 may be configured by joining the rigid member 50Q, which is molded in a plate shape, to the surface of the continuous member 50P other than the part of the hinge part 52 by using adhesive as a joining material. Further, if thermosetting resin is used as the rigid member 50Q, the vibration direction converter part 50 may be configured by impregnating partially the link part 51 or the connecting part 53 of the fibrous continuous member 50P with resin and then hardening it. Further, if resin or metal is used as the rigid member 50Q, the continuous member 50P and the rigid member 50Q may be integrated at the link part 51 and the connecting part 53 by using insert molding. The above-mentioned technology concerning the integral forming is described in US20050127233 (Publication No. US2005/253298) filed in the US on May 12, 2005 and US20050128232 (Publication No. US2005/253299) filed in the US on May 13, 2005, which is incorporated here in the present application.

Figure 14:
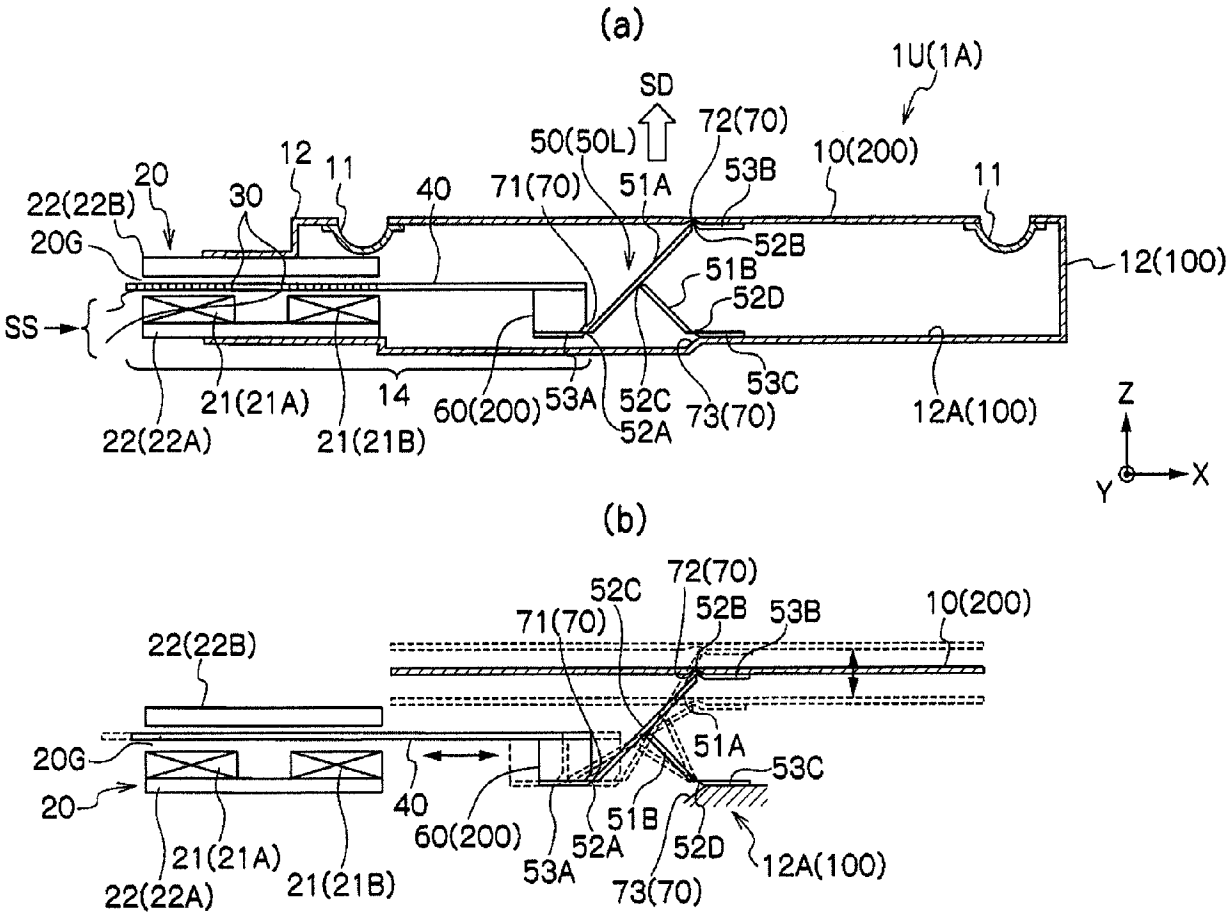
FIGS. 14(*a*) and (*b*) are views illustrating a speaker unit adopting the vibration direction converter part.
Figure 15:
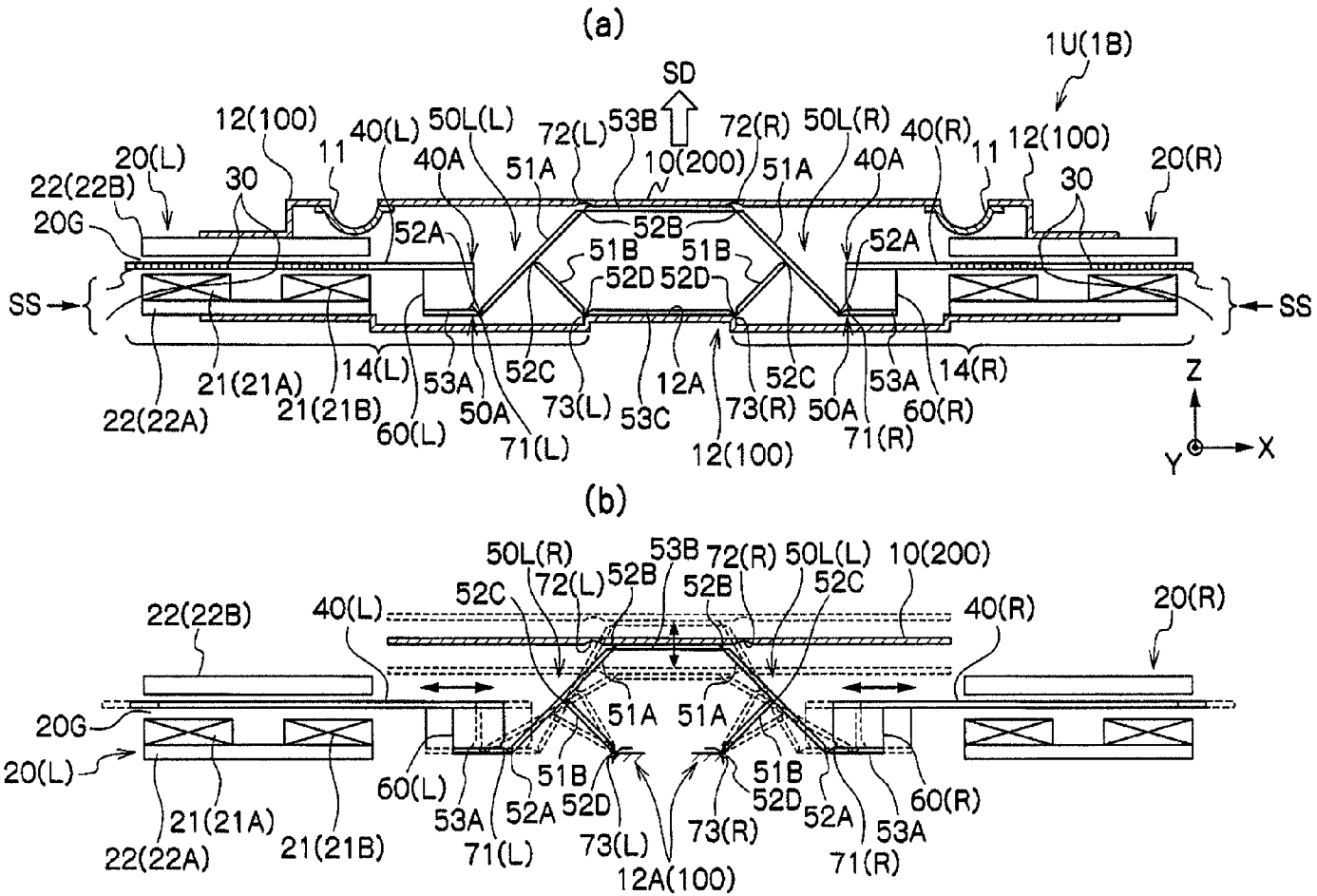
FIGS. 15(*a*) and (*b*) are views illustrating a speaker unit adopting the vibration direction converter part.

FIGS. 14 and 15 are views illustrating a speaker device adopting the above-mentioned vibration direction converter part (FIGS. 14(*a*) and 15(*a*) are cross-sectional views taken in X-axis direction and FIGS. 14(*b*) and 15(*b*) are views illustrating an operation of the driving part). The same symbols are applied to the same parts and a part of duplicate descriptions is eliminated. In a speaker unit 1 U (1A, 1B) shown in FIGS. 14 and 15, a link body 50L is configured to include the first connecting part 53A that is connected to the voice coil support part 40 and vibrates integrally with the voice coil support part 40 and the second connecting part 53B that is connected to the diaphragm 10 and vibrates integrally with the diaphragm 10 as well as a plurality of link parts.

In the speaker unit 1 U (1A) shown in FIG. 14, the vibration direction converter part 50 is formed with the link body 50L including the rigid first link part 51A and second link part 51B. The first connecting part 53A is located at one end of the first link part 51A via the hinge part 52A while the second connecting part 53B is located at another end of the first link part 51A via the hinge part 52B. The middle part of the first link part 51A is located at one end of the second link part 51B via the hinge part 52C while the connecting part 53C, which is static with respect to vibration of the voice coil support part 40, is located at another end of the second link part 51B via the hinge part 52D.

According to the drawings, the first connecting part 53A is connected to the end of the voice coil support part 40 directly or via the connecting part 60, the second coupling part 53B is directly connected to the diaphragm 10 and the static connecting part 3C is coupled to the bottom portion 12A of the frame 12 that is the static part 100. A concave portion or a notch part 73, which acts as a contact avoiding part 70, is formed at the bottom portion 12A of the frame 12 that is an attaching counterpart 200 arranged near the hinge part 52D, such that a space is formed between the hinge part 52D and the bottom portion 12A of the frame 12. In an example shown in the drawings, the notch part is formed. The first link part 51A and the second link part 51B are obliquely disposed in different directions with respect to the vibration direction (X-axis direction) of the voice coil support part 40 and the static part 100 is provided on the opposite side of the diaphragm 10 with respect to the vibration direction converter part 50. In the example shown in the drawings, although the static part 100 is formed with the bottom portion 12A of the frame 12, a yoke 22A of a magnetic circuit 20 may be the static part 100 instead of the bottom portion 12A of the frame 12 by extending the yoke 22A of the magnetic circuit 20 to the position under the vibration direction converter part 50.

As shown in FIG. 14(*b*), the hinge part 52A on the side of the voice coil support part 40 moves in the X-axis direction in accordance with the movement of the voice coil support part 40 while the hinge part 52D connected to the static part 100 is fixed. The movement of the hinge part 52A is converted to changing angles of the first link part 51A and the second link part 51B, and thus the hinge part 52B on the side of the diaphragm 10 is moved in the vibration direction of the diaphragm 10 (for example, Z-axis direction).

The speaker unit 1 U (1B) shown in FIG. 15 is configured with the driving parts 14 shown in FIG. 14 symmetrically disposed opposite to each other, which includes the driving parts 14(R) and 14(L), respectively. Each of the driving parts 14(R) and 14(L) includes a link body 50L(R) or 50L(L), a voice coil support part 40(R) or 40(L), a magnetic circuit 20(R) or 20(L) and a connecting part 60(R) or 60(L).

The link bodies 50L(R) and 50L(L) configure the vibration direction converter part 50 such that a pair of the first link parts 51A, a pair of the second link parts 51B, a pair of the first connecting parts 53A, the second connecting part 53B and the static connecting part 53C, which are disposed opposite to each other, are integrally formed. A pair of the first connecting parts 53A are connected to the voice coil support part 40 respectively, the second connecting part 53B is connected to the diaphragm 10, and the static connecting part 53C is connected to the bottom portion 12A of the frame 12.

As shown in FIG. 15(*b*), the diaphragm 10 may be driven by two combined driving forces of the driving parts 14(R) and 14(L) by setting the vibration directions of the voice coil support part 40(R) and 40(L) synchronously opposite to each other. Further, since a plurality of hinge parts 52B are provided on the side of the diaphragm 10, the number of support points on the diaphragm 10 is increased, thereby the phase of vibration of the diaphragm 10 may become uniform.

Figure 16:
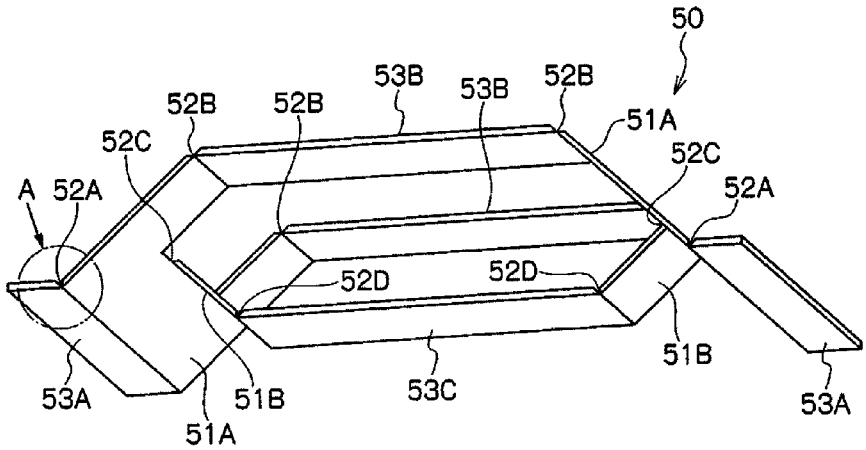
FIGS. 16(*a*) and (*b*) are views illustrating a specific vibration direction converter part.
Figure 16:
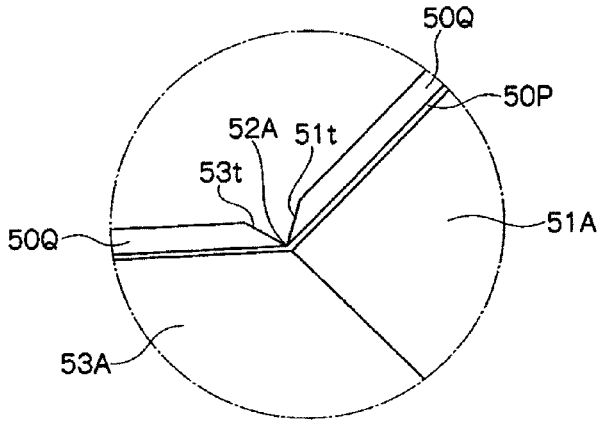
Figure 17:
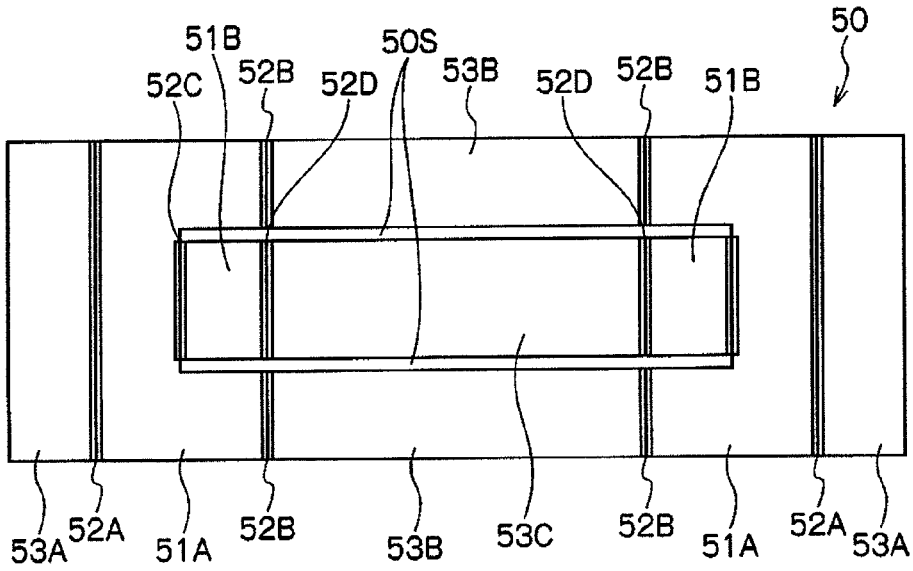
FIGS. 17(*a*) and (*b*) are views illustrating a specific vibration direction converter part.
Figure 17:
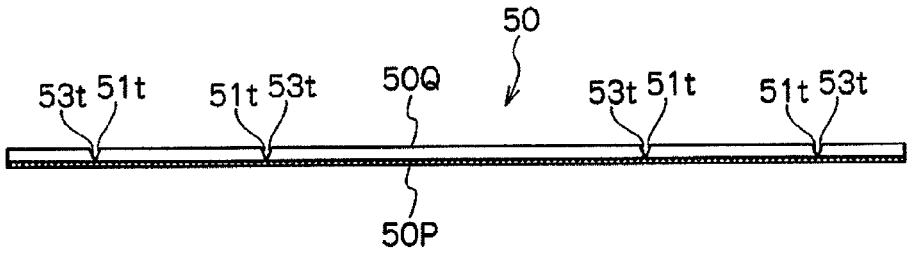

FIGS. 16 and 17 are views illustrating more specific vibration direction converter part (FIG. 16(*a*) is a perspective view, FIG. 16(*b*) is an enlarged view of part A in FIG. 16(*a*), FIG. 17(*a*) is a plan view illustrating a flattened whole part by unfolding the vibration direction converter part and FIG. 17(*b*) is a side view illustrating a flattened whole part by unfolding the vibration direction converter part. In this example, the vibration direction converter part 50 is formed with a single integrated component. As described above, the vibration direction converter part 50 is formed with a pair of the first link parts 51A, hinge parts 52A and 52B formed at both ends of the first link parts 51A, a pair of the second link parts 51B and hinge parts 52C and 52D formed at both ends of the second link parts 51B. Further, the first connecting parts 53A are formed at one ends of a pair of the first link parts 51A via the hinge parts 52A, the second connecting part 53B is formed between hinge parts 52B formed at other ends of a pair of the first link parts 51A and the static connecting part 53C is formed between the hinge parts 52D formed at other ends of the second link parts 51B. The first link parts 51A, 51A and the second connecting part 53B are bent in a convex shape and the second link parts 51B, 51B and the static connecting part 53C are bent in a concave shape.

As shown in FIG. 16(*b*), the hinge part 52A is bendably formed with the above continuous member 50P. The above rigid member 50Q is attached to the first link part 51A and also to the first connecting part 53A. Also, the first connecting part 53A is joined by the above rigid member 50Q. As such, all of the above-mentioned hinge parts are formed in the similar configuration. Further, slant faces 51*t* and 53*t* are formed opposite to each other in each hinge part.

As shown in FIG. 17(*a*), the vibration direction converter part 50, including the link parts 51A, 51B, each hinge part and the connecting part 53A, 53B, 53C, is formed with an integral sheet-shaped member. The hinge parts 52A are formed linearly crossing the integral sheet-shaped member, while the hinge parts 52B, 52C, 52D are formed partially crossing the integral sheet-shaped member. A pair of notch parts 50S are formed in a longitudinal direction of the integral sheet-shaped member such that the second link parts 51B, 51B and the static coupling part 53C are cut out and formed.

As shown in FIG. 17(*b*), the vibration direction converter part 50 is formed, for example, by applying resin material forming the rigid member 50Q to the whole surface of the continuous member 50P that is a sheet-shaped member, such that the resin material is laminated on the continuous member 50P, and cutting in a V-shape to form each hinge part and the slant faces 51*t* and 53*t* at both sides thereof. After that, the above-mentioned notch part 50S is formed and the resin material is hardened. A liquid unhardened resin material or resin film may be used as the resin material used in this embodiment.

Further, each hinge part and the slant faces 51*t* and 53*t* at both sides thereof may be formed at the same time as forming the rigid member 50Q with the resin material. It is preferable that a cross-sectional V-shape groove or a concave portion is formed preliminarily in a die, which is used to mold the rigid member 50Q.

Figure 18:
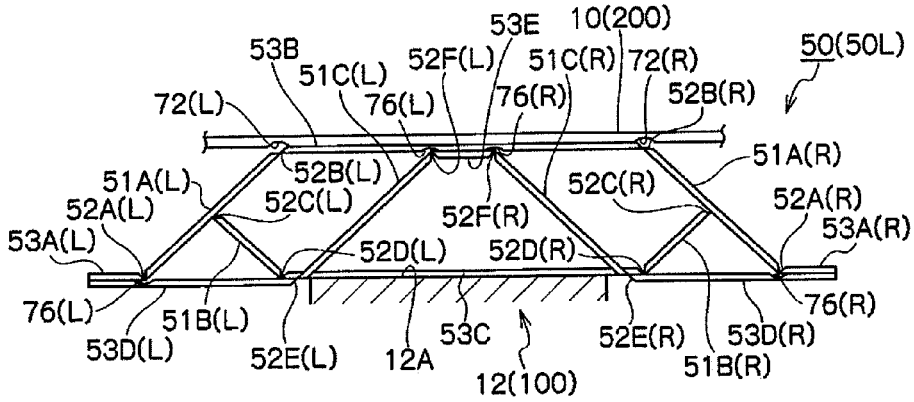
FIGS. 18(*a*) and (*b*) are views illustrating another example of the vibration direction converter part.
Figure 18:
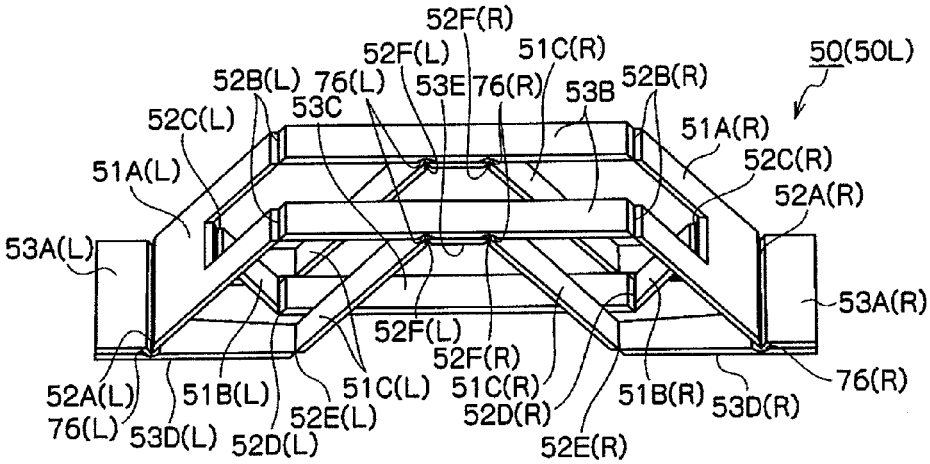
Figure 19:
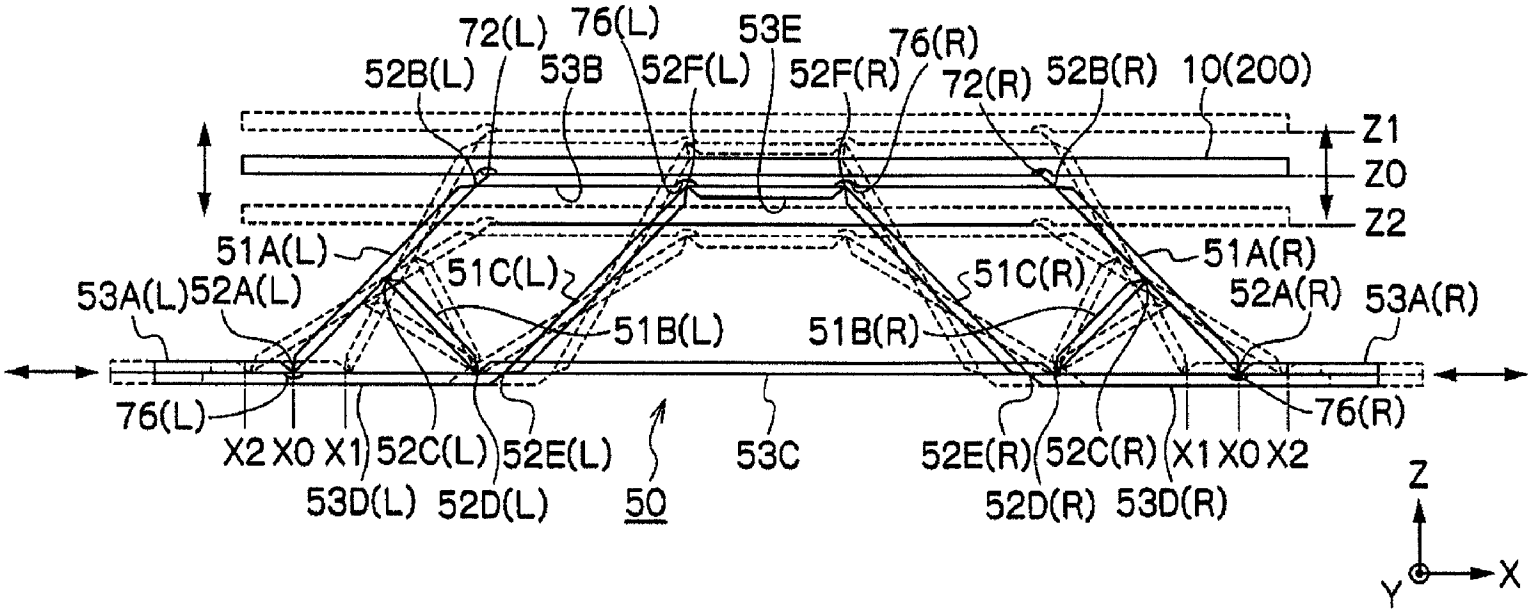
FIG. 19 is a view illustrating another example of the vibration direction converter part.
Figure 20:
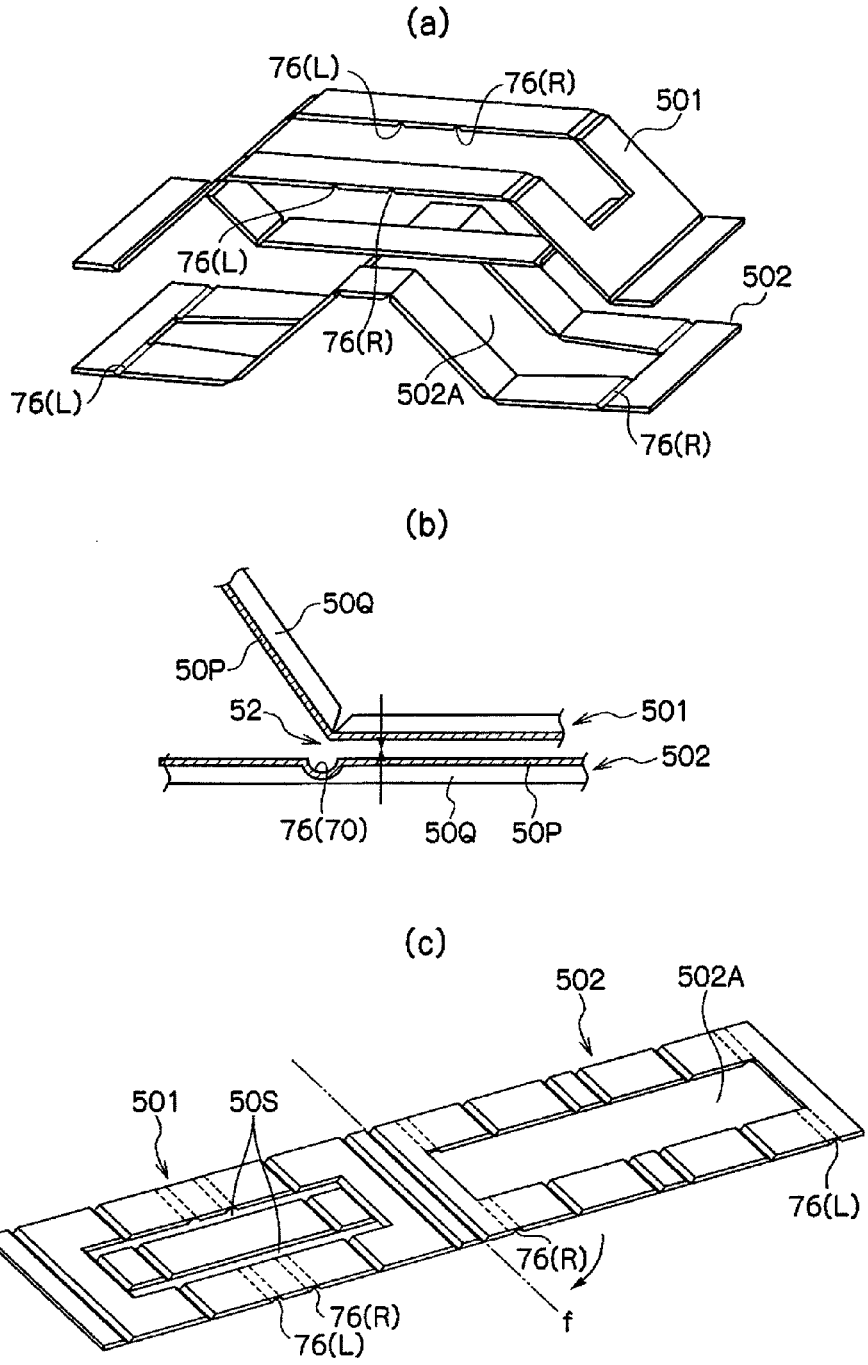
FIGS. 20(*a*)-(*c*) are views illustrating another example of the vibration direction converter part.

FIGS. 18, 19 and 20 are views illustrating other examples of the vibration direction converter part 50 (FIG. 18(*a*) is a side view, FIG. 18(*b*) is a perspective view, FIG. 19 is a view illustrating an operation and FIGS. 20(*a*) and 20(*b*) are views illustrating formation examples). The vibration direction converter part 50 (link body 50L) includes a pair of driving parts. In this embodiment, the vibration direction converter parts 50 are substantially symmetrically disposed opposite to each other and a parallel link is formed with a plurality of link parts.

The vibration direction converter part 50 includes a pair of first link parts 51A(R) and 51A(L) having a hinge part 52A (R) and 52A(L) to a first connecting part 53A(R) and 53A(L) at one end, and having a hinge part 52B(R) and 52B(L) to a second connecting part 53B at another end. Also, the vibration direction converter part 50 includes a pair of second link parts 51B(R) and 51B(L) having hinge parts 52C(R) and 52C(L) to the middle parts of the first link parts 51A(R) and 51A(L) at one end, and having hinge parts 52D(R) and 52D (L) to the static connecting part 53C at another end. As described above, the first connecting part 53A is connected to the voice coil 30 or the voice coil support part 40 directly or via the connecting part 60 as other member, while the second connecting part 53B is connected to the diaphragm 10 and the static connecting part 53C is connected to the bottom portion 12A of the frame 12 that is the static part 100, the yoke 22, etc. forming the magnetic circuit 20.

Further the vibration direction converter part 50 includes a pair of third link parts 51C(R) and 51C(L) having hinge parts 52E(R) and 52E(L) at one end to a pair of the connecting parts 53D(R) and 53D(L) integrally extending from the first connecting part 53A(R) and 53A(L), and having hinge parts 52F(R) and 52F(L) at another end to a connecting part 53E that is integral with the second connecting part 53B.

Further, the first link part 51A(R) and the third link part 51C(R), the first link part 51A(L) and the third link part 51C(L), the second link part 51B(R) and the third link part 51C(L), and the second link part 51B(L) and the third link part 51C(R) form parallel links respectively.

This link body 50L of the vibration direction convertor part 50 substantially includes a function combining the link body of the embodiment shown in FIG. 14 and the parallel link body. Each link part and connecting part are formed by integrating the continuous member 50P with the rigid member 50Q, while each hinge part between link parts is linearly formed with the bendable continuous member 50P, and thus link parts are mutually integrally formed via hinge parts.

As shown in the drawings, the second connecting part 53B arranged near the hinge parts 52F(R) and 52F(L) and a pair of the connecting part 53D(R) and 53D(L) arranged near the hinge parts 52A(R) and 52A(L) form concave portions 76 as the contact avoiding part 70, such that a space is formed between each hinge part and connecting part.

An operation of the vibration direction converter part 50 is described with reference to FIG. 19. In this embodiment, the static connecting part 53C functions as the static part 100. According to the vibration direction converter part 50, when the hinge parts 52A(R) and 52A(L) is moved from the reference position X0 to X1 in the X-axis direction in accordance with vibration of the voice coil support part 40, the second connecting part 53B and the connecting part 53E integrally with the second connecting part 53B moving up keeping a parallel state by the parallel link body, while the first link parts 51A(R) and 51A(L) and the third link parts 51C(R) and 51C(L), which configure a parallel link, are angle-varied as they are erected. Since the hinge parts 52D(R) and 52D(L) are supported at both ends of the static connecting part 53C as the static part, they receive a reaction force from the static part and angle of the first link parts 51A(R) and 51A(L) and the third link parts 51C(R) and 51C(L) is securely varied and the displacement of the hinge parts 52A(R) and 52A(L) from the position X0 to X1 is securely converted to the displacement of the diaphragm 10 from the position Z0 to Z1.

Similarly, when the hinge parts 52A(R) and 52A(L) is moved from the reference position X0 to X2 in the X-axis direction, the second connecting part 53B and the connecting part 53E integrally with the second connecting part 53B are moved down keeping a parallel state by the parallel link body, while angles of the first link parts 51A(R) and 51A(L) and the third link parts 51C(R) and 51C(L), which configure a parallel link, are varied as they are laid. Since the hinge parts 52D(R) and 52D(L) are supported by the static part, they receive a reaction force from the static part and angle variation of the first link parts 51A(R) and 51A(L) and the third link parts 51C(R) and 51C(L) is securely produced and the displacement of the hinge parts 52A(R) and 52A(L) from the position X0 to X2 is securely converted to the displacement of the diaphragm 10 from the position Z0 to Z2.

According to this vibration direction converter part 50, the vibration in the X-axis direction of one voice coil support part 40 is converted to the vibrations in the Z-axis direction of the hinge parts 52B(R) and 52B(L), 52F(R) and 52F(L), and the second connecting part 53B, which vibrate substantially in the same phase and the same amplitude. As such, since the diaphragm 10 is supported over a large area and given the vibration that has substantially the same phase and the same amplitude, the vibration of the voice coil support part 40 may be transmitted substantially in the same phase to the planar diaphragm 10 with large area.

As shown in FIG. 18(*b*), in the vibration direction converter part 50, a pair of the connecting parts 53B, 53D(R) and 53D(L) and the third link parts 51C(R) and 51C(L) are disposed in a width direction and parallel respectively. The first link parts 51A(R) and 51A(L) are formed in a biforked shape, and the hinge parts 52C(R) and 52C(L) to the second link parts 51B(R) and 51B(L) are formed at the middle parts of the first link parts 51A(R) and 51A(L). The second link parts 51B(R) and 51B(L) and the connecting part 53C are placed between a pair of the connecting parts 53B, 53D(R) and 53D(L) and the third link parts 51C(R) and 51C(L), which are disposed in a width direction and parallel.

With link parts configured with a single sheet-shape component as described above, the diaphragm 10 can be vibrated and supported by aface, and thereby the whole diaphragm 10 can be vibrated substantially in the same phase and divided vibration may be restrained.

Further, as shown in FIG. 18(*b*), in the vibration direction conversion part 50 of this embodiment, the first link parts 51A(R) and 51A(L), and the second connecting parts 53B are configured by folding the whole single sheet-shape component forming the link parts in a convex-trapezoid shape, while the second link parts 51B(R) and 51B(L), and the static connecting part 53C are configured by folding a partially taken-out portion of this plate component.

A method of configuring this vibration direction converter part 50 is described with reference to FIG. 20. According to one configuration method, this vibration direction convertor part 50 is formed by joining a plurality of sheet-shape components 501, 502 (for example, two components) as shown in FIG. 20(*a*). The first connecting parts 53A(R) and 53A(L), the first link parts 51A(R) and 51A(L), the second link parts 51B(R) and 51B(L), the second connecting parts 53B and the static connecting part 53C are formed in one sheet-shape component 501, while the connecting parts 53D, the third link parts 51C(R) and 51C(L) and the connecting parts 53E are formed in another sheet-shape component 502. And, the third link parts 51C(R) and 51C(L) and the connecting parts 53D (R) and 53D(L) are formed along the first link parts 51A(R) and 51A(L) and the second connecting parts 53B, and an opening 502A is formed in the sheet-shape component 502 corresponding to the second link parts 51B(R) and 51B(L) and the static connecting part 53C.

In this embodiment, the opening 502A, formed in another sheet-shape component 502 corresponding to the second link parts 51B(R) and 51B(L) and the static connecting part 53C of one sheet-shape component 501, is formed so as to expand inward from ends of another sheet-shape component 502. This configuration may prevent the second link parts 51B(R) and 51B(L), and the static connecting part 53C from contacting another sheet-shape component 502, and thus a smooth movement of the link body may be performed.

The two sheet-shape components 501 and 502, which are formed with the continuous member 50P and the rigid member 50Q, are applied with their continuous members 50P, 50P face-to-face as shown in FIG. 20(*b*). According to this arrangement, the continuous members 50P, 50P are integrated, and thereby hinge parts 52 may smoothly bend. Also in this case, the concave portion or the notch part 76 is formed as the contact avoiding part 70 near the hinge part 52.

Further, the slant face as shown in FIG. 14(*c*) is formed at the end of each link part near each hinge part. The slant face is formed such that the link parts do not interfere with each other when they bend at the hinge parts. Thus the link parts can efficiently bend at the hinge parts.

In another configuration example, the above-mentioned sheet-shape component 501 and the sheet-shape component 502 are integrally formed with the sheet-shape component 502 connected to the end of the sheet-shape component 501 as shown in FIG. 20(*c*). The vibration direction converter parts 50 shown in FIGS. 18 and 19 may be obtained by folding the integrated components along a folding line f in the direction of an arrow. In this example, the vibration direction converter part 50 may be simply configured by applying resin material forming the rigid member 50Q to the whole surface of the continuous member 50P that is a sheet-shaped member, cutting in a V-shape to form each hinge part and the slant faces at both sides thereof, and then forming the above-mentioned notch part 50S and opening 502A and hardening the resin material in the same way as shown in FIG. 17.

Further, when forming each hinge part and the slant faces 51*t* and 53*t* at the both sides thereof, the rigid member 50Q may be formed with the resin material and molded at the same time. It is preferable that a cross-sectional V-shape groove or a concave portion is preliminarily formed in a die, which is used to mold the rigid member 50Q.

In the vibration direction converter part 50 shown in FIGS. 15 to 20, since the link body of the vibration direction converter part 50 may be configured with a single integral component with respect to two opposing voice coil support parts 40, the assembly operation may be simplified as well when configuring a speaker unit provided with a pair of driving parts. Further, provided with the static connecting part 53C, the hinge parts 52D(R) and 52D(L) may be held at fixed positions even if they are not particularly supported by the frame 12 corresponding to opposing vibrations of the voice coil support parts 40 (a plurality of the voice coil support parts 40 vibrate in directions opposite to each other), and thus the vibration direction converter part may be simply built into a speaker unit.

Further, in the vibration direction converter part 50 shown in FIGS. 18 to 20, since the right side first link part 51A(R) and the third link parts 51C(R), and the left side first link part 51A(L) and the third link parts 51C(L) form parallel links as the link body, the second connecting parts 53B fixed to the diaphragm 10 may be stably moved in parallel in the Z-axis direction corresponding to the opposing vibrations of the voice coil supporting parts 40. Accordingly, it is possible to apply stable vibrations to the planar diaphragm 10.

According to this speaker unit 1U (1A, 1B), when an audio signal SS is inputted, the voice coil support part 40 vibrates along the magnetic gap 20G formed in a direction different from the vibration direction admissible for the diaphragm 10, and this vibration is direction-converted by the vibration direction converter part 50 and transmitted to the diaphragm 10, and thereby vibrating the diaphragm 10 to emit a sound in the sound emission direction SD corresponding to the audio signal SS.

Since the direction of the magnetic gap 20G is configured to cross the vibration direction of the diaphragm 10 and the thickness direction of the speaker unit 1U (1A, 1B), increasing the driving force of the magnetic circuit 20 or the vibration of the voice coil 30 does not directly affect the size of the speaker unit 1U (1A, 1B) in the thickness direction (Z-axis direction). Accordingly, it is possible to make the speaker unit 1U (1A, 1B) thin while pursuing making a louder sound.

Further, since the vibration direction converter part 50 converts the vibration direction of the voice coil support part 40 and transmits the vibration to the diaphragm 10 through the mechanical link body, transmission efficiency of vibration is high. In particular, in the speaker unit 1U (1A, 1B) shown in FIGS. 14 to 15, since angle variation of the first link parts 51A and the second link parts 51B is produced by the vibration of the voice coil support part 40 and reaction force of the static part 100, vibration of the voice coil support part 40 may be more securely transmitted to the diaphragm 100. Accordingly, the speaker unit 1U (1A, 1B) may produce preferable reproducing efficiency.

Further, in the speaker unit 1U (1A, 1B) shown in FIGS. 9, 14, and 15, provided with the connecting part 60, interval in the Z-axis direction may be provided between the position of the end 40A of the voice coil support part 40 and the position of the end 50A of the vibration direction converter part 50. As such, the length (height) in the Z-axis direction (thickness) of the magnetic circuit 20 can be included in the length in the Z-axis direction of the vibration direction converter part 50, and thus the speaker unit 1U (1A, 1B) may be made thin while securing a sufficient length in the Z-axis direction for the magnetic circuit 20, which is required to secure a driving force. Further, provided with the connecting part 60, a necessary length of the direction converter part 50 (length of link parts 51) may be sufficiently secured even if the speaker unit 1U (1A, 1B) is made thin, and thus the amplitude of vibration of the diaphragm 10 may be comparatively large.

More particularly, a bottom portion 61 of the connecting part 60 is configured to slide over the bottom portion 12A of the frame 12 or the static part 100 with a predetermined distance therefrom, and thereby vibration of the voice coil support part 40 may be stabilized. Further, the end of the vibration direction converter part 50 can be linearly moved, and thus the end of the vibration direction converter part 50 connected to the diaphragm 10 can be securely and stably moved.

Figure 21:
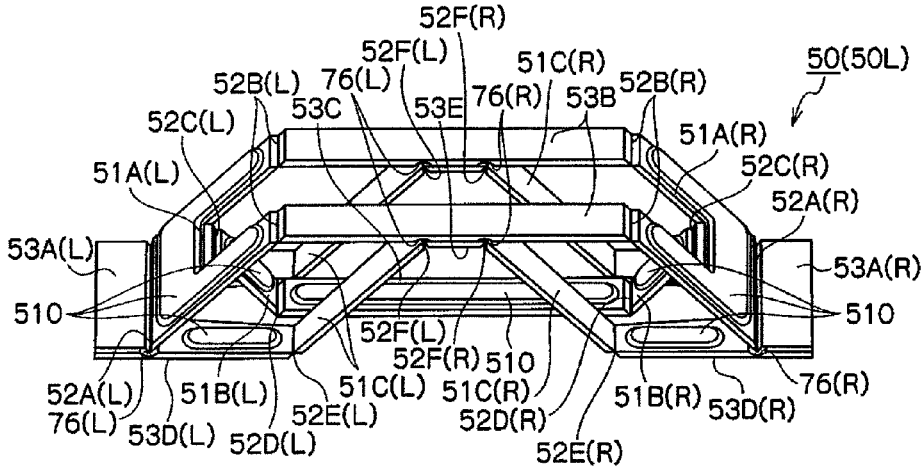
FIGS. 21(*a*) and (*b*) are views illustrating another example of the vibration direction converter part.
Figure 21:
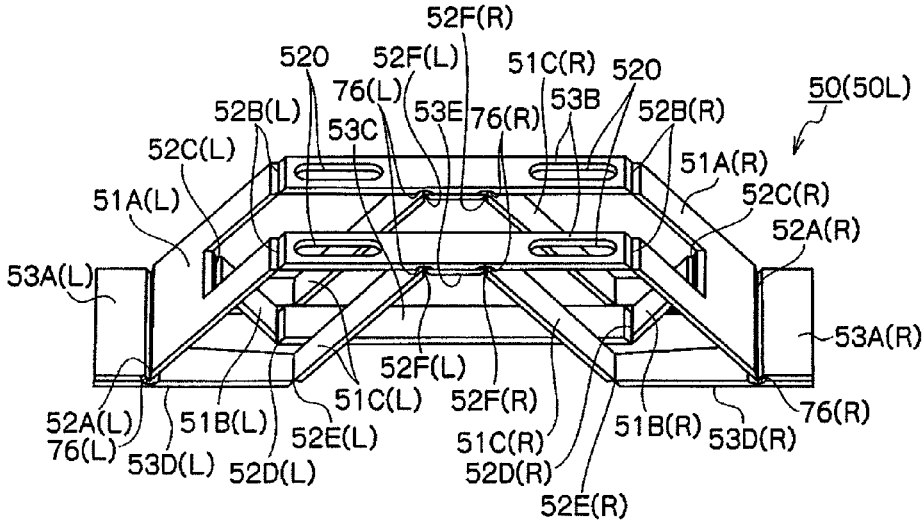

The vibration direction converter part 50 shown in FIG. 21 is a modified example of the embodiment shown in FIG. 18. In one example shown in FIG. 21(*a*), a convex portion 510 is provided on the link part that are subject to bend by opposing vibrations of the voice coil supporting parts 40, thereby rigidity of the link part can be increased. As shown in the drawing, the first link part 51A(R) and 51A(L), the second link parts 51B(R) and 51B(L), the connecting parts 53D(R) and 53D(L) and the connecting part 53C are provided with the convex portion 510 respectively. Further, in one example shown in FIG. 21(*b*), openings 520 are provided in the link part that need no particular strength, weight of the vibration direction converter part can be decreased. In the drawing, the connecting part 53B includes the openings 520. The weight reduction of the vibration direction converter part is effective to broaden a reproduction characteristic or increase amplitude and a sound pressure level of a sound wave corresponding to predetermined voice currents.

FIGS. 22 to 28 are views illustrating a power feed structure of the speaker unit according to one embodiment of the present invention. The speaker unit according to the embodiment of the present invention, with reference to the above-mentioned basic structure, includes the diaphragm 10 provided with concave portion 10*a*, the static part 100 vibratably supporting the vibrating body 10 and the driving part 14, provided in proximity of the static part 100, vibrating the diaphragm 10 in response to an audio signal, while the driving part 14 includes a plurality of the voice coils 30, 30 vibrating in a direction different from the diaphragm 10 upon the inputted audio signal, a plurality of the magnetic circuits 20, 20 having the magnetic gaps 20G, 20G in which the voice coils 30, 30 are arranged respectively and the rigid vibration direction converter part 50, which is obliquely disposed with respect to the vibration directions of the voice coils 30, 30 and the diaphragm 10, transmits the vibrations of the voice coils 30, 30 to the diaphragm 10.

Further, terminal parts 81, 81 common to a plurality of the voice coils 30, 30, which extend from one voice coil 30 to another voice coil 30 of the plurality of the voice coils 30, 30 in order to input the audio signal to the plurality of the voice coils 30, 30, are provided on the static part 100. When a pair of the voice coils 30, 30 are provided, a pair of these terminal parts 81, 81 are provided and each one end of the pair of the voice coils 30, 30 is connected to one terminal part 81, while each another end of the pair of the voice coils 30, 30 is connected to another terminal part 81. Provided with common terminal parts 81, 81 to a plurality of the voice coils 30, 30, a space for arranging the terminal parts may be reduced to be less than when the terminal parts are provided on one and another end of each voice coil 30. The space required for the terminal parts is reduced, and thereby a small sized or thin speaker unit may be produced.

Wirings (first wiring 80A) are formed at the terminal parts 81, 81 to electrically connect a plurality of the voice coils 30, 30. As such, the audio signal may be supplied to each of the plurality of the voice coils 30, 30 via the wirings when the audio signal is inputted to the terminal parts 81, 81.

Figure 22:
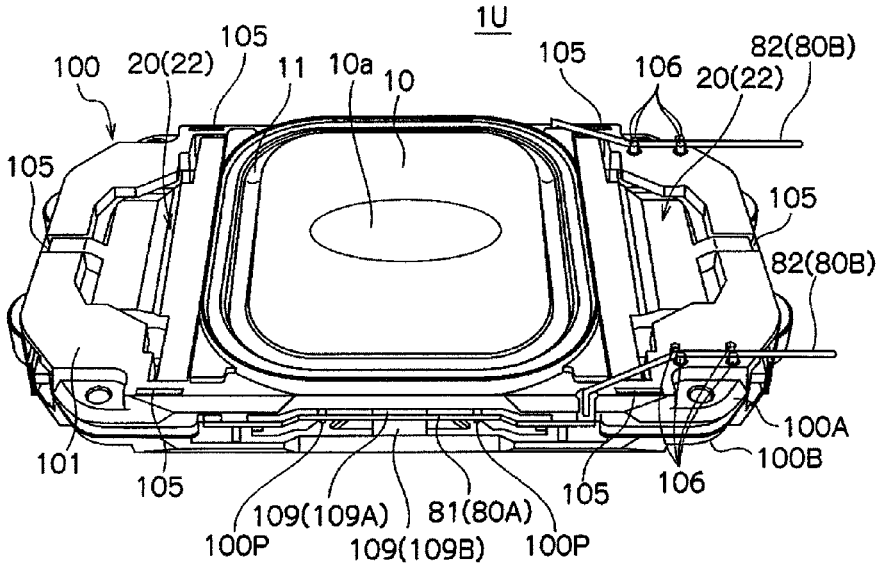
FIGS. 22(*a*) and (*b*) are views illustrating a power feed structure of the speaker unit according to an embodiment of the present invention.
Figure 22:
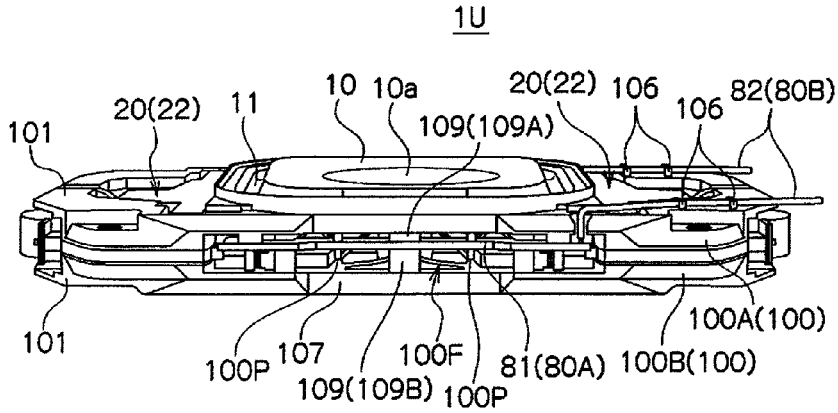

FIGS. 22(*a*) and 22(*b*) are external perspective views of the speaker unit according to the embodiment of the present invention. The static part 100 of the speaker unit 1U is configured with a first configuring member 100A and a second configuring member 100B. The second configuring member 100B is a frame arranged on the side of the vibration direction converter part 50, and supports a part of the vibration direction converter part 50. The terminal parts 81, 81 are arranged between the first configuring member 10A and the second configuring member 100B. The first configuring member 100A is a frame arranged on the side of the diaphragm 10, and supports the diaphragm 10 via the edge 11. Further, the first configuring member 100A and the second configuring member 100B support the magnetic circuit 20. The first configuring member 100A supports one magnetic pole member (yoke 22) that is one side of the magnetic circuit 20. The second configuring member 100B supports another magnetic pole member (yoke 22) that is another side of the magnetic circuit 20. Thereby, a magnetic gap with a prescribed interval is formed between both magnetic pole members while the first configuring member 100A and the second configuring member 100B are coupled.

Figure 23:
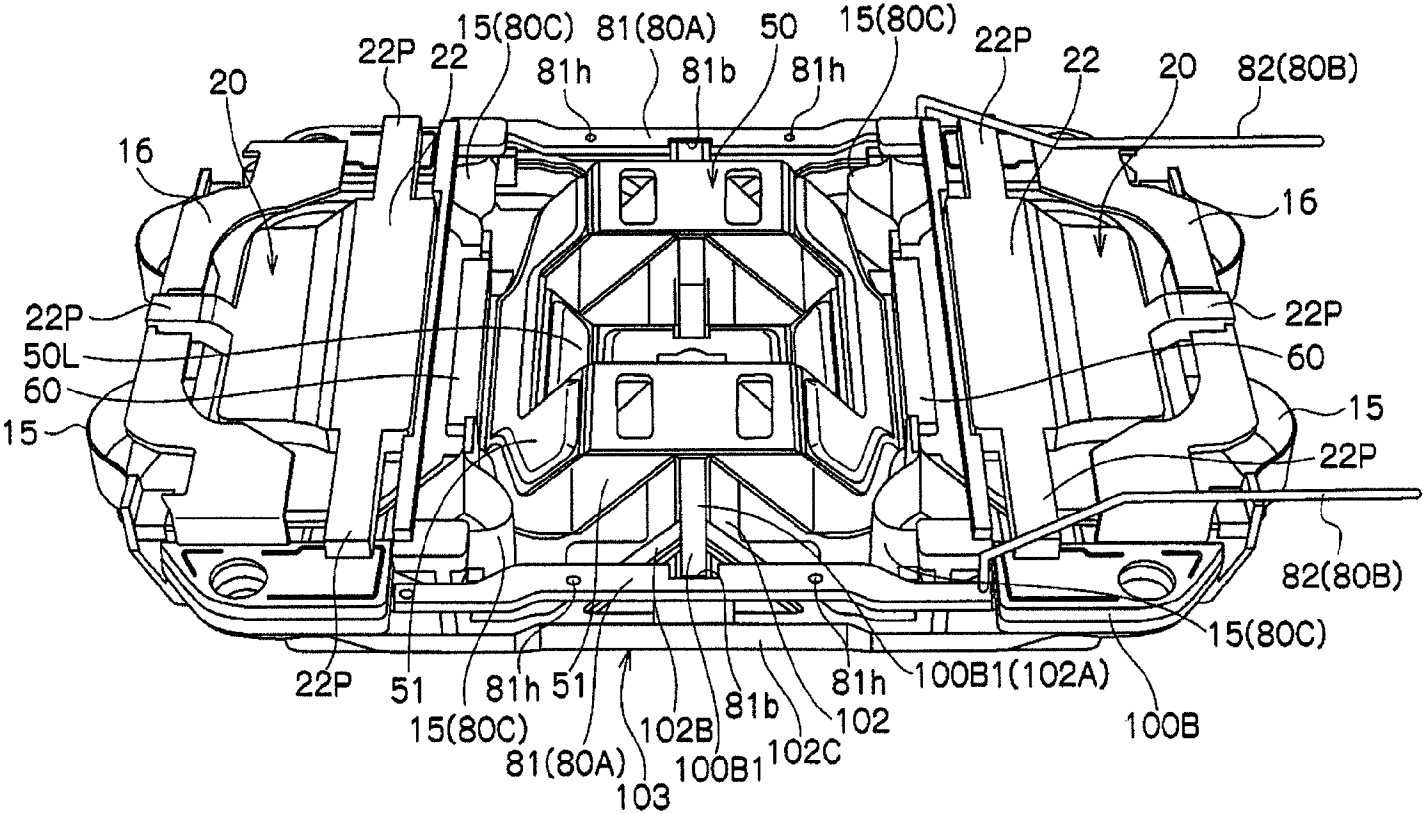
FIG. 23 is a view illustrating a power feed structure of the speaker unit according to an embodiment of the present invention.
Figure 26:
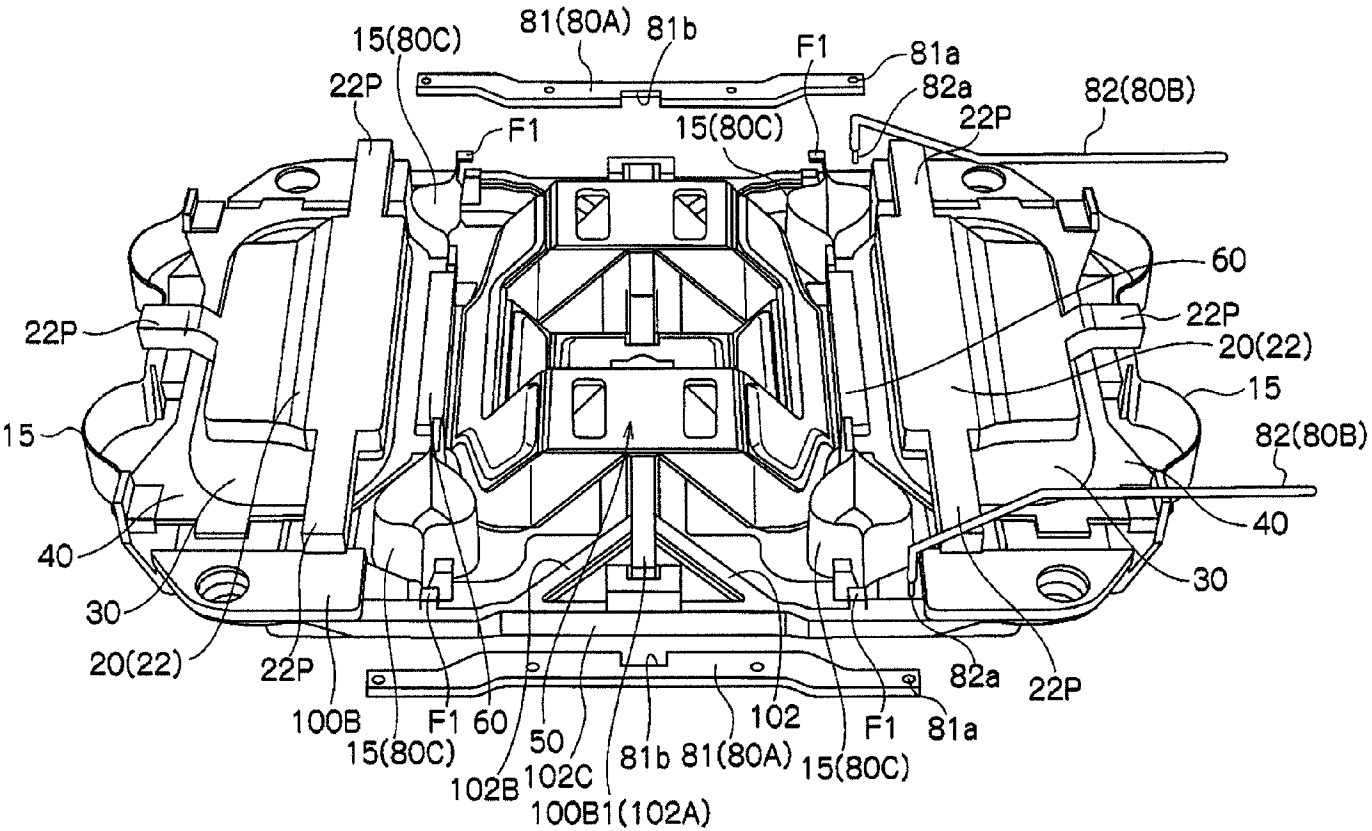
FIG. 26 is a view illustrating a power feed structure of the speaker unit according to an embodiment of the present invention.

FIGS. 23 and 26 are views illustrating configuration examples of the static part 100 in a speaker device according to an embodiment of the present invention. As described above, the static part 100 is formed with the frame 12. This static part 100 includes an outer periphery frame 101 surrounding the diaphragm 10 and a bridge part 102 bridging inside of the outer periphery frame 101, and the bridge part 102 exerts a reaction force on the above-mentioned the link body 50L (vibration direction converter part 50) and has rigidity in the vibration direction of the link body 50L.

As described above, upon vibration of the voice coil 30, the vibration is transmitted to the diaphragm 10 via the link body 50L. Thereby a reaction force from the diaphragm 10 is applied to the link body 50L angle converting the link part 51. When the link body 50L receives this reaction force, if the static part 100 supporting the link body 50L is bent, the link body 50L itself vibrates, and thus unwanted vibration is transmitted to the link part 51. If the vibration transmitted to the link part 51 is transmitted to the diaphragm 10, the vibration of the voice coil 30 is not efficiently transmitted to the diaphragm 10. Accordingly, the bridge part 102, a part of the static part 100, supporting the link body 50L, has a function of restraining a deflection of the bridge part 102, thereby unwanted vibration is prevented from being transmitted to the link part and the diaphragm 10. Therefore, the vibration of the voice coil 30 may be efficiently transmitted to the diaphragm 10.

The static part 100 includes the first configuring member (first frame) 100A and the second configuring member (second frame) 100B. The first configuring member 100A is a support part material on the sound emission side of the speaker device 1B. The second configuring member 100B is a support part material on the opposite (rear) side of the sound emission side. The driving part 14 of the speaker device 1 is supported sandwiched between the first configuring member 100A and the second configuring member 100B.

The first configuring member 100A includes the annularly formed outer periphery frame 101, and supports the outer periphery of the diaphragm 10 via the edge 11 and supports one side (22B) of the magnetic pole member (yoke) 22 of the magnetic circuit 20. The second configuring member 100B includes the outer periphery frame 101 and the bridge part 102, and supports one side (22A) of the magnetic pole member (yoke) 22 of the magnetic circuit 20 while the bridge part 102 supports the link body 50L. The bridge part 102 has rigidity against a force applied by the diaphragm 10 via the link body 50L. To this end, compliance of the bridge part 102 is preferably substantially the same or lower than that of the outer periphery frame 101 in the vibration direction of the diaphragm 10. More particularly, the thickness of the bridge part 102 is preferably substantially the same or larger than the thickness of a part of the static part 100 supporting the diaphragm 10 or the magnetic circuit 20.

The bridge part 102 provided at the second configuring member 100B has a first projection part 102A formed projecting along its extending direction and the vibration direction of the diaphragm 10. This first projection part 102A is a rib structure formed along the longitudinal direction of the bridge part 102, and thereby bending rigidity of the bridge part 102 is enhanced. Further, the second projection part 102B, extending in a direction crossing the first projection part 102A, is formed on the surface of the bridge part 102 opposing the diaphragm 10. This second projection part 102B is a reinforcing rib at both ends of the bridge part 102 and rigidly supports the bridge part 102 at the outer periphery frame 101 with both ends.

Further, the bridge part 102 has a third projection part 102C, extending in the direction crossing the first projection part 102A and the second projection part 102B, formed on the surface of the static part 100 opposing the diaphragm 10, and reinforcing parts 103 are formed at a plurality of the second projection parts 102B and the third projection parts 102C. The planar shape of the reinforcing part is polygonal shape.

The first configuring member 100A and the second configuring member 100B, which are the static part 100, have a planar shape having a long axis $O_1$ and a short axis $O_2$, and the bridge part 102 is formed along the short axis $O_2$ direction. Further, the bridge part 102 may be formed along the long axis $O_1$ direction or along the long axis $O_1$ direction and the short axis $O_2$ direction.

An opening 100F is configured with a concave portion formed between the opposing faces of the first configuring member 100A and the second configuring member 100B. Projection parts 109 (109A, 109B), supporting the terminal parts 81, 81, are formed at the first configuring member 100A and the second configuring member 100B, and the terminal parts 81, 81 are sandwiched between the projection part 109A and the projection part 109. As such, when the first configuring member 100A and the second configuring member 100B are coupled, the terminal parts 81, 81 may be concurrently stably fixed.

Further, as shown in FIG. 22, the static part 100 includes an outer-periphery frame 101 surrounding the magnetic circuit 20 and a bottom face part 107, and the terminal parts 81, 81 are formed in a shape along the outer-periphery frame 101 and are mounted on the outer-periphery frame 101. As such the terminal parts 81, 81 are not projected out of the outer-periphery frame 101 of the static part 100, the device can be made compact. Further, with the terminal parts 81, 81 mounted on the outer-periphery frame 101, the terminal parts 81, 81 may be stably fixed, and thereby bad connection with the voice coils 30, 30 may be avoided.

The terminal parts 81, 81 are formed in a shape having a long axis extending along one voice coil 30 to another voice coil 30 and a short axis crossing the long axis. With this longitudinal shape, efficiency of installation space may be improved.

The terminal parts 81, 81 may be arranged inside the outer-periphery frame 101. Therefore the terminal parts 81, 81 may be arranged without affecting shape or size of the outer circumference of the speaker unit. Further, the terminal parts 81, 81 may be arranged inside the outer-periphery frame 101 by using a technique of insert molding as necessary.

The respective outer-periphery frames 101, 101 of the first configuring member 100A and the second configuring member 100B include the above-mentioned openings 100F between faces opposing the voice coil 30, and the terminal parts 81, 81 are arranged in the opening 100F. In this case, the terminal parts 81, 81 act as reinforcing parts reinforcing the opening 100F of the static part 100.

The terminal parts 81, 81 are provided with a connecting part 81*a* to wirings 82, 82 (second wiring 80A) that are electrically connected to outside (see FIG. 26), and a wiring (first wiring 80A) of the terminal parts 81, 81 and a wiring 82 (second wiring 80B) are electrically connected at the connecting part 81*a*. The wiring 82 (second wiring 80A) is fixed on the side face of the static part 100 and connected to the terminal parts 81, 81. The outer-periphery frame 101 of the static part 100 includes a side face on which the wiring 82 (second wiring 80B) is mounted, and guiding parts 106, 106 guiding the wirings 82, 82 are formed on the side face of the static part 100.

Figure 24:
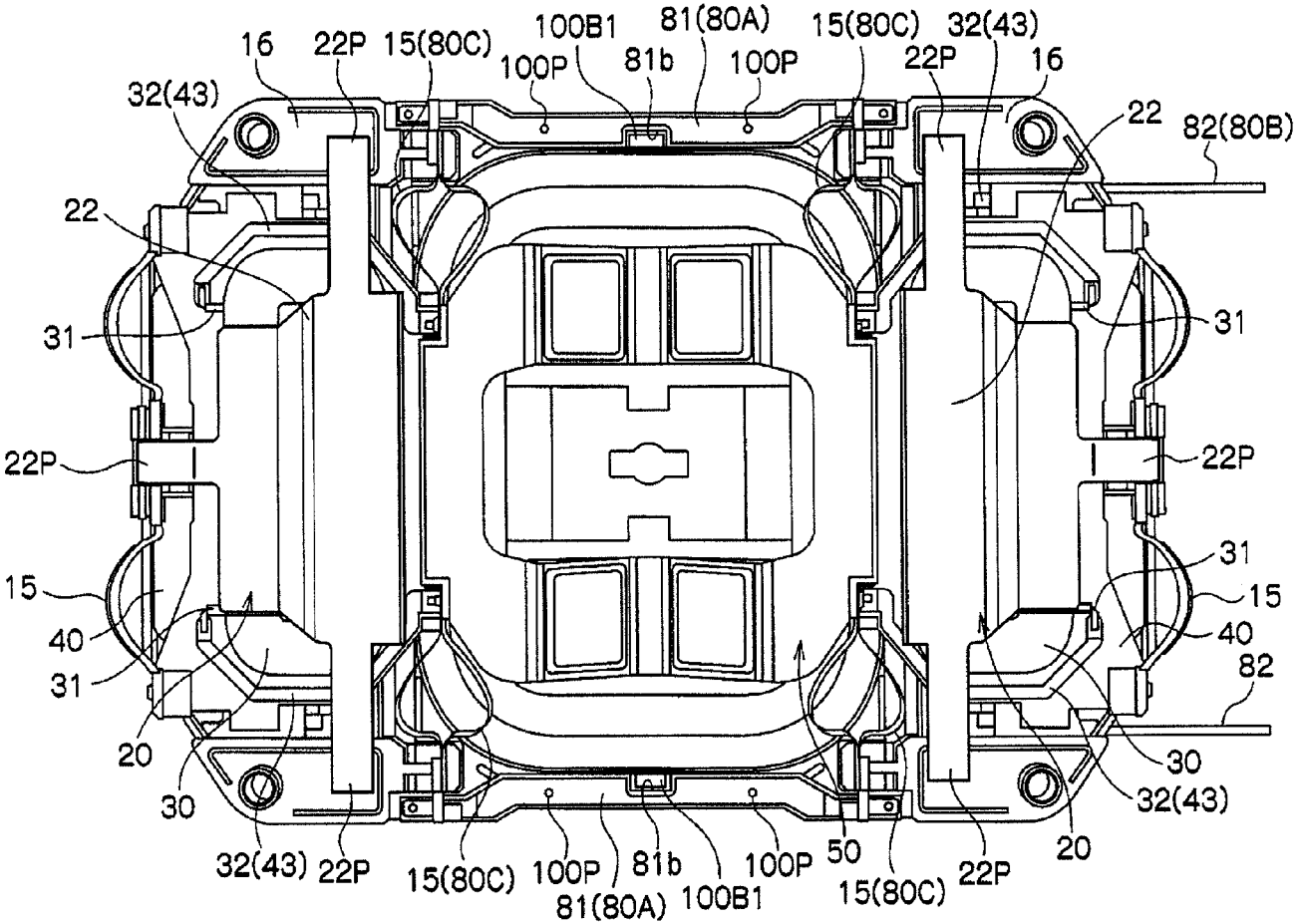
FIG. 24 is a view illustrating a power feed structure of the speaker unit according to an embodiment of the present invention.
Figure 25:
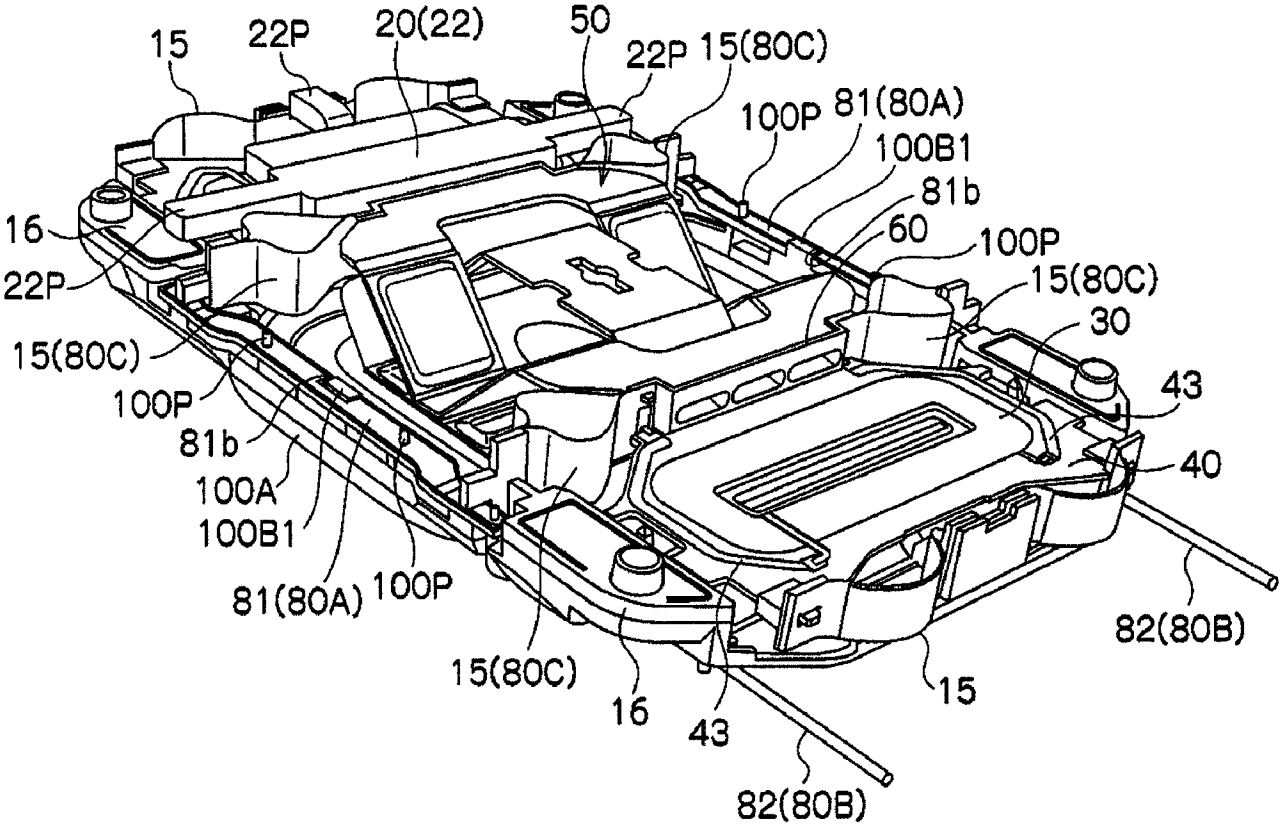
FIG. 25 is a view illustrating a power feed structure of the speaker unit according to an embodiment of the present invention.
Figure 27:
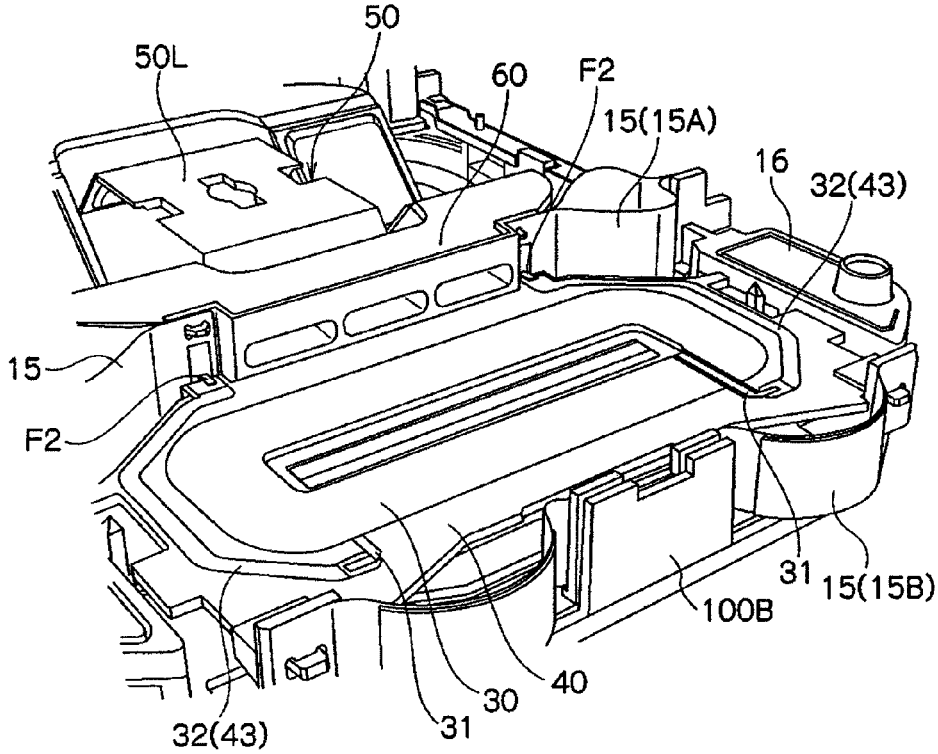
FIG. 27 is a view illustrating a power feed structure of the speaker unit according to an embodiment of the present invention.
Figure 28:
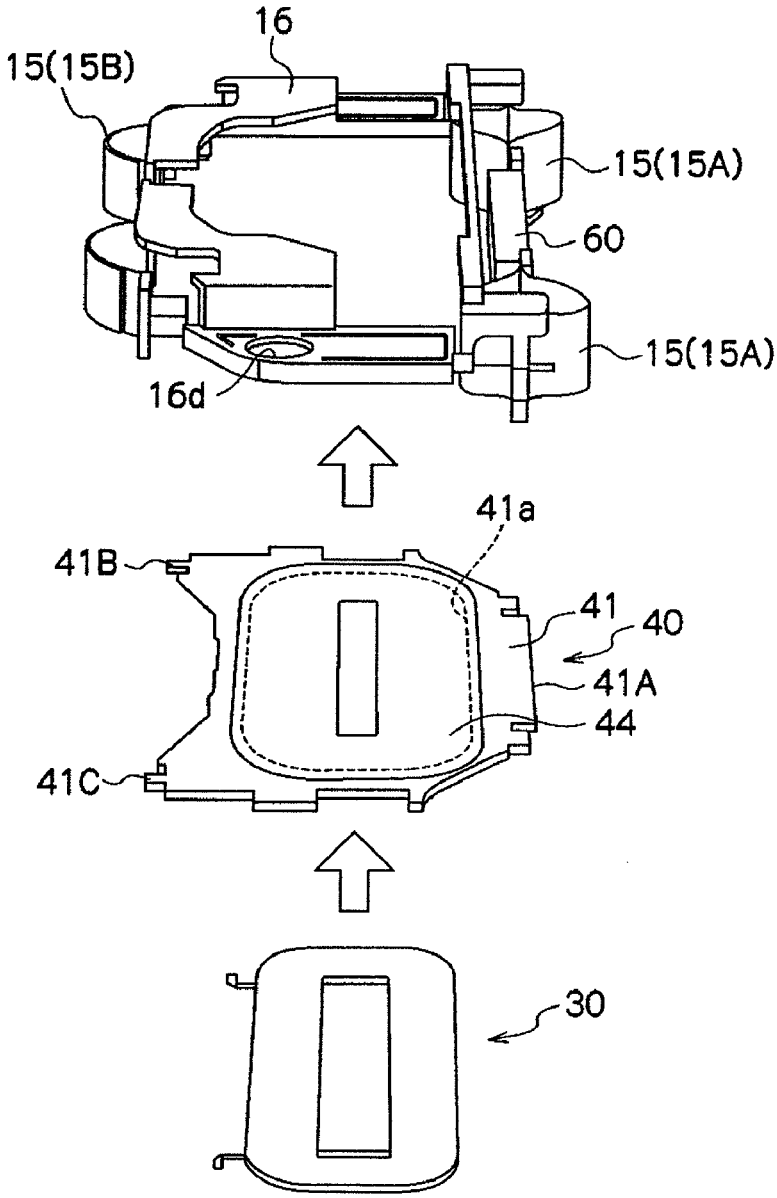
FIG. 28 is a view illustrating a power feed structure of the speaker unit according to an embodiment of the present invention.
Figure 29:
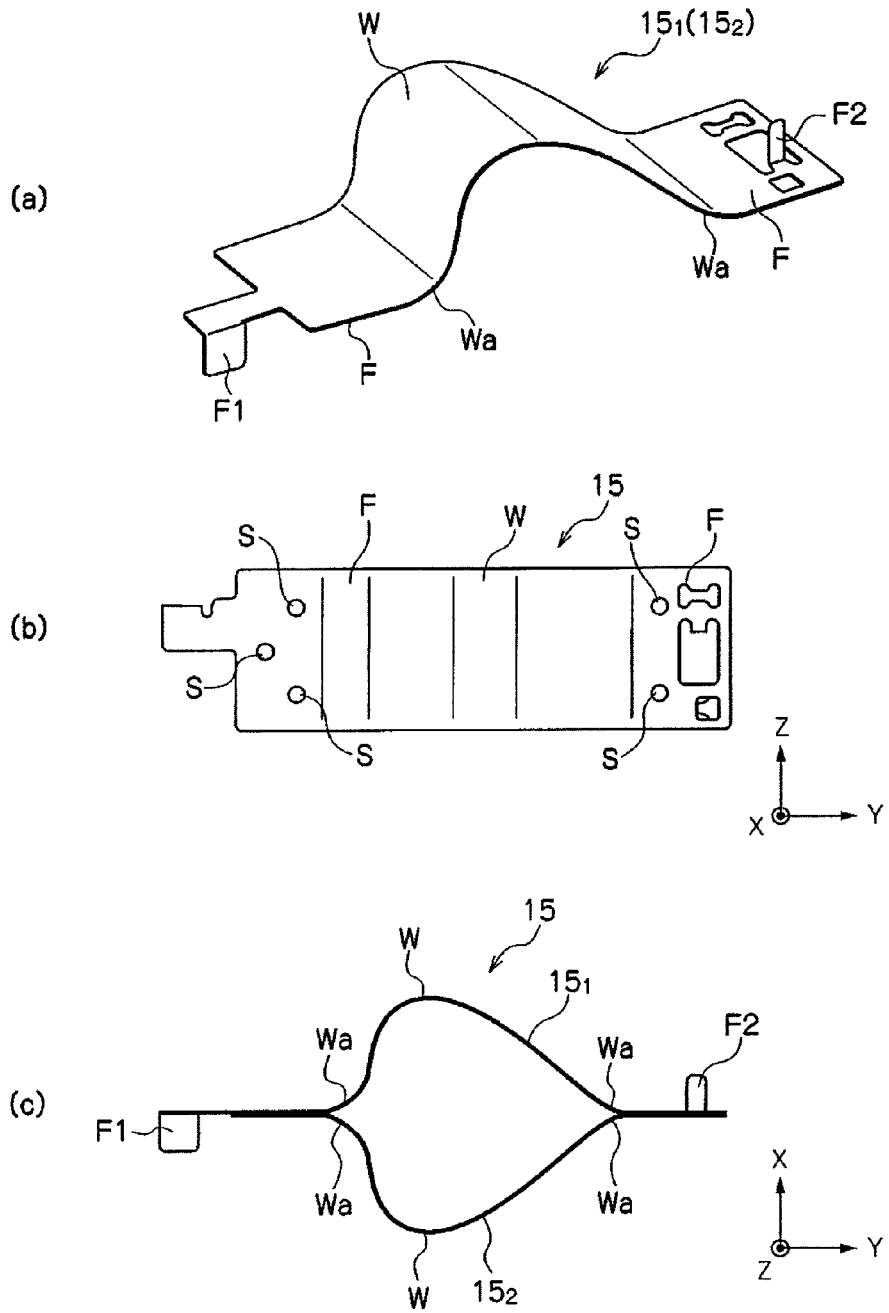
FIGS. 29(*a*)-(*c*) are views illustrating components of a holding part.

FIG. 23 is a perspective view illustrating an inner structure of the speaker unit (excluding the first configuring member 100A); FIG. 24 is a plan view illustrating an inner structure of the speaker unit (excluding the second configuring member 100B); FIG. 25 is a perspective view illustrating an inner structure of the speaker unit (excluding the second configuring member 100B); FIG. 26 is a perspective view illustrating an inner structure of the speaker unit (illustration of connected state of wiring); FIG. 27 is a partial enlarged view illustrating an inner structure of the speaker unit; FIG. 28 is a view illustrating installation structure of the voice coil; and FIG. 29 is a view illustrating components of the holding part.

The yoke 22 of the magnetic circuit 20 is provided with a projection part 22*p* to support the yoke 22 at the first configuring member 100A and the second configuring member 100B. The projection part 22*p* is engaged with a receiving part 105 provided at the first configuring member 100A and the second configuring member 100B.

Either one of the first configuring member 100A and the second configuring member 100B is provided with a positioning pin 100P positioning the terminal parts 81, 81 (see FIGS. 24 and 25) and the terminal part 81 may be arranged at a prescribed position with respect to the static part 100 with the positioning pin 100P inserted into a hole 81*h* (see FIG. 23) of the terminal parts 81, 81. Further, according to the example shown in the drawings, a concave portion 81*b* is formed at the side portion of the terminal part 81, 81, and the terminal parts 81, 81 are positioned at the second configuring member 100B with this concave portion 81*b* engaged with a convex portion 100B1 formed at the second configuring member 100B.

The voice coil 30 is an annular conducting member formed in a tabular shape, and this conducting member is supported by a rigid base (voice coil support part 40). The voice coil 30 or the voice coil support part 40 is unitized by a mounting unit 16 and mounted between the first configuring member 100A and the second configuring member 100B. Further, the voice coil 30 or the voice coil support part 40 is mounted at the mounting unit 16 via the holding part 15, and the voice coil 30 or the voice coil support part 40 is supported by the static part 100 via the holding part 15 with the mounting unit 16 mounted between the first configuring member 100A and the second configuring member 100B. Further, the mounting unit 16 is integrated with the connecting part 60, and the voice coil 30 or the voice coil support part 40 are connected to the vibration direction converter part 50 via the connecting part 60.

A voice coil lead wire 32 (see FIG. 27) connected to a lead wire 31 is formed on the surface of the voice coil support part 40 (base) supporting the voice coil 30. The voice coil lead wire 32 is a conducting layer 43, which is pattern-formed outside of the conducting member of the voice coil 30 so as to surround the conducting member. A pair of the conducting layers 43 are placed such that the voice coil lead wire 32 electrically connects the conducting member of the voice coil 30 and the holding part 15 and functions as a junction wire for inputting the audio signal to the conducting member of the voice coil 30.

A wiring (third wiring 80C), which electrically connects the voice coil 30 and the terminal part 81, is formed on the holding part 15. The end of the terminal parts 81, 81 and the wiring (third wiring 80C) are electrically connected, the wiring (third wiring 80C) of the holding part 15 and the voice coil lead wire 32 are connected, and the wiring 82 (second wiring 80B) is connected to the terminal part 81, 81. Thereby, the audio signal is inputted from outside to the voice coil 30. The wiring (third wiring 80C) may be formed with the holding part 15 as the conducting member. Further, wiring may be separately formed on the holding part 15. Also, the holding part 15 in itself may be formed by using a wiring substrate. Connection between the wiring 82 (second wiring 80B) and the terminal part 81, 81 is made by electrical connection between an end 82*a* of the wiring 82 and a connecting part 81*a* of the terminal parts 81, 81.

The holding part 15 has rigidity in a vibration direction of the diaphragm 10 and has a deformable shape in a vibration direction of the voice coil 30. In the example shown in the drawings, the holding part 15 has a side face linearly extending in the vibration direction (X-axis direction) of the diaphragm 10 and has a curved cross-sectional shape in the vibration direction of the voice coil 30. As such, the holding part 15 may restrict the vibration of the voice coil 30 in one axis direction (X-axis direction) and the vibration of the voice coil 30 in other directions is restrained.

The holding part 15, which supports the voice coil 30 at the static part 100 directly or via other member vibratably in the vibration direction of the voice coil 30, has the first holding part 15 (15A) and the second holding part 15 (15B). The first holding part 15 (15A) is arranged on the side of the vibration direction converter part 50 of the voice coil 30, and the second holding part 15 (15B) is arranged on the side opposite to the vibration direction converter part 50 of the voice coil 30.

The first holding part 15 (15A) is arranged on the right and left sides of the connecting part 60 between the connecting part 60 and the static part 100, and the second holding part 15 (15B) is arranged on the right and left sides of the voice coil 30 on the opposite side of coupling to the connecting part 60, and the first holding part 15 (15A) and the second holding part (15B) substantially symmetrically support the voice coil 30 at the static part directly or via other member. More particularly, in the second holding part 15 (15B), the central part thereof is supported by the static part directly or via other member, and both ends thereof are connected to the right and left ends of the voice coil.

FIG. 28 is a view illustrating an attachment structure of the voice coil. The voice coil 30, winding a conducting member, is supported by the voice coil support part 40, and the voice coil support part 40 is supported by the mounting unit 16 via the holding part 15. The voice coil support part 40 includes a voice coil attaching point 41*a* having an opening in the base 41 made of a tabular insulating material, and one side of the opening is covered with a protection film 44. The voice coil 30 is attached in this voice coil attaching point 41*a*.

Each of outer ends of a pair of the first holding part 15 (15A) is coupled to the mounting unit 16 on one side of the mounting unit 16, while inner end parts of a pair of the first holding part 15 (15A) are connected to the connecting part 60. The second holding part 15 (15B), a single component, is mounted on the mounting unit on another side of the mounting unit 16, and the central part of this second holding part 15 (15B) is connected to the mounting unit 16 while both ends of the second holding part 15 (15B) are mounted on both ends 41B, 41C of the voice coil support part 40. An end 41*a* of the voice coil support part 40 is connected to the connecting part 60. The connecting part 60 is a member connecting the voice coil 30 and the vibration direction converter part 50. A connection hole 16*d* is a fitting hole configured to connect the mounting unit 16 to the static part.

With reference to FIG. 29, a forming example of the holding part 15 is more specifically described. As shown in the drawing, the holding part 15 is formed by joining two configuring members $\mathbf{15}_1$, $\mathbf{15}_2$. FIG. 29(*a*) is a perspective view illustrating a single component of the configuring members $\mathbf{15}_1$, $\mathbf{15}_2$, FIG. 29(*b*) is a side view of the holding part 15, and FIG. 29(*c*) is its plan view. The configuring members $\mathbf{15}_1$ ($\mathbf{15}_2$) of the holding part 15, contacting each other at the tabular portion F, have first curved parts W and second curved parts Wa. Tabular portions F, F are provided on both ends, and connecting parts F1, F2 are provided in a direction perpendicular to the tabular portion F. A plurality of configuring members $\mathbf{15}_1$, $\mathbf{15}_2$ are conductive metal materials and applied by welding. In one example shown in the drawing, the configuring members $\mathbf{15}_1$, $\mathbf{15}_2$ are welded by applying a spot welding to the tabular portion F facing each other. In this example, spot welding is applied to a plurality of points of the tabular portions F, F at both ends (symbols s are spot welding points). Since the holding part 15 is formed with two configuring members $\mathbf{15}_1$, $\mathbf{15}_2$ applied each other, the holding part 15 may be prevented from twisting or generating a resonance.

A connecting part F1 to the terminal part 81, 81, which the holding part 15 includes, extends in a direction crossing the vibration direction (Z-axis direction) of the diaphragm 10, and is tabularly formed to contact with the terminal parts 81, 81. Also, a connecting part F2 to the voice coil lead wire 32, which the holding part 15 includes, extends in a direction crossing the vibration direction (Z-axis direction) of the diaphragm 10, and is tabularly formed to contact with the end of the voice coil lead wire 43.

Figure 30:
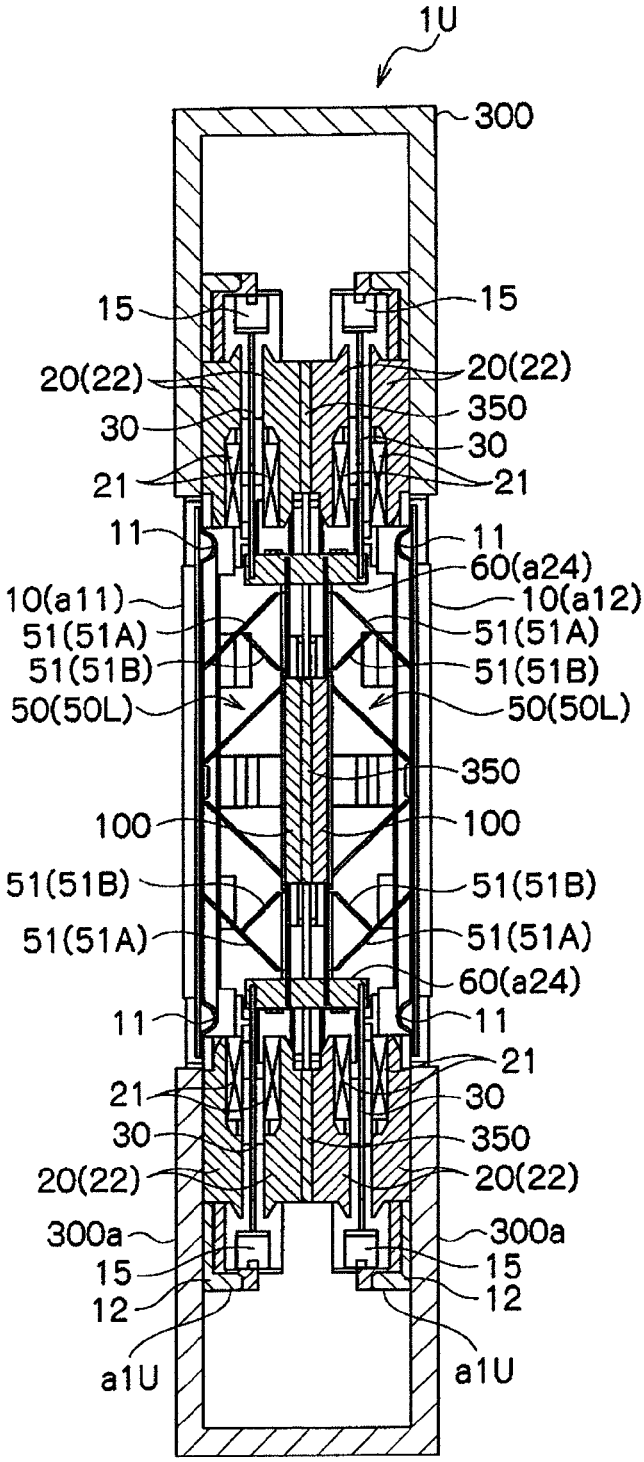
FIG. 30 is a view illustrating a speaker unit in which a speaker vibrating body according to an embodiment of the present invention is driven by a driving force of a magnetic circuit.
Figure 31:
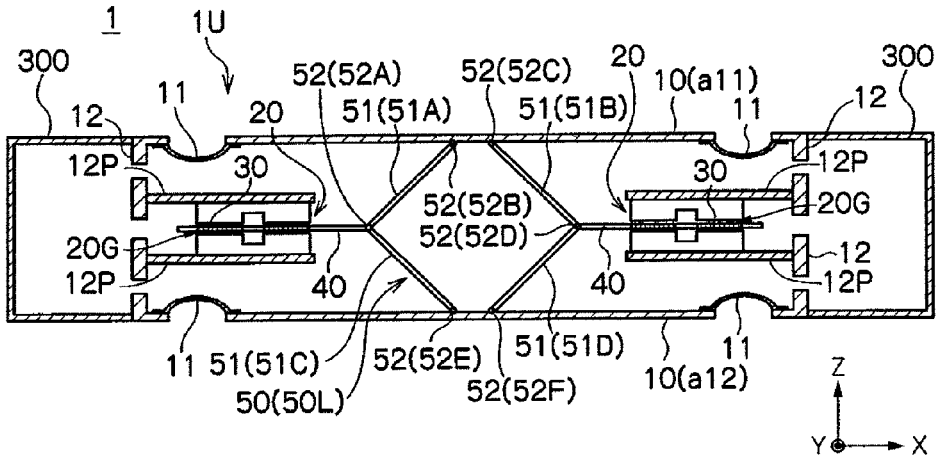
FIGS. 31(*a*) and (*b*) are views illustrating a speaker unit in which a speaker vibrating body according to an embodiment of the present invention is driven by a driving force of a magnetic circuit.
Figure 31:
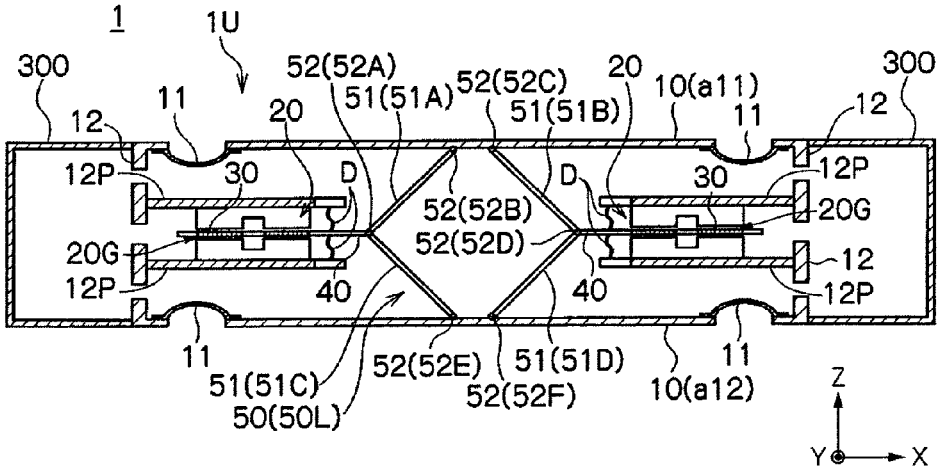
Figure 32:
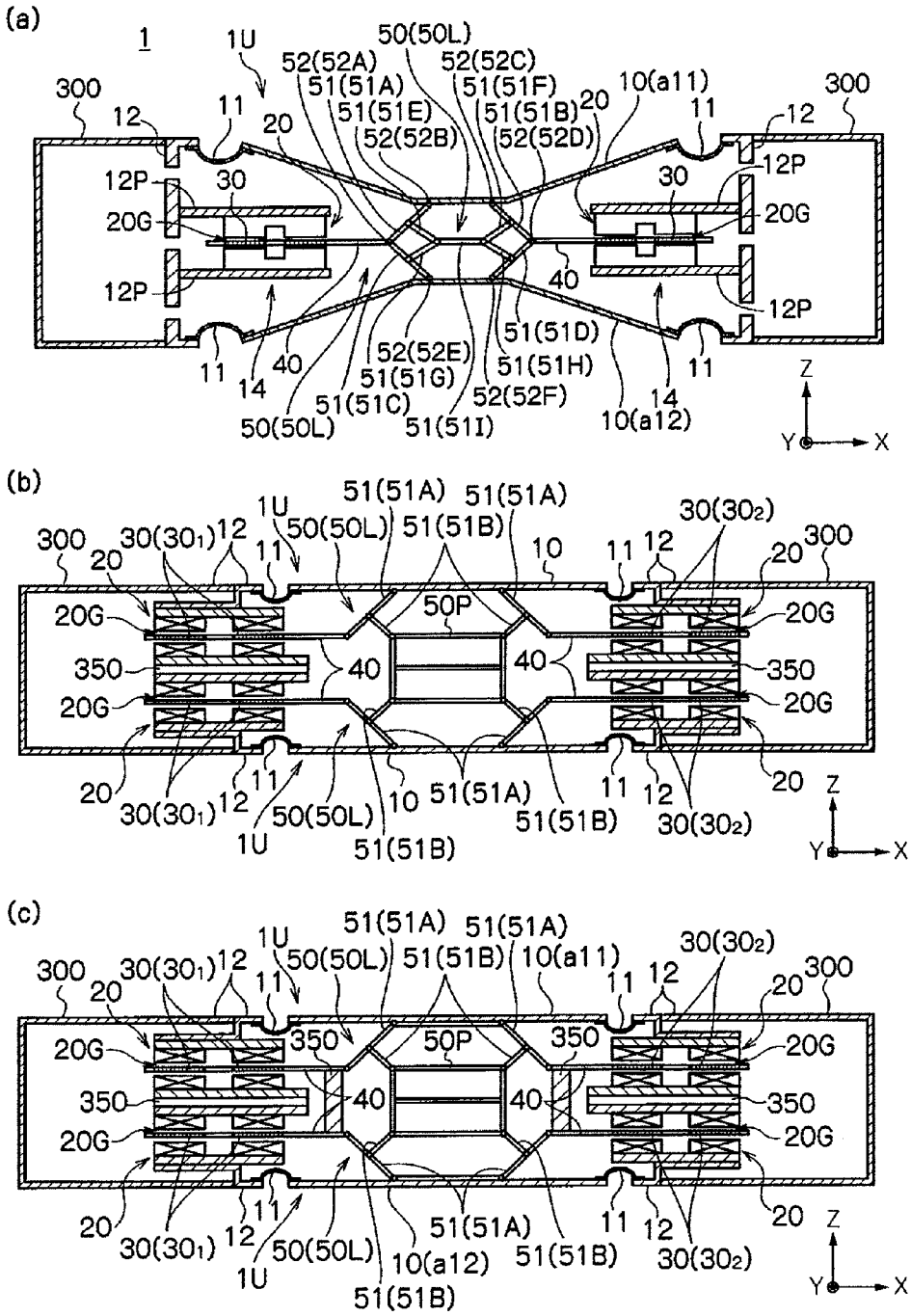
FIGS. 32(*a*)-(*c*) are views illustrating a speaker unit in which a speaker vibrating body according to an embodiment of the present invention is driven by a driving force of a magnetic circuit.

FIGS. 30 to 32 are views illustrating a speaker unit in which a speaker vibrating body according to an embodiment of the present invention is driven by a driving force of a magnetic circuit. A vibration direction converter part 50 configures a diaphragm connecting part connecting the first diaphragm a11 and the second diaphragm a12. In the embodiments, a plurality of diaphragms 10 (the first diaphragm a11 and the second diaphragm a12) disposed opposite to each other are driven by a plurality of driving units a1U, a1U or a single driving unit a1U.

According to the embodiment shown in FIG. 30, a plurality of the driving units a1U are provided such that the first diaphragm a11 and the second diaphragm a12 are mounted on the outer periphery faces of the frame 300 via the edges 11. In the example shown in the drawing, two driving units a1U are arranged opposite to each other and each of their static parts 100 is joined to each other directly or via other member, and thus a thin speaker unit of both-face-emission type 1U is configured. In this configuration, when two driving units a1U are driven by a single audio signal, vibrations, transmitted to both driving units a1U, a1U when driving, cancel out with each other, and thereby a stable drive may be realized. In the speaker unit that can be made thin as described above, even if two diaphragms are joined opposite to each other, the thickness of the speaker device is not much increased, and thus a speaker unit, with a frame 300 with thin depth (thickness), may be produced.

And, in this configuration, a vibration restraining member 350 may be provided between the driving units a1U, a1U. According to this configuration, vibrations affecting each other between the driving units a1U, a1U are absorbed by the vibration restraining member 350, and thereby more stable drive of the speaker unit 1U may be realized. Further, by providing the vibration restraining member or the mass of the first diaphragm being substantially the same as the mass of the second diaphragm a12, unwanted vibrations generated at the diaphragm connecting part, the static part or the voice coil may cancel out with each other, for example, upon a reaction force applied from the first diaphragm a11 and the second diaphragm a12. Further, substantially symmetrical vibration may be generated in the speaker vibrating body in the directions of the first diaphragm, the second diaphragm a12, or in the vibration direction of the voice coil, and thereby generation of the unwanted vibration may be restrained.

Further, in this embodiment, functioning as a diaphragm connecting part connecting the first diaphragm a11 and the second diaphragm a12, has a link part 51 as the first link part 51A. The vibration direction converter part 50 also has the second link part 51B as the link body 50L between the first link part 51A and the static part 100. The above-mentioned vibration restraining member 350 is mounted on a part of the static part 100 supporting the second link part 51B. In this embodiment, since the vibration restraining member 350 is mounted between the static parts 100, 100 supporting both link bodies 50L, 50L, it is possible to restrain the trouble that vibrations of the vibration direction converter part 50 affect each other, causing an unstable drive of the speaker device or generating abnormal noises when driving the speaker device. Further, when mechanical impedance of the link body is substantially the same, reaction forces on each link part of the vibration direction converter part 50 applied from the diaphragm 10, may cancel each other out. In the operation itself of the vibration direction converter part 50, with the static parts 100, 100, supporting both vibration direction converter parts 50, 50, connecting each other directly or via other member, position fluctuation of the static parts 100, 100 may hardly occur, and thereby stable vibration direction conversion may be realized.

Further, the static parts 100, 100 supporting both link bodies 50L, 50L may be a frame or a part of the diaphragm connecting part. If the static parts 100, 100 are parts of the diaphragm connecting part, for example, they can be made of a member forming the link part.

Further, the above-mentioned vibration restraining member 350 mounted between the static parts 100, 100 has flexibility or comparatively large compliance. Also, the static part has a high-cut function shutting off a vibration prescribed as a high frequency out of vibrations that voice coil 30 transmits to the diaphragm 10 via the vibration direction converter part 50. Thus, it is possible to restrain the trouble such that a reproduced sound-pressure frequency characteristic of the speaker unit 1U is fluctuated or a harmonic distortion of the speaker unit 1U is generated with the static part 100 resonating by the vibration of the vibration direction converter part 50. Further, as the example shown in the drawing, the connecting parts 60, 60 that the driving units a1U, a1U include may be connected directly or via the vibration restraining member 350. When the connecting parts 60, 60 are connected directly or via other member, generation of the unwanted vibration may be restrained, and thus acoustic characteristic may be improved.

The connecting part 60 is provided between the end on the side of the voice coil of the vibration direction converter part 50 and the end on the side of the vibration direction converter part 50 of the voice coil, and the positions of both ends are different in the vibration direction of the diaphragm 10. Specifically, in the diaphragm connecting part that functions by the vibration direction converter part 50, the connecting part 60 is provided between the end on the side of the voice coil of the link connecting part and the end on the side of the link connecting part of the voice coil, connecting both ends at different positions in the vibration direction of the diaphragm 10. Further, the connecting part 60 functions as the link connecting part a24.

FIGS. 31 and 32 show the speaker unit 1U, which vibrates a pair of the diaphragms 10 (the first diaphragm a11 and the second diaphragm a12) with the link body 50L of various types of vibration direction converter parts 50 functioning as diaphragm connecting parts. In the embodiment shown in FIG. 31, vibrations of the voice coils 30 ($\mathbf{30}_1$, $\mathbf{30}_2$) supported vibratably in the X-axis direction, moving toward or away from each other, are direction-converted by the vibration direction converter part 50 (diaphragm connecting part) that includes the link body 50L having the link parts 51 (51A, 51B, 51C, 51D) and the hinge parts 52 (52A, 52B, 52C, 52D, 52E, 52F) and drive a pair of the diaphragm 10 (the first diaphragm a11 and the second diaphragm a12). The voice coils 30 ($\mathbf{30}_1$, $\mathbf{30}_2$) are arranged in the magnetic gap 20G of the magnetic circuit 20, which is attached to the attaching portion 12*p* of the frame 12. In FIG. 31(*a*), the voice coils 30 are supported by holding part (not shown) and in FIG. 31(*b*), the movement of the voice coil is restricted by the damper D in addition to the holding part.

The embodiment shown in FIG. 32(*a*) is the same as the embodiment shown in FIG. 31(*a*) except that the link part 51 includes link parts 51E, 51F, 51G, 51H and 51I in addition to the above-mentioned example shown in FIG. 31(*a*) and the central part of the diaphragm 10 has a concave portion. The embodiments, shown in FIGS. 32(*b*) and 32(*c*), include two voice coils $\mathbf{30}_1$, $\mathbf{30}_1$ vibrating substantially in the same direction and two voice coils $\mathbf{30}_2$, $\mathbf{30}_2$ vibrating substantially in the same direction, moving toward or away from the two voice coils $\mathbf{30}_1$, $\mathbf{30}_1$. The vibration direction converter part 50 has the link body having the first link part 51A and the second link part 51B supported by four corners of a rectangular fixing frame 50P. The voice coil 30 ($\mathbf{30}_1$, $\mathbf{30}_1$, $\mathbf{30}_2$, $\mathbf{30}_2$) is arranged in the magnetic gap 20G of the corresponding magnetic circuit 20, and magnetic circuits 20 are arranged in proximity with each other are connected via the vibration restraining member 350.

In the embodiments shown in FIGS. 31 and 32, the vibration direction converter part 50 is substantially symmetrically arranged with respect to a central axis in the vibration direction of the voice coil 30, and the vibration direction converter part 50 vibrates a pair of the diaphragms 10 (the first diaphragm a11 and the second diaphragm a12). As such, the vibrations of the link parts 51 of the link body 50L are substantially symmetrically generated with respect to the above-mentioned central axis, and thus interference between each link part 51 may cancel out with each other. Accordingly, the trouble such as resonance phenomenon caused by the vibration of the vibration direction converter part 50 may be restrained.

In the embodiments shown in FIGS. 30 and 32, when the interval of the diaphragms 10 (the first diaphragm a11 and the second diaphragm a12) is comparatively small, the speaker unit 1U can be deemed as a point sound source at frequency range with comparatively long wavelength (comparatively low frequencies). Thus, an output sound pressure characteristic at low frequencies is not affected by baffle board area (area of a part of frame 12 supporting and surrounding the diaphragms 10, 10), and thus the speaker device 1U may generate good reproduced sound at low frequencies. Further, with substantially the same mechanical impedance as mentioned above, reaction forces on each link part of the vibration direction converter part 50 applied from the diaphragm 10, may cancel out with each other. Further, as in FIG. 30, the voice coil 30 of the speaker units 1U, may be connected to the voice coil support part 40 directly or via the vibration restraining member 350 as shown in FIG. 32(*c*). When the connecting parts 60, 60 are connected directly or via other member, generation of unwanted vibration may be restrained, acoustic characteristic may be improved.

In the embodiments shown in FIGS. 32(*a*) to 32(*c*), the static part (frame 12) is arranged between the first diaphragm a11 and the second diaphragm a12, and the magnetic circuit 20 is supported by the static part (frame 12). In these examples, the voice coil support part 40 functions as a link connecting part of the diaphragm connecting part. Accordingly, a plurality of the voice coils 30 are connected to one end of this link connecting part, and the vibration of the link connecting part angle-varies the link parts 51, 52, and thus the first diaphragm a11 and the second diaphragm synchronously vibrate.

In the embodiments shown in FIGS. 30 to 32, the voice coil 30 is vibratably held by the holding part 15 as shown in FIGS. 23 to 29. More specifically, the holding part 15 includes the first holding part 15A and the second holding part 15B, and the first holding part 15A is arranged on the side of the diaphragm connecting part (vibration direction converter part 50) of the voice coil 30 while the second holding part 15B is arranged on the opposite side of the diaphragm connecting part (vibration direction converter part 50) of the voice coil 30.

Figure 33:
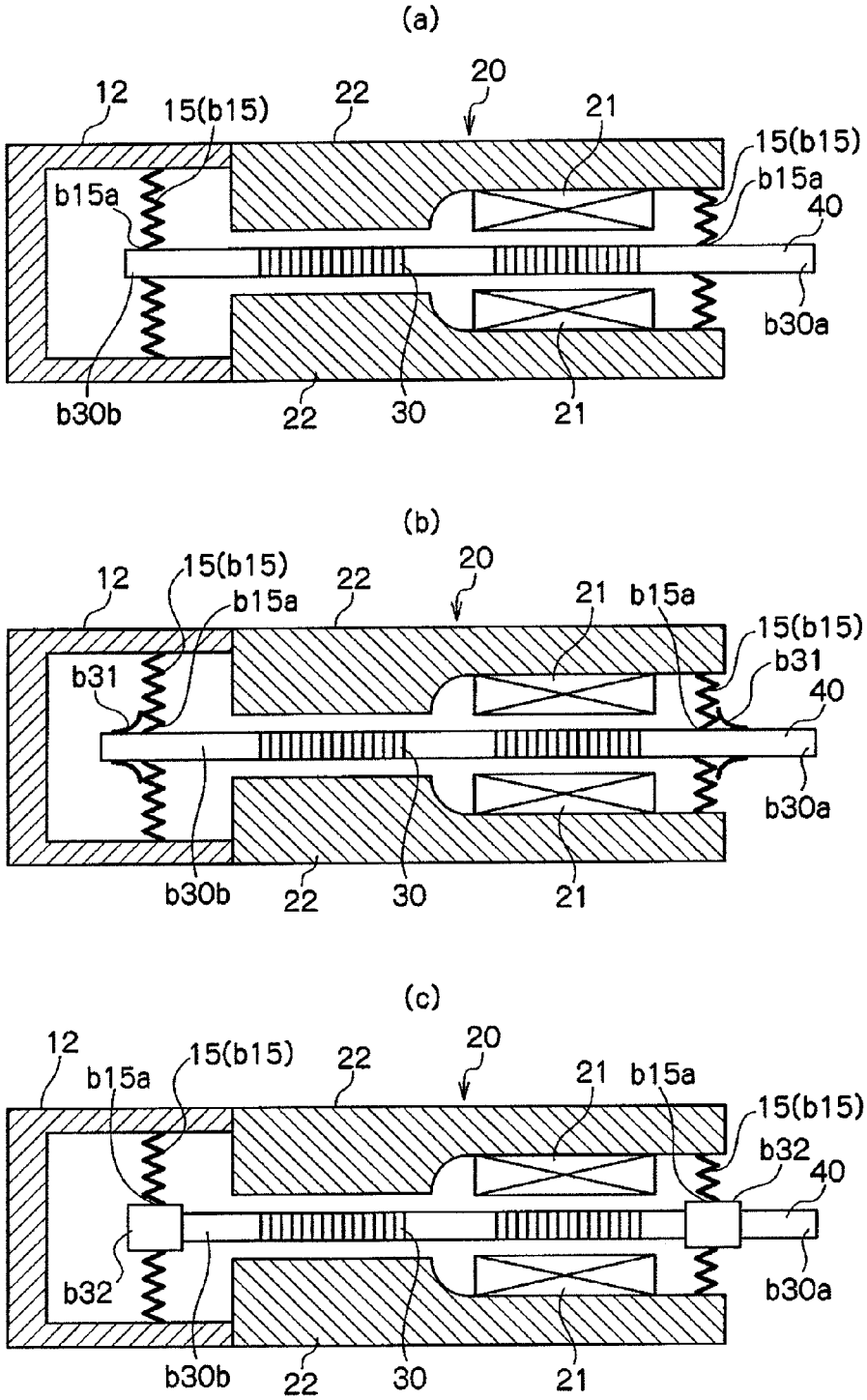
FIGS. 33(*a*)-(*c*) are views illustrating another embodiment of a holding part holding the voice coil.
Figure 34:
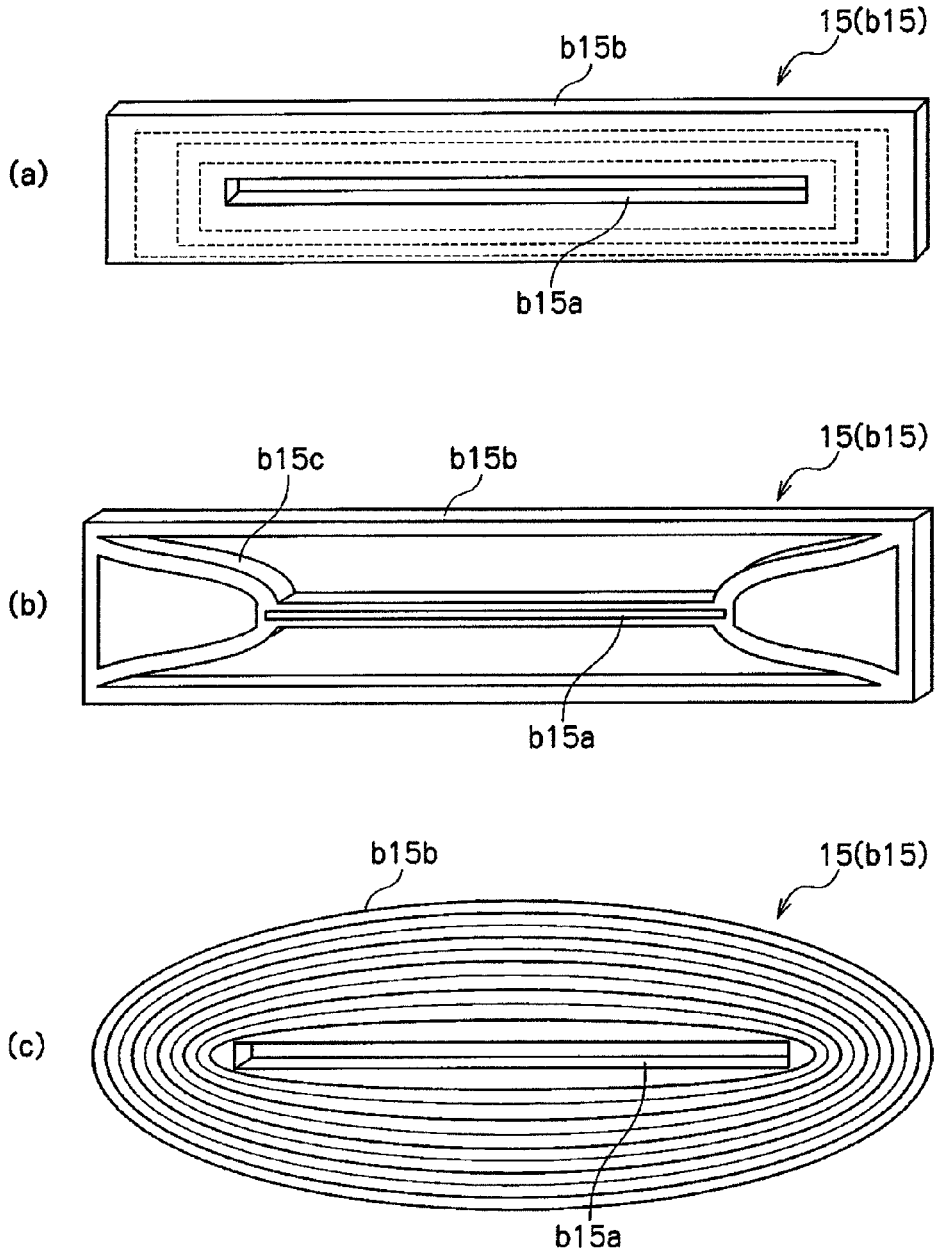
FIGS. 34(*a*)-(*c*) are views illustrating another embodiment of a holding part holding the voice coil.

FIGS. 33 and 34 are views illustrating another embodiment of the holding part 15 holding the above voice coil 30. In this example, the voice coil 30 (or voice coil support part 40) is supported by the static part (frame 12 or magnetic circuit 20, etc.) via the annular holding part 15 (b15) surrounding the voice coil 30 (or voice coil support part 40).

A plurality of the holding part 15 (b15) are provided. The voice coil 30 has one end b30*a* on the side of the diaphragm connecting part (or vibration direction converter part) and the other end b30*b* on the opposite side of the diaphragm connecting part (or vibration direction converter part). The inner periphery parts of the plurality of the holding parts 15 (b15) are attached to the end b30*a* and the end b30*b* of the voice coil 30, while the outer periphery parts of the plurality of the holding part 15 (b15) are attached to the static part (frame 12, magnetic circuit 20 etc.).

Further, the one end b30*a* of the voice coil (voice coil support part 40) is arranged inside the magnetic circuit 20, while the other end b30*b* of the voice coil 30 (voice coil support part 40) is arranged outside the magnetic circuit 20, and the plurality of the holding parts 15 (15*b*) support the voice coil 30 on the static part (frame 12, magnetic circuit 20, etc.) inside and outside the magnetic circuit 20.

According to the example shown in FIG. 33(*a*), the holding part 15 (b15) includes an attachment hole b 15*a* in which the voice coil 30 (voice coil support part 40) is inserted, and the end of the voice coil 30 (voice coil support part 40) is inserted in this attachment hole b15*a*. According to the example shown in FIG. 33(*b*), as in the example shown in FIG. 3(*a*), the end of the voice coil 30 (or voice coil support part 40) is inserted in the attachment hole b 15*a*, and a retaining stopper b31 is fixed on the voice coil 30 (or voice coil support part 40). According to the example shown in FIG. 33(*c*), a rigid voice coil ring b32 is fixed on the voice coil 30 (voice coil support part 40), and this voice coil ring b32 is fitted in the attachment hole b15*a*.

FIG. 34 is a view illustrating an embodiment of the above holding part 15 (b15). In FIG. 34(*a*), the holding part includes a corrugated shape. The holding part includes the periphery b15*b* formed in a rectangular shape and the above-mentioned attachment hole b15*a* formed in the center position. In FIG. 34(*b*), the holding part includes a shape of a butterfly damper. The holding part includes the periphery b15*b* formed in a rectangular shape and an elastic support part b 15*c*. The elastic part b15*c* supports a part of the holding part forming the attachment hole b15*a*. In FIG. 34(*c*), the holding part includes a corrugated shape. The holding part includes the periphery b15*b* formed in a closed shape (circle, ellipse, oval, etc.) and the attachment hole b15*a*. The holding part may include a hard portion around the attachment hole b15. The outer periphery of the hard portion is similar to the ridge line formed with a top portion of the corrugatin. This hard portion may, for example, be formed with a hard resin member, or if the holding part 15 is formed with a fiber member such as a nonwoven fabric or a woven material, it may be formed by mixing or impregnating a fiber member with a resin member such as phenol resin.

The holding part 15 is not limited to the examples shown in the drawings. The end of the holding part 15 on the side of the voice coil 30 or the inner periphery part of the holding part 15 on the side of the voice coil 30 may be attached to the end edge of the voice coil 30 facing the side face of the static part, while the outer periphery part of the holding part 15 may be attached to the static part. This holding part 15 may be made of a fiber member, a fiber member impregnated with a resin member, a resin member or a elastic metal material.

Figure 35:
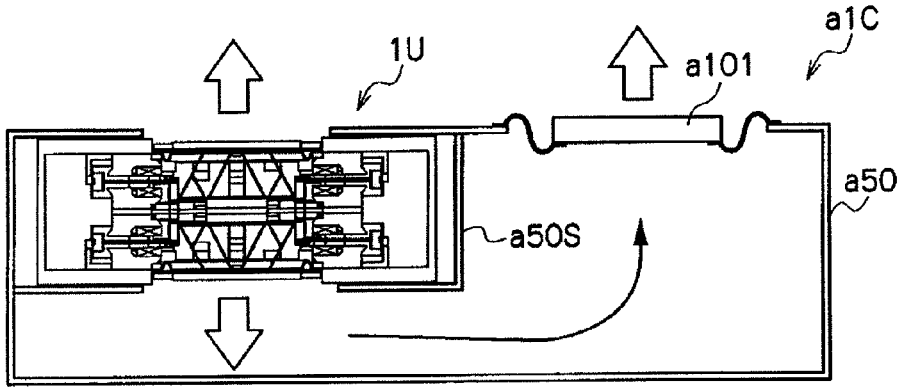
FIG. 35 is a view illustrating a structure of the speaker device (FIG. 35(*a*)) including the speaker unit shown in FIGS. 30 to 32 and sound pressure frequency characteristics (FIG. 35(*b*): frequency Hz in horizontal axis and sound pressure dB in vertical axis)
Figure 35:
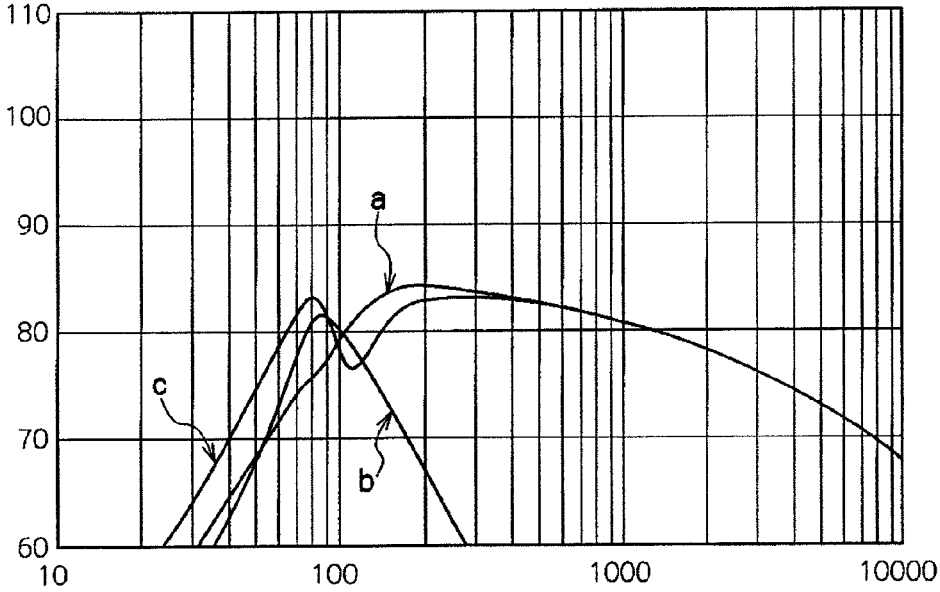

FIG. 35 is a view illustrating a structure of the speaker device a1C (FIG. 35(*a*)) including the speaker unit shown in FIGS. 30 to 32 and sound pressure frequency characteristics (FIG. 35(*b*): frequency Hz in horizontal axis and sound pressure dB in vertical axis). The space surrounded by the first diaphragm a11, the second diaphragm a12, the edge a14 and the diaphragm support part a15 may be substantially sealed, or a cabinet a50S described below may be provided with a duct having a sound emitting part. The speaker unit 1U shown in FIGS. 30 to 32 can form the speaker device a1C when the speaker unit 1U is mounted on or in various types of cabinets. In the example shown in the drawing, the speaker unit 1U is mounted in a cabinet a50 supporting a passive vibrating body a101 having at least a diaphragm.

In this embodiment, the speaker unit 1U with two sound emission surfaces is mounted in a child cabinet a50*s* and a cabinet a50 including a passive vibrating body a101 is provided outside the child cabinet a50*s*. One of the sound emission surfaces of the speaker unit 1U faces outside of the cabinet a50, which is the same side as the sound emission surface of the passive vibrating body a101, while another sound emission surface of the speaker unit 1U faces inside the cabinet a50. Although an example of the speaker device including the passive vibrating body a101 as a passive radiator shown here, the speaker device may include a duct in place of the passive vibrating body a101. Further, the inner periphery part of an edge may be arranged on the upper face or the lower face of the passive vibrating body a101, and the outer periphery part of the edge may be arranged on the upper face or the lower face of the cabinet a50.

Since the speaker unit 1U can vibrate the diaphragms 10 (the first diaphragm a11 and the second diaphragm alt) substantially with the same amplitude so as to move toward or away from each other, the speaker unit 1U can forcibly vibrate the passive vibrating body a101 by change of pressure in the cabinet a50. In this case, the vibration of the diaphragm facing outside in the speaker unit 1U can be substantially in the same phase as the vibration of the passive vibrating body a101 particularly at frequency range lower than the antiresonant frequency in the speaker device a1 (a1A, a1B) described above. As such, a speaker system, effectively reproducing sound at ultra low frequency range, can be realized. In this case, with one of the sound emission surfaces of the speaker unit 1U facing outside, reproduction from low frequency range to mid-frequency range can be realized.

The speaker unit 1U can accurately vibrate the diaphragms 10, 10 (the first diaphragm a11 and the second diaphragm a12) substantially with the same amplitude of vibration in the directions opposite with each other by connecting the link body of the vibration direction converter part 50, which functions as a diaphragm connecting part.

The sound pressure frequency characteristic of the speaker device a1C is the characteristic c combining a characteristic a of the speaker unit 1U and characteristic b of the passive vibrating body a101, as shown in FIG. 35(*b*), and thus sound pressure at low frequency range may be effectively increased.

Figure 36:
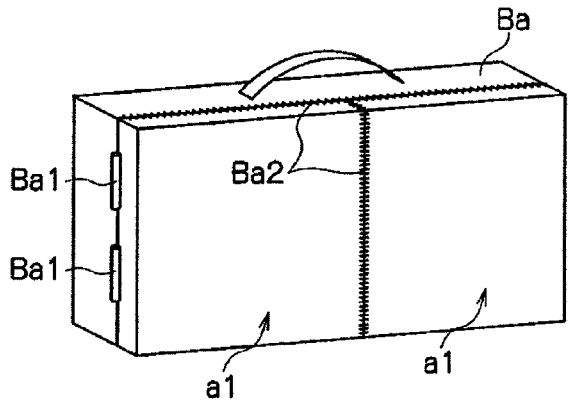
FIGS. 36(*a*) and (*b*) are views illustrating a mounting example of the speaker device according to an embodiment of the present invention.
Figure 36:
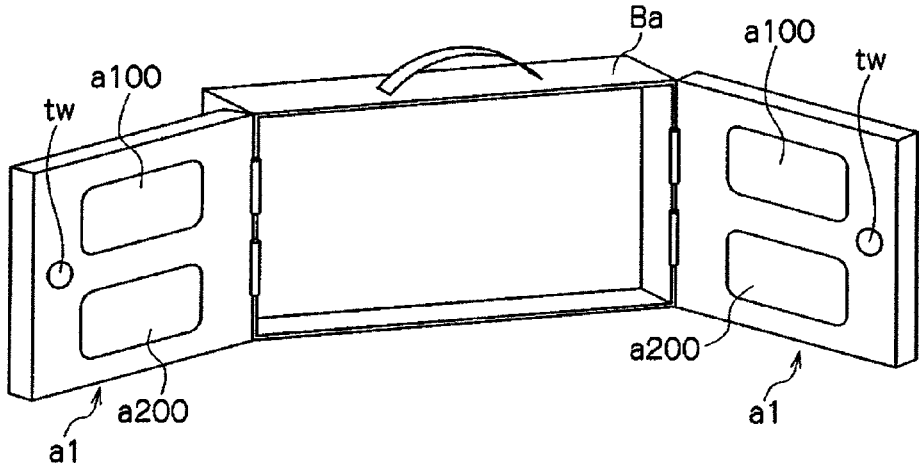

FIGS. 36 to 39 are views illustrating mounting examples of the speaker device according to an embodiment of the present invention. FIG. 36 is a view illustrating an example that the speaker device a1 (a1A, a1B, a1C) is mounted in a bag like an attache case. The side portions of speaker devices a1, a1 are connected to a case Ba with hinges Ba1. When opening a fastener part Ba2 shown in FIG. 36(*a*) illustrating a portable state of the case, the speaker devices a1, a1 are opened side-by-side as shown in FIG. 36(*b*), and the speaker vibrating body a100 that is a passive vibrating body, the speaker unit a200, and a speaker unit tw (tweeter) reproducing sound at high frequency range added on as necessary, etc. are exposed. A space inside the case Ba functions as a bag, an electronic device (mobile phone, portable display device (TV), radio, or audio devices such as disk reproducer, tape reproducer, etc.) may be placed. Further, for example, with the hinge Ba1 that can have an energization function enabling transmission of audio signal, an audio device can input an audio signal to the speaker device a1 and the speaker device can generate a reproduced sound.

Figure 37:
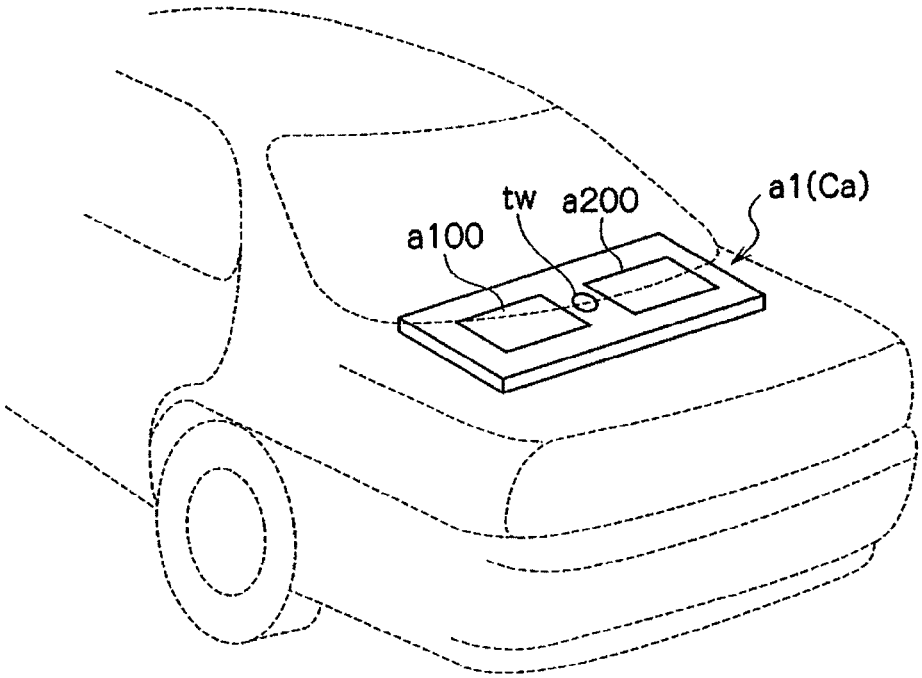
FIG. 37 is a view illustrating a mounting example of the speaker device according to an embodiment of the present invention.

FIG. 37 is a view illustrating an example of the speaker device a1 (a1A, a1B, a1C) mounted on a rear tray Ca of an automobile. A thin speaker device a1 itself may be a rear tray Ca or the speaker device a1 may be incorporated in a part of the rear tray Ca. The speaker vibrating body a100, speaker unit a200, and a single or a plurality of speaker units (tweeter) reproducing sound at high frequency range as necessary, may be placed on the upper face of the rear tray Ca.

Figure 38:
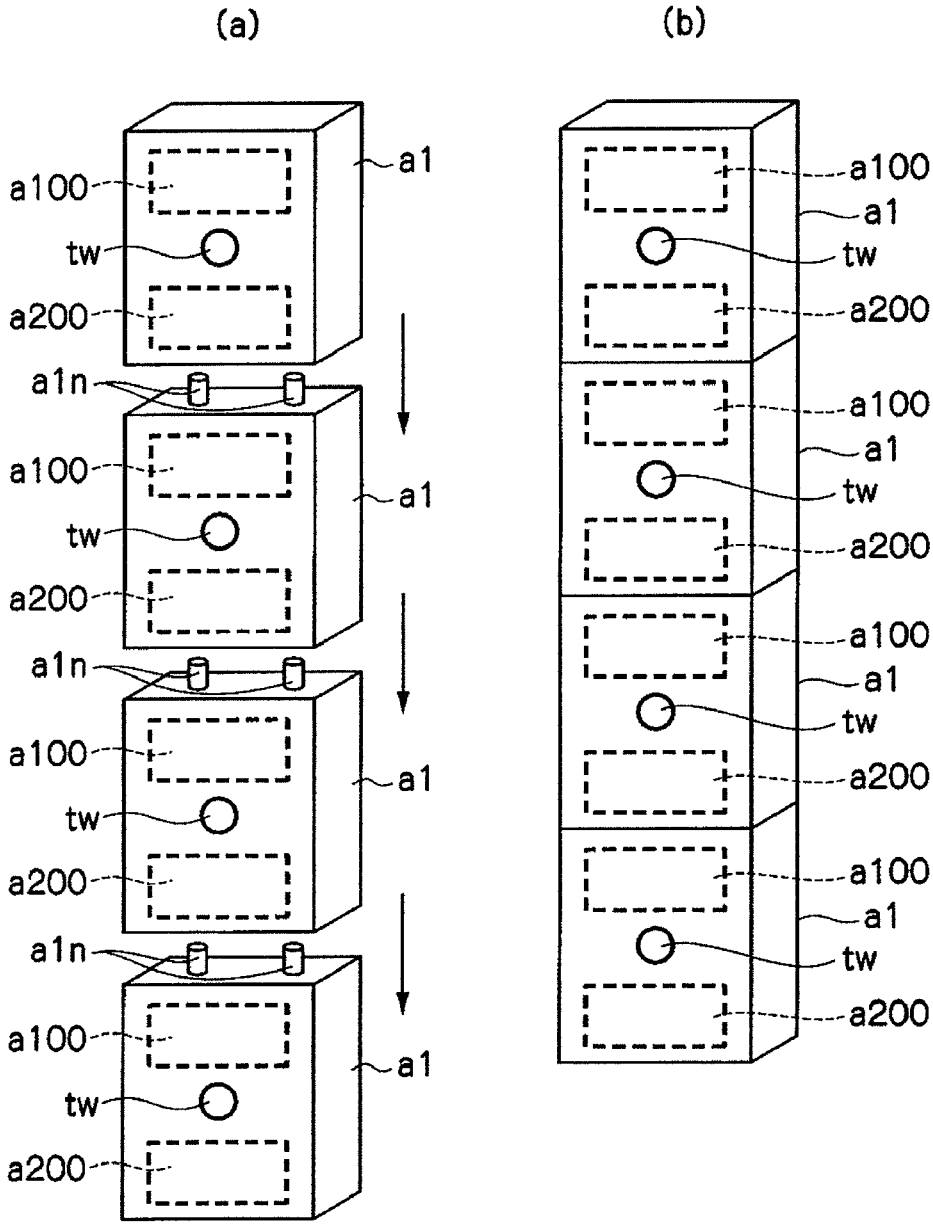
FIGS. 38(*a*) and (*b*) are views illustrating a mounting example of the speaker device according to an embodiment of the present invention.

FIG. 38 is a view illustrating box type speaker devices a1 (a1A, a1B, a1C) arranged in a stack structure. Each speaker device a1, arranged in a stack structure, is connected with speaker connector a1*n*, which is a connecting rod. Also, the speaker connector a1*n* acts as audio signal path between each speaker device a1. FIG. 38(*a*) shows a state before connection and FIG. 38(*b*) shows a state after connection. The speaker vibrating body a100, the speaker unit a200, and the speaker unit tw (tweeter) reproducing sound at high frequency range added on as necessary, may be placed on the front face of the box.

Figure 39:
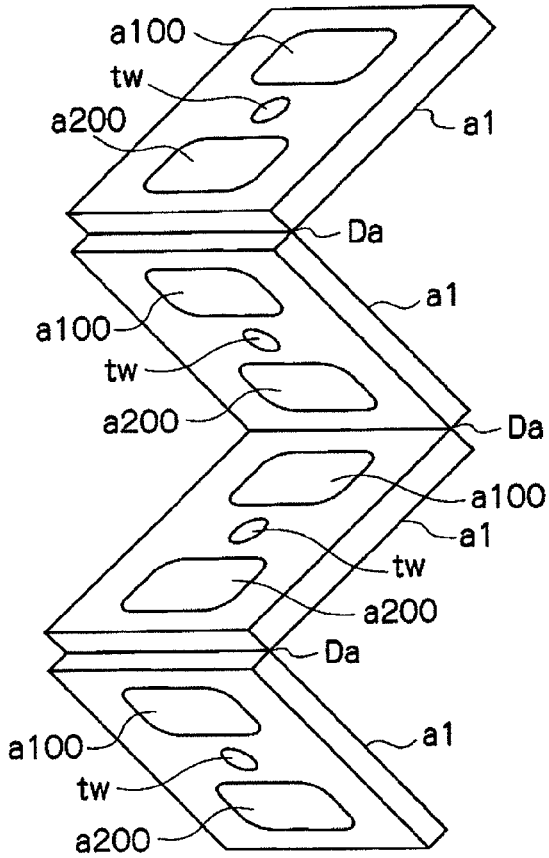
FIGS. 39(*a*) and (*b*) are views illustrating a mounting example of the speaker device according to an embodiment of the present invention.
Figure 39:
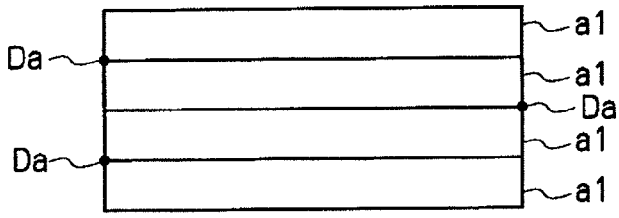

FIG. 39 is a view illustrating an example of an electronic device in which a plurality of speaker devices a1 are connected so as to be foldably stored. The ends of the speaker devices a1 are connected with hinges Da, and an unfolded state as shown in FIG. 39(*a*) or a folded state as shown in FIG. 39(*b*) can be selected. The hinge Da also acts as a signal path between each speaker device a1. These speaker devices a1, when used, can be unfolded and hung on the wall or leaned in an automobile or room as shown in FIG. 39(*a*), while they can be folded and compactly carried, as shown in FIG. 39(*b*). The speaker vibrating body a100, the speaker unit a200, and the speaker unit tw (tweeter) reproducing sound at high frequency range added on as necessary, may be placed on the front face of the speaker device a1 when unfolded.

Figure 40:
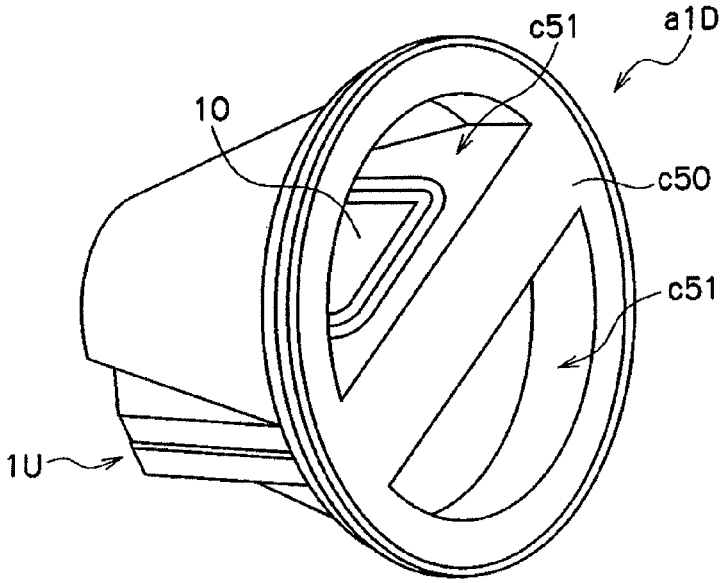
FIGS. 40(*a*) and (*b*) are views illustrating a configuration example of the speaker device according to an embodiment of the present invention.
Figure 40:
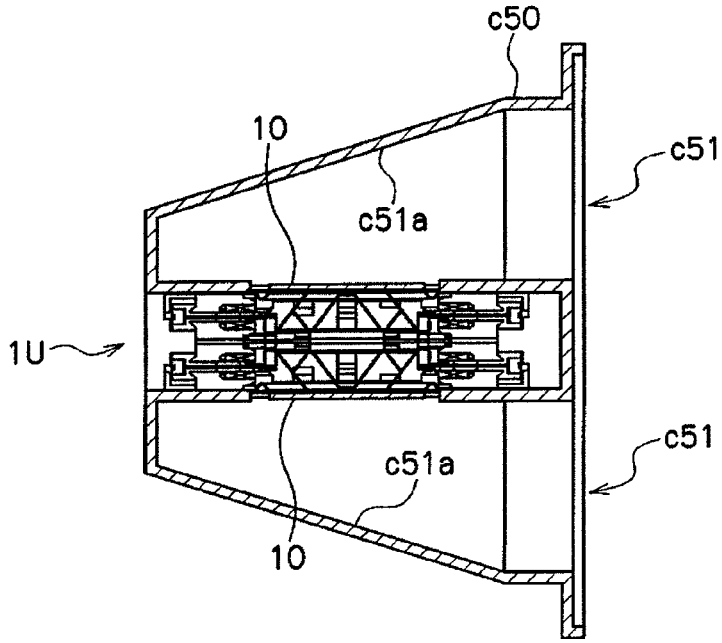

FIG. 40 is a view illustrating a configuration example of the speaker device a1D including speaker units 1U shown in FIGS. 30 to 32 (FIG. 40(*a*) is a perspective view and FIG. 40(*b*) is a vertical cross-sectional view). In this example, the speaker unit 1U is connected with a cabinet c50. In this example, the speaker unit 1U with two sound emission surfaces is connected with a cabinet c50 having two sound emission holes c51, c51, and two diaphragms 10, 10 are directed toward the two sound emission holes c51, c51. The sound emission openings c51, c51 include acoustic reflection surfaces c51*a*, c51*a* respectively, and sound emitted from the diaphragm 10, 10 is reflected on the acoustic reflection surfaces c51*a*, c51*a* and emitted from the sound emission holes c51, c51.

These speaker devices are effectively used as various types of electronic devices or in-car devices. For example, an electronic device such as a mobile phone, a handheld terminal or a flat panel display has a housing as an attaching counterpart in which the speaker device 1 is housed. The speaker device 1 is also attached to the side face of the housing as the attaching counterpart of the electronic device. Since installation space in thickness direction required for the speaker device 1 may be small, the whole electronic device may be made thin. Further, sufficient audio output may be produced even by the electronic device made thin.

Further, with the speaker device applied to an automobile, in-car space may be widened. More particularly, the speaker device according to the embodiment of the present invention, even if attached to a door panel, ceiling, rear tray or a dashboard as the attaching counterpart, may comparatively reduce a bulge projecting into in-car space, and thus enabling to widen driver's space or in-car space. Further, with sufficiently produced audio output, it is possible to enjoy listening to music or radio broadcasting pleasantly in a car even when driving on a noisy highway. The electronic device as shown in FIG. 40 may be attached to the attaching counterpart such as a rear tray, etc. in an automobile, and thus a desirable acoustic field may be created in accordance with the number of passengers or seating positions in the automobile.

Further in a resident building, a hotel, an inn or a training facility as a building including a speaker device a1, when the speaker device 1 is provided on a wall or ceiling as the attaching counterpart, installation space in thickness direction required for the speaker device a1 may be reduced and thus enabling to save space in a room and make effective use of space. The hotel is capable of holding an event and accommodating many guests for conference, meeting, lecture, party, etc. Further, providing a room equipped with audiovisual equipment can be seen in recent years along with prevalence of a projector or a big-screen TV. On the other hand, there is also seen a living room, etc. used as a theater room without room equipped with audiovisual equipment. Also in this case, the living room, etc. can be easily converted to a theater room with the speaker device a1 while making effective use of space in the living room. More particularly, the placement at which the speaker device a1 is arranged may be, for example, ceiling or wall, etc. (attaching counterpart).

Other examples of the application of the speaker device a1 are described hereinafter. The speaker device 1 can be effectively applied to sound reproduction means for announcing to a user operating condition of home appliance such as a refrigerator, washing machine, control panel of water heater in bath room, microwave oven, air conditioner, watch, rice cooker, oil fan heater, etc. It also can be effectively applied to an acoustic generation element for dramatic impact of amusement machine such as a pachinko, slot panel or entertainment device, and a headphone, earphone, hearing aid, music instrument speaker, speaker for amplifying a sound, speaker for studio, speaker for a hall, speaker for karaoke, etc.

Further, the speaker device a1, used in road noise reduction system as shutting off body of shutting off external sound, also can be attached to the predetermined attaching counterpart such as wall surface of roads. Moreover, the speaker device a1 may be effectively used as a vibration generation device and a body sensory actuator (body sonic, etc.).

Although the embodiments according to the present invention are described with reference to the drawings, specific configurations are not limited to these embodiments, and even modifications not departing from the subject matter of the present invention are included in the scope of the present invention. Further, the technology of each embodiment described above can be used by each other, unless specific contradictions or problems are found in their objects, the configurations, etc. In addition, PCT/JP2008/051197 filed on Jan. 28, 2008, PCT/JP2008/068580 filed on Oct. 14, 2008, PCT/JP2008/069480 filed on Oct. 27, 2008, PCT/JP2008/069269 filed on Oct. 23, 2008, PCT/JP2009/053752 filed on Feb. 27, 2009, PCT/JP2009/053592 filed on Feb. 26, 2009, PCT/JP2009/050764 filed on Jan. 20, 2009, PCT/JP2009/055533 filed on Mar. 19, 2009, PCT/JP2009/055496 filed on Mar. 19, 2009, PCT/JP2009/055497 filed on Mar. 19, 2009, PCT/JP2009/055498 filed on Mar. 19, 2009, PCT/JP2009/055534 filed on Mar. 19, 2009, PCT/JP2009/055523 filed on Mar. 19, 2009, PCT/JP2009/055524 filed on Mar. 19, 2009, PCT/JP2009/055525 filed on Mar. 19, 2009, PCT/JP2009/055526 filed on Mar. 19, 2009, PCT/JP2009/055527 filed on Mar. 19, 2009, PCT/JP2009/055528 filed on Mar. 19, 2009, PCT/JP2009/62482 filed on Jul. 9, 2009, PCT/JP2009/62483 filed on Jul. 9, 2009, PCT/JP2009/62484 filed on Jul. 9, 2009, PCT/JP2009/62477 filed on Jul. 9, 2009, PCT/JP2009/62478 filed on Jul. 9, 2009, PCT/JP2009/62479 filed on Jul. 9, 2009, PCT/JP2009/62480 filed on Jul. 9, 2009, PCT/JP2009/62481 filed on Jul. 9, 2009, PCT/JP2009/063524 filed on Jul. 28, 2009, PCT/JP2009/063525 filed on Jul. 28, 2009, PCT/JP2009/063526 filed on Jul. 28, 2009, PCT/JP2009/063527 filed on Jul. 28, 2009 and JP2009/238688 filed on Oct. 15, 2009 are incorporated by reference into the present application.

The invention claimed is:

1. A speaker vibrating body vibrated by a driving part, comprising:

a plurality of diaphragms; and a diaphragm connecting part, provided between a first diaphragm and a second diaphragm among said plurality of diaphragms, coupling said first diaphragm and said second diaphragm and synchronously moving said first diaphragm and said second diaphragm toward or away from each other, wherein said diaphragm connecting part includes a link body formed with a rigid link part, and wherein said link body includes a bendable or foldable hinge part formed between said link part and said diaphragm.

2. The speaker vibrating body according to claim 1, wherein said diaphragm connecting part has a reference face between said first diaphragm and said second diaphragm, and said first diaphragm and said second diaphragm move toward or away from each other with respect to said reference face, and said reference face is substantially static with respect to said first diaphragm and said second diaphragm moving toward or away from each other, and integrally vibrates with respect to integral vibration of said first diaphragm and said second diaphragm.

3. The speaker vibrating body according to claim 1, wherein said link part includes a first link part having hinge parts at one end on the side of said first diaphragm and the other end and a second link part having hinge parts at one end on the side of said second diaphragm and the other end, and said link body includes a link connecting part coupling the other end of said first link part and the other end of said second link part such that said first link part and said second link part vary an angle upon vibration of said first diaphragm or said second diaphragm.

4. The speaker vibrating body according to claim 3, wherein said first link part and said second link part are obliquely provided in the directions opposite to each other with respect to the vibration direction of said diaphragm, and said link connecting part is movably provided in a direction crossing the vibration direction of said diaphragm.

5. The speaker vibrating body according to claim 4, wherein a bendable or foldable hinge part is formed between the other end of said first link part and the other end of said second link part, and said link connecting part.

6. The speaker vibrating body according to claim 5, wherein the outer peripheries of said first diaphragm and said second diaphragm are vibratably supported by a tubular diaphragm support part surrounding a space between said first diaphragm and said second diaphragm.

7. The speaker vibrating body according to claim 6, wherein the outer periphery of said diaphragm is supported by said diaphragm support part via an edge.

8. The speaker vibrating body according to claim 7, wherein the link body of said diaphragm connecting part is substantially symmetrically formed with respect to the central axis between said first diaphragm and said second diaphragm.

9. The speaker vibrating body according to claim 8, wherein said link part is coupled to an attaching counterpart including said diaphragm via said hinge part, and a contact avoiding part avoiding contact with said hinge part is formed on the surface of said link part in the proximity of said hinge part of said attaching counterpart.

10. The speaker vibrating body according to claim 8, wherein said link part includes a coupling part coupling said link part to said attaching counterpart including said diaphragm via said hinge part, and said coupling part is joined to said attaching counterpart with adhesive material, and an adhesive material housing part, housing said adhesive material so as not to adhere to said hinge part, is formed on the surface of said link part opposing said hinge part of said attaching counterpart.

11. The speaker vibrating body according to claim 9, wherein said hinge part is formed with a bendable continuous member continuing between the parts of both sides over the hinge part.

12. A speaker device comprising a speaker vibrating body according to claim 3, said driving part, and a cabinet as a static part supporting said driving part, wherein said speaker vibrating body is a passive vibrating body, said driving part is a speaker unit supported by said cabinet at a position different from said speaker vibrating body, and air pressure, generated by the drive of said speaker unit on the opposite side of the sound emission surface of said speaker unit, drives said speaker vibrating body.

13. The speaker device according to claim 12, wherein said first diaphragm and said second diaphragm vibrate substantially with the same amplitude of vibration in the directions opposite each other.

14. The speaker device according to claim 13, wherein said link connecting part is supported by said static part vibratably in a direction crossing the vibration direction of said diaphragm.

15. A speaker device comprising said speaker vibrating body according to claim 3, said driving part, and a cabinet as a static part supporting said driving part, and a passive vibrating body supported by said cabinet, including at least a diaphragm, wherein said first diaphragm includes a sound emission surface emitting a sound wave, and said second diaphragm arranged on the side of said cabinet with respect to said first diaphragm includes a driving force emission surface driving said passive vibrating body.

16. The speaker device according to claim 15, wherein said second diaphragm is configured with an acoustic adjustment member.

17. The speaker device according to claim 16, wherein said acoustic adjustment member is a member having large weight compared to said first diaphragm, or a member having a plurality of openings.

18. A speaker device comprising said speaker vibrating body according to claim 3, said driving part, and a cabinet as a static part supporting said driving part, wherein said driving part includes a voice coil connected with said diaphragm connecting part directly or via other member, and a magnetic circuit supported by said static part, having a magnetic gap, said voice coil includes a tabular and annularly wound conducting member and a rigid base supporting said conducting member, and a conducting layer is pattern-formed on the outside surface of said conducting member of said base.

19. The speaker device according to claim 18, wherein a pair of said conducting layers are placed so as to surround said conducting member, and functions as a junction wire to input an audio signal to said conducting member.

20. The speaker device according to claim 19, further comprising a holding part vibratably holding said voice coil at said static part directly or via other member.

21. An electronic device comprising a speaker device, wherein said speaker device includes said speaker vibrating body according to claim 11 and said driving part.

22. An automobile comprising a speaker device, wherein said speaker device includes said speaker vibrating body according to claim 11 and said driving part.

23. A building comprising a speaker device, wherein said speaker device includes said speaker vibrating body according to claim 11 and said driving part.

* * * * *